US007672768B2

(12) United States Patent
Narisawa et al.

(10) Patent No.: US 7,672,768 B2
(45) Date of Patent: Mar. 2, 2010

(54) OPERATION ASSIST APPARATUS

(75) Inventors: Junichi Narisawa, Adachi-ku (JP); Toshiyuki Miyamoto, Tsukube (JP); Kenichi Sagiya, Makabe (JP); Hidefumi Ishimoto, Niihari (JP); Sumio Morita, Tsukuba (JP); Kouichi Madarame, Ishioka (JP); Kenya Shyouji, Tsuchiura (JP); Hiroshi Ogura, Ryugasaki (JP); Hiroshi Watanabe, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 1518 days.

(21) Appl. No.: 10/508,330

(22) PCT Filed: Mar. 25, 2003

(86) PCT No.: PCT/JP03/03605

§ 371 (c)(1),
(2), (4) Date: Sep. 20, 2004

(87) PCT Pub. No.: WO03/084855

PCT Pub. Date: Oct. 16, 2003

(65) Prior Publication Data

US 2005/0192732 A1 Sep. 1, 2005

(30) Foreign Application Priority Data

Mar. 25, 2002 (JP) ..... 2002-083313
Aug. 5, 2002 (JP) ..... 2002-227752

(51) Int. Cl.
*B66C 23/90* (2006.01)

(52) U.S. Cl. ..... 701/50; 340/438

(58) Field of Classification Search ..... None
See application file for complete search history.

(56) References Cited

U.S. PATENT DOCUMENTS 5,730,305 A * 3/1998 Ichiba et al. ..... 212/276
5,731,974 A 3/1998 Pietzsch et al.
5,823,370 A 10/1998 Ueda
5,854,988 A * 12/1998 Davidson et al. ..... 701/50
6,343,237 B1 * 1/2002 Rossow et al. ..... 700/83
6,766,600 B2 * 7/2004 Ogura et al. ..... 37/348

FOREIGN PATENT DOCUMENTS

EP 0 768 588 A2 4/1997
EP 0 857 687 A1 8/1998

(Continued)

OTHER PUBLICATIONS

English Translation of Japanese Office Action issued in JP Application No. 2002-227752 mailed Oct. 27, 2009.

*Primary Examiner*—Michael J. Zanelli
(74) *Attorney, Agent, or Firm*—Oliff & Berridge, PLC

(57) ABSTRACT

An operation assist apparatus includes a display device installed in an operator's cab of a construction machine, at which at least operating procedures for the construction machine are displayed with text and illustrations; an image processing device that generates images; and a control device that engages the image processing device to generate an image of an operating procedure corresponding to an operation of the construction machine and engages the display device to display the image generated by the image processing device.

21 Claims, 68 Drawing Sheets

FOREIGN PATENT DOCUMENTS

| | | |
|---|---|---|
| JP | A-61-49035 | 3/1986 |
| JP | 07-138994 | 5/1995 |
| JP | A 8-133681 | 5/1996 |
| JP | A 9-110369 | 4/1997 |
| JP | A 10-237905 | 9/1998 |
| JP | A-11-310393 | 11/1999 |
| JP | A-2001-335286 | 12/2001 |
| JP | A 2002-23791 | 1/2002 |
| JP | 2002-081096 A | 3/2002 |
| WO | WO 02/40783 A1 * | 5/2002 |

* cited by examiner

FIG. 2
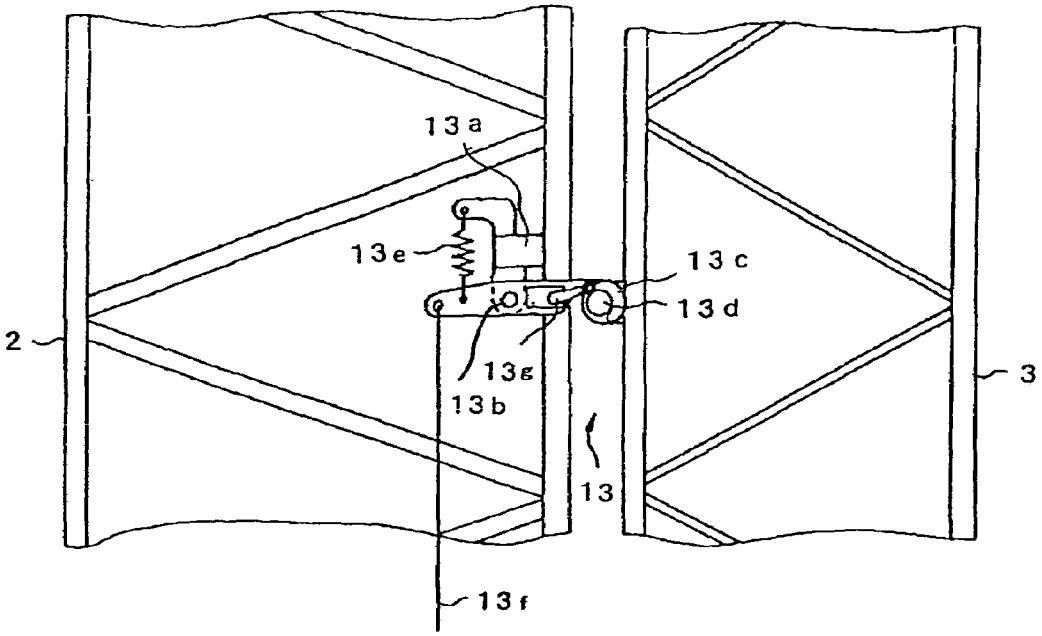
(a)
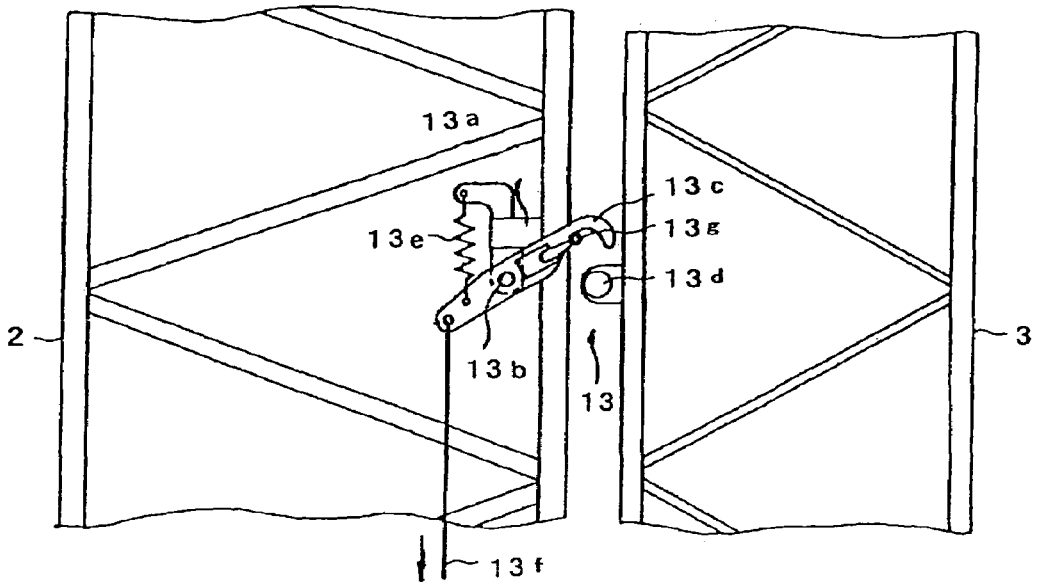
(b)

FIG.11

RAISING GUIDANCE/PRE-RAISE INSPECTION 【4/4】 11:05AM

CHECK THE OVERWIND SAFETY DEVICES.

| | HOOK | | TOWER | | JIB | | BE-LL | BUZZER | |
|---|---|---|---|---|---|---|---|---|---|
| | UP | DO-WN | UP | DO-WN | UP | DO-WN | | OV-ER | ML |
| HOOK | ● | | | ● | | ● | ● | | |
| TOWER 90° | | | ● | | | | | ● | |
| TOWER ULTIMATE | ● | | ● | | ● | | ● | ● | |
| JIB ULTIMATE | ● | | | ● | ● | | ● | ● | |
| OVERLOAD PREVENTING DEVICE | ● | | | ● | | ● | | | ● |

▶ TO NEXT

SELECT | ✕ RETURN | ○ NEXT | △ DISCONTINUE

FIG.12

RAISING GUIDANCE/PRE-RAISE INSPECTION 【4/4】 11:05AM

CHECK THE HOOK OVERWIND PREVENTING DEVICE.

AUTO STOP
○HOOK TAKE-UP
○TOWER TAKE-DOWN
○JIB TAKE-DOWN

ALARM
○BELL

✕ RETURN | ○ NEXT | △ DISCONTINUE

FIG.13

RAISING GUIDANCE/PRE-RAISE INSPECTION 【4/4】 11:05AM

CHECK TOWER 90° OVERWIND PREVENTING DEVICE.

AUTO STOP
○TOWER TAKE-UP

ALARM
○BUZZER

✕ RETURN ○ NEXT ▲ DISCONTINUE

FIG.14

RAISING GUIDANCE/PRE-RAISE INSPECTION 【4/4】 11:05AM

CHECK THE TOWER ULTIMATE OVERWIND PREVENTING DEVICE.

AUTO STOP
○JIB TAKE-UP
○TOWER TAKE-UP
○HOOK TAKE-UP

ALARM
○BELL
○BUZZER

✕ RETURN ○ NEXT ▲ DISCONTINUE

FIG.15

RAISING GUIDANCE/PRE-RAISE INSPECTION 【4/4】 11:05AM

CHECK THE JIB ULTIMATE OVERWIND PREVENTING DEVICE.

AUTO STOP
○JIB TAKE-UP
○TOWER TAKE-DOWN
○HOOK TAKE-UP

ALARM
○BELL
○BUZZER

✕ RETURN ○ NEXT ▲ DISCONTINUE

FIG.16

RAISING GUIDANCE/PRE-RAISE INSPECTION 【4/4】 14:36PM

CHECK THE OVERLOAD PREVENTING DEVICE.

○AN ALARM WILL SOUND 3 SECONDS AFTER ○ KEY IS PRESSED AND AN AUTO STOP SIGNAL IS OUTPUT 6 SECONDS AFTER. VERIFY THAT THE TAKE-UP DRIVE AND THE HOIST-DOWN DRIVE STOP IN RESPONSE TO OPERATING THE LEVERS.

LOAD FACTOR 90%

ALARM
NOT OUTPUT

AUTO STOP
NOT OUTPUT

✕ RETURN ○ START ▲ DISCONTINUE

FIG. 32

PRE-OPERATION INSPECTION 11:05AM

CHECK THE OVERWIND SAFETY DEVICES.

| | HOOK | | TOWER | | JIB | | BE-LL | BUZZER | |
|---|---|---|---|---|---|---|---|---|---|
| | UP | DOWN | UP | DOWN | UP | DOWN | | OVER | ML |
| HOOK | ○ | | | ○ | | ○ | ○ | | |
| TOWER 90° | | | ⊘ | | | | | ⊘ | |
| TOWER ULTIMATE | ⊘ | | ⊘ | | ⊘ | | ⊘ | ⊘ | |
| JIB ULTIMATE | ⊘ | | | ⊘ | ⊘ | | ⊘ | ⊘ | |
| OVERLOAD PREVENTING DEVICE | ⊘ | | | ⊘ | | ⊘ | | | ⊘ |

TO NEXT

SELECT | ✕ RETURN | ○ DETAILS | ▲ DISCONTINUE

FIG. 33

PRE-OPERATION INSPECTION 11:05AM

CHECK THE OVERWIND SAFETY DEVICES.

| | HOOK | | TOWER | | JIB | | BE-LL | BUZZER | |
|---|---|---|---|---|---|---|---|---|---|
| | UP | DOWN | UP | DOWN | UP | DOWN | | OVER | ML |
| HOOK | ⊘ | | | ⊘ | | ⊘ | ⊘ | | |
| TOWER 90° | | | ⊘ | | | | | ⊘ | |
| TOWER ULTIMATE | ⊘ | | ⊘ | | ⊘ | | ⊘ | ⊘ | |
| JIB ULTIMATE | ⊘ | | | ⊘ | ⊘ | | ⊘ | ⊘ | |
| OVERLOAD PREVENTING DEVICE | ⊘ | | | ⊘ | | ⊘ | | | ⊘ |

TO NEXT

SELECT | ✕ RETURN | ○ NEXT | ▲ DISCONTINUE

FIG. 59A

| | POSTURE CLASSIFICATION | CORRESPONDING OPERATION | MAIN: ML | MAIN: POSTURE (REAL) | MAIN: DRUM ROTATIONS | MAIN: OTHER (GUIDANCE) <CAMERA> | LOAD FACTOR | SUB: JIB HOIST CABLE TOO SLACK / TOO TAUT | SUB: TOWER HOIST CABLE TOO SLACK / ABNORMAL | SUB: COUPLING DEVICE ENGAGED / RELEASED | SUB: ENGINE ROTATIONAL SPEED | SUB: WIND VELOCITY/WIND DIRECTION | SUB: OTHER |
|---|---|---|---|---|---|---|---|---|---|---|---|---|---|
| RAISING GUIDANCE | A PRE-RAISE | A1 PRE-RAISE INSPECTION FIGS. 6 TO 9 | | | | (INSPECTION DETAILS) | | ◎ | | ◎ | | | CLUTCH HOSE CONNECTION BRAKE MODE SELECTOR KEY AUXILIARY HOIST BRAKE MODE SELECTOR SWITCH |
| | | A2 OPERATIONS OF OVERWIND PREVENTING DEVICES FIGS. 10 TO 16 | | | | (INSPECTION INSTRUCTIONS) | | | | | | | OVERWIND PREVENTING DEVICE OPERATING STATES |
| | B TOWER RAISING | B1 LIFT OFF/RAISING FIGS. 18, 19 AND 20 | | ◎ | ○ | (LOWER THE SPEED) (OPERATING DIRECTION) | | ○ | ◎ | ○ | ○ | | |
| | | B2 TOWER 70° FIG. 21 | | | | (HOIST PAD) | | | | | | ◎ | |
| | | B3 TOWER 90° OVERWIND FIG. 26 | | | | <90° OVERWIND> | | | | | | | |
| | C JIB RAISING | C1 RELEASE COUPLING DEVICE FIGS. 28 AND 29 | | | | (COUPLING RELEASE) | | | | ◎ | | | |
| | | C2 JIB RAISING FIG. 30 | | ◎ | ○ | (LOWER THE SPEED) (OPERATING DIRECTION) | | ◎ | ◎ | | ◎ | ◎ | |

FIG. 59B

| | POSTURE CLASSIFICATION | CORRESPONDING OPERATION | MAIN | | | | LOAD FACTOR | SUB | | | | | |
|---|---|---|---|---|---|---|---|---|---|---|---|---|---|
| | | | ML | POSTURE (REAL) | DRUM ROTATIONS | OTHER (GUIDANCE) <CAMERA> | | JIB HOIST CABLE TOO SLACK / TOO TAUT | TOWER HOIST CABLE TOO SLACK / ABNORMAL | COUPLING DEVICE ENGAGED / RELEASED | ENGINE ROTATIONAL SPEED | WIND VELOCITY/WIND DIRECTION | OTHER |
| WORK RANGE | D WORK RANGE FIGS. 32 TO 36 | D1 OPERATIONS OF OVERWIND PREVENTING DEVICES FIGS. 32 AND 33 | | | | (INSPECTION INSTRUCTIONS) | | | | | | | OVERWIND PREVENTING DEVICE OPERATING STATES |
| | | D2 DURING WORK FIGS. 34 TO 36 | ◎ | | ◎ | <REAR SIDE> <DRUM> | ◎ | | | | ◎ | ◎ | |

FIG. 59C

| | POSTURE CLASSIFICATION | CORRESPONDING OPERATION | MAIN: ML | MAIN: POSTURE (REAL) | MAIN: DRUM ROTATIONS | MAIN: OTHER (GUIDANCE) <CAMERA> | SUB: LOAD FACTOR | SUB: JIB HOIST CABLE TOO SLACK / TOO TAUT | SUB: TOWER HOIST CABLE TOO SLACK / ABNORMAL | SUB: COUPLING DEVICE ENGAGED / RELEASED | SUB: ENGINE ROTATIONAL SPEED | SUB: WIND VELOCITY/WIND DIRECTION | SUB: OTHER |
|---|---|---|---|---|---|---|---|---|---|---|---|---|---|
| LOWERING GUIDANCE | F TOWER RAISING FIGS. 37 TO 41 | F1 TOWER RAISING FIGS. 37 TO 39 | | ◎ | ○ | (LOWER THE SPEED) (OPERATING DIRECTION) | | | ◎ | | ◎ | ◎ | |
| | | F2 TOWER 90° OVER WIND FIG. 40 | | | | <90° OVERWIND> | | | | | | | |
| | G JIB LOWERING FIGS. 42 TO 46 | G1 JIB LOWERING FIG. 42 | | ◎ | ○ | (LOWER THE SPEED) (OPERATING DIRECTION) | | ◎ | | | ◎ | ◎ | |
| | | G2 HOOK HEIGHT ADJUSTMENT FIG. 44 | | | | (HOOK HEIGHT) | | | | | | | |
| | | G3 COUPLING DEVICE ENGAGEMENT FIGS. 45 AND 46 | | | | (COUPLING DEVICE ENGAGEMENT) | | | | ◎ | | | |
| | H TOWER LOWERING FIGS. 47 TO 56 | H1 TOWER LOWERING FIGS. 49 AND 50 | | ◎ | ○ | (LOWER THE SPEED) (OPERATING DIRECTION) | | ◎ | ◎ | | ◎ | ◎ | |
| | | H2 TOWER 70° FIG. 51 | | | | (HOIST PAD) | | | | | | | |
| | | H3 HOOK GROUNDING FIG. 47 | | | | (HOOK GROUNDING) | | | | | | | |

FIG. 86

HANDLING INSTRUCTIONS 11:05AM

【MOMENT LIMITER】 1/4 PAGE

THIS IS A MOMENT LIMITER SCREEN INDICATING THE STATE OF THE MACHINE.

KEEP THE SCREEN ON DISPLAY WHILE PERFORMING A CRANE WORK.

PRESS [←]TO SWITCH TO THE MAIN LIFTING OPERATION DISPLAY.

(TO BE CONTINUED)

➡ SWITCH PAGE ✕ RETURN

FIG. 87

HANDLING INSTRUCTIONS 11:05AM

【MOMENT LIMITER】 2/4 PAGE

PRESS [→] TO SWITCH TO THE AUXILIARY LIFTING OPERATION DISPLAY.

([←] AND [→] ARE DISPLAYED ONLY WHEN OPERATING A CONSTRUCTION MACHINE EQUIPPED WITH AN AUXILIARY JIB OR A JIB.)

PRESS (○) TO BRING UP THE MENU FOR SWITCHING THE DISPLAY TO A MOMENT LIMITER SUB-FUNCTION SCREEN.

(TO BE CONTINUED)

⬅ ➡ SWITCH PAGE ✕ RETURN

OPERATION ASSIST APPARATUS

INCORPORATION BY REFERENCE

The disclosures of the following priority applications are herein incorporated by reference:

Japanese Patent Application No. 2002-083313 filed Mar. 25, 2002

Japanese Patent Application No. 2002-227752 filed Aug. 5, 2002

TECHNICAL FIELD

The present invention relates to an operation assist apparatus that provides assistance for operations performed by an operator by displaying information such as operating procedures at a display screen installed in a construction machine.

BACKGROUND ART

When transporting a construction machine such as a crawler crane on a truck or the like, it may be necessary to disassemble the boom and the like of the construction machine at the worksite before loading them on the truck and then to reassemble them at the new worksite. Specific setup operations must be performed after assembling the construction machine and before disassembling the construction machine, and the operator performs individual setup steps by referring to the instruction manual.

However, the setup operations, during which numerous steps such as verifying the operating states of safety devices, raising and lowering the boom and the like must be performed in specific sequences, cannot be executed with a high degree of efficiency if the operator has to refer to the instruction manual constantly.

DISCLOSURE OF THE INVENTION

The present invention provides an operation assist apparatus that assists the operator during operations by displaying operating procedures at a display screen.

An operation assist apparatus according to the present invention includes a display device installed in an operator's cab of a construction machine, at which at least operating procedures for the construction machine are displayed with text and illustrations; an image processing device that generates images; and a control device that engages the image processing device to generate an image of an operating procedure corresponding to an operation of the construction machine and engages the display device to display the image generated by the image processing device. It is preferable that the control device engages the display device to display an operating procedure of a setup operation for raising or lowering a front attachment of the construction machine.

The apparatus further includes an information detection device that detects information required to drive and operate the construction machine, and it is preferable that the control device engages the image processing device to generate an image based upon the information detected by the information detecting device and the operating procedure and engages the display device to display the image of the operating procedure and the image of the information related to the construction machine which are generated by the image processing device. It is preferable that the control device updates the images displayed at the display device based upon the information detected by the information detection device.

The operating procedure of the construction machine displayed at the display device may include an instruction on how to operate the construction machine, verification items to be checked, inspection items to be checked and an operational warning, which match the information detected by the information detection device.

It is preferable that the information detection device detects a state quantity indicating a state of the construction machine, a posture of the construction machine and environment information indicating an environment surrounding the construction machine. It is also preferable that the control device engages the display device to display a subsequent operating procedure based upon the posture of the construction machine detected by the information detection device.

The apparatus further includes a selection device that selects an operating procedure to be displayed at the display device, and it is preferable that the control device engages the display device to display the operating procedure selected by the selection device.

When the posture of the construction machine detected by the information detection device is within an allowable work range, the control device may engage the display device to display information related to a load applied to the construction machine (hereafter referred to as moment limiter information), instead of the operating procedure, at the display screen.

The control device may engage the display device to display a list of the operating procedures in a tree format. The control device may sustain a display of the list of the operating procedures at all times at a portion of the display device. As an alternative, the control device may display the list of the operating procedures at the display device as required.

The control device includes a storage unit that stores in memory the operating procedure displayed at the display device immediately before power to the construction machine is turned off and engages the display device to display the operating procedure stored in memory at the storage unit when the power to the construction machine is turned on again. The apparatus may further includes an audio output device that outputs the operating procedures of the construction machine as audio instructions.

It is preferable that the display device further displays information related to a load applied to the construction machine (hereafter referred to as moment limiter information); and that the control device engages the image processing device to generate an image providing the moment limiter information and an image of the operating procedure corresponding to the operation of the construction machine and engages the display device to display the images generated by the image processing device. The apparatus further includes an information detection device that detects a state quantity indicating a state of the construction machine, a posture of the construction machine and environment information indicating an environment surrounding the construction machine, and it is preferable that the control device engages the image processing device to generate an image based upon the information detected by the information detection device and engages the display device to display one of the moment limiter information and the operating procedure in correspondence to the posture of the construction machine.

It is preferable that the control device switches the image displayed at the display device from the moment limiter information to the operating procedure when the posture of the construction machine detected by the information detection device is not within an allowable work range or when the posture of the construction machine detected by the information detection device which has been in the allowable work range shifts into outside of the allowable work range. It is also preferable that the operating procedure of the construction machine displayed at the display device includes an instruction on how to operate the construction machine, verification items to be checked, inspection items to be checked and an operational warning, which match the information detected by the information detection device, the apparatus further includes a selection device that selects an image to be displayed at the display device; and the control device engages the display device to display one of the operating procedure and the moment limiter information corresponding to the posture of the construction machine, or one of the operating procedure and the moment limiter information selected by the selection device.

The control device may engage the display device to display a failure diagnosis screen when an error has been detected with regard to an inspection item. The operating procedure of the construction machine displayed by the control device may further include a handling instruction; and if the handling instruction is selected by the selection device, the control device engages the display device to display the handling instruction corresponding to the screen currently on display.

It is preferable that the information detection device detects whether or not a front attachment is mounted at the construction machine; and the control device engages the display device to display the operating procedure if the information detection device detects that a front attachment is not mounted. The control device may engage the display device to display an operating procedure of a setup operation for raising or lowering a front attachment of the construction machine.

A construction machine according to the present invention includes the operation assist apparatus.

BRIEF DESCRIPTION OF THE DRAWINGS

FIGS. 2(*a*) and 2(*b*) are enlargements of a coupling device of the tower crane shown in FIG. 1;

FIGS. 5 to 31 each present an example of an operating procedure screen that may be displayed at a display unit;

FIGS. 32 and 33 each present an example of a pre-work inspection screen that may be displayed at the display unit;

FIGS. 59A-59C show a list of the operating procedures displayed at the display unit;

FIGS. 81 to 87 each present an example of an operating procedure screen that may be displayed at the display unit;

BEST MODE FOR CARRYING OUT THE INVENTION

First Embodiment

The following is an explanation of an operation assist apparatus achieved in an embodiment of the present invention, given in reference to the drawings.

Figure 1:
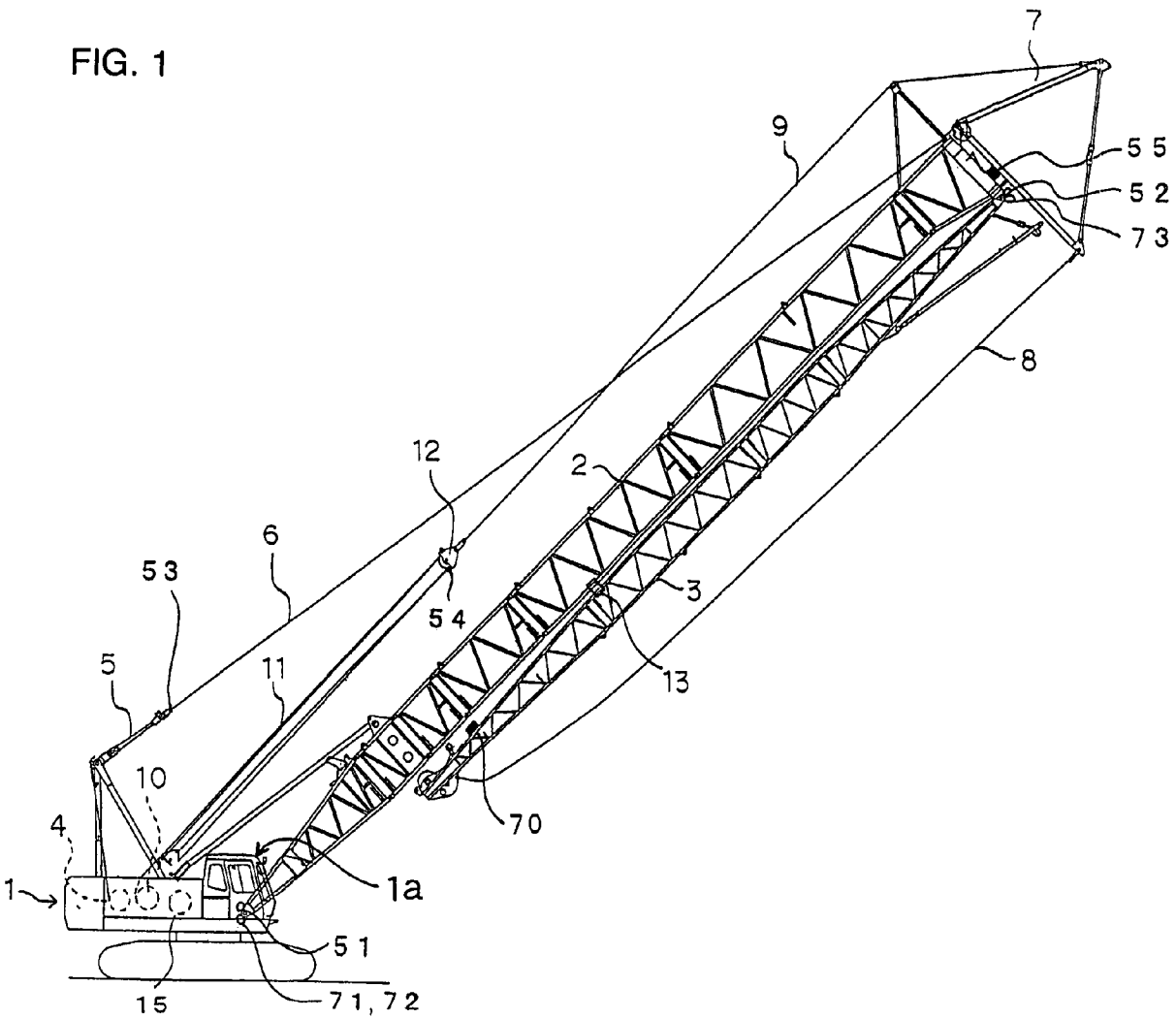
FIG. 1 is a side elevation of a tower crane at which an operation assist apparatus achieved in an embodiment of the present invention is mounted, undergoing in a setup operation.

FIG. 1 is a side elevation showing the structure of a tower crane equipped with the operation assist apparatus achieved in the embodiment of the present invention. As shown in FIG. 1, the tower crane includes a crane main body 1, a tower boom 2 axially supported at the crane main body 1 so as to be hoisted up and down and a jib 3 axially supported at the front end of the tower boom 2 in a rotatable manner. It is to be noted that FIG. 1 shows the tower crane in a so-called setup state, in which the tower crane is in the process of either being raised or being lowered. While the tower crane is in a setup state, the jib 3 is locked to the front surface side of the tower boom 2 by a coupling device 13 and, as a result, the tower boom 2 and the jib 3 are hoisted as an integrated unit. At the crane main body 1, a boom hoist winch 4 and a jib hoist winch 10 are provided. In addition, a hook hoist winch 15 with which a suspended load is lifted/lowered is provided at the crane main body 1.

A first pendant cable 6 is connected to the front end of the tower boom 2 at one end thereof and is connected with a boom hoist cable 5 wound around the boom hoist winch 4 at the other end thereof. As the boom hoist cable 5 is taken up or delivered with the tower boom hoist winch 4, the tower boom 2 is hoisted up or down via the first pendant cable 6.

At the front end of the tower boom 2, a swing lever 7 is axially supported so as to be allowed to rotate. The swing lever 7 assumes a triangular shape, with one of the apexes linked with the front end of the jib 3 via a second pendent cable 8. Another apex of the swing lever 7 is linked to a jib hoist cable 11 wound around the jib hoist winch 10 via a third pendent cable 9 and a bridle device 12. As the jib hoist cable 11 is taken up or paid out with the jib hoist winch 10, the swing lever 7 is caused to rotate in the counter clockwise direction or the clockwise direction via the third pendent cable 9, thereby hoisting up/down the jib 3.

An operator's cab 1*a* is provided at the crane main body 1, and operating levers and the like operated by the operator to drive the tower boom hoist winch 4 and the jib hoist winch 10 described above are installed in the operator's cab 1*a*. In addition, a display unit 30 (see FIG. 3) at which various types of information such as operating procedures are displayed is installed in the operator's cab 1*a* at a position at which the operator can check the display with ease.

FIGS. 2(*a*) and 2(*b*) are enlargements of the coupling device 13. The coupling device 13 includes a jib locking claw 13*c* which is rotatably supported via a pin 13*b* at a bracket 13*a* fixed to the tower boom 2 and a holder 13*d* which is fixed to the jib 3 so as to interlock with the jib locking claw 13*c*. The jib locking claw 13*c* and the bracket 13*a* are linked with each other via a spring 13*e*, and the jib locking claw 13*c* and the holder 13*d* become engaged with each other due to the spring force imparted from the spring 13*e* as shown in FIG. 2(*a*). A rope 13*f* used to release the linkage is connected to the jib locking claw 13*c*, and as the rope 13*f* is pulled, the connection of the jib locking claw 13*c* and the holder 13*d* is released against the spring force imparted by the spring 13*e*, as shown in FIG. 2(*b*). A limit switch 13*g* is mounted at the jib locking claw 13*c*. When the jib locking claw 13*c* and the holder 13*d* become engaged with each other, the limit switch 13*g* is placed in contact with the holder 13*d* and is turned on.

Figure 3:
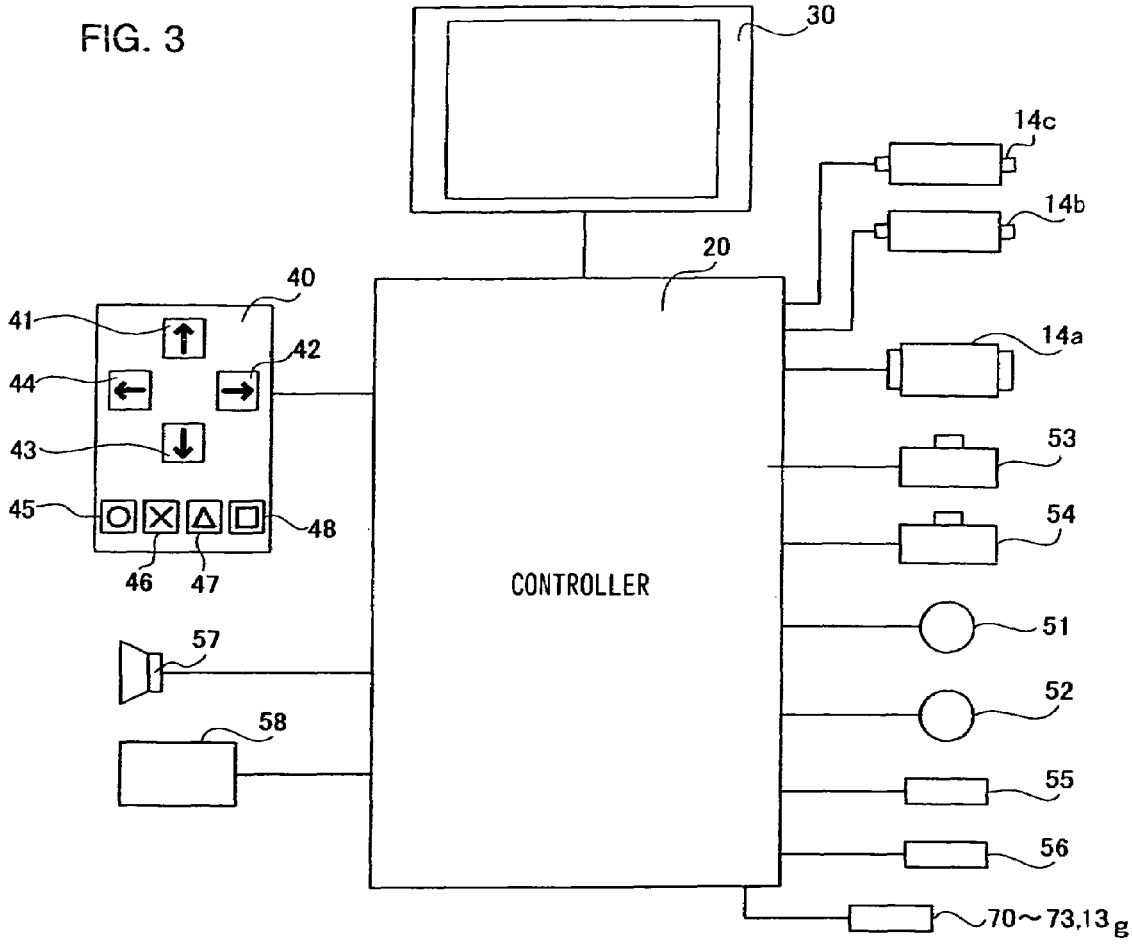
FIG. 3 shows the structure of the operation assist apparatus achieved in an embodiment of the present invention.

FIG. 3 schematically shows the structure adopted in the operation assist apparatus in the embodiment of the present invention. As shown in FIG. 3, a boom angle sensor 51, a jib angle sensor 52, tension detectors 53 and 54, an anemometer 55, a tachometer 56, a speaker 57, a camera 58 and the like are electrically connected to a controller 20 which controls the operations of the operation assist apparatus.

The boom angle sensor 51, which is mounted near the base end of the tower boom 2, detects the angle (boom-to-ground angle) of the tower boom 2 relative to the ground surface. The jib angle sensor 52, which is mounted near the rotational center of the jib 3, detects the angle of the jib 3 relative to the tower boom 2. The tension detector 53 detects the tension of the boom hoist cable 5, whereas the tension detector 54 detects the tension of the jib hoist cable 11. The anemometer 55 is mounted at the front end of the tower boom 2 to measure the wind velocity and the wind direction. The tachometer 56 measures the rotational speed of an engine (not shown) in the crane main body 1. A warning sound, voice and the like are output through the speaker 57. The camera 58, which may be a CCD camera or a CMOS camera, captures an image behind the crane or around the winch drums in order to monitor the state behind the crane main body 1 or the states of the winch drums, which cannot be visually checked from the operator's cab 1*a*.

The controller 20 calculates the ground angles of the tower boom 2 and the jib 3 relative to the horizontal based upon signals input from the angle sensors 51 and 52. It is to be noted that the angle sensors 51 and 52 are each constituted of a rotary encoder or the like, whereas the tension detectors 53 and 54 are each constituted of a load cell or the like.

In addition, limit switches 70, 71, 72, 73 and 13*g* are electrically connected to the controller 20. The limit switch 70 is mounted near the front end of the jib 3 to detect a hook overwind. The limit switches 71 and 72 are both mounted near the base end of the tower boom 2 to detect a 90°-overwind and an ultimate-overwind of the tower boom 2 respectively. The limit switch 73 is mounted near the rotational center of the jib 3 to detect an ultimate-overwind of the jib 3. The limit switch 13*g* detects the connection state of the coupling device 13.

The controller 20 is also electrically connected with proportional solenoid valves 14*a*, 14*b* and 14*c* provided to control the flows of the pressure oil supplied from a hydraulic source (not shown) to the boom hoist winch 4, the jib hoist winch 10 and the hook hoist winch 15 respectively.

Upon detecting an overwind of the tower boom 2 or the like, the corresponding limit switches 70 to 73 provided for overwind detection outputs an ON signal to the controller 20. The limit switch 13*g* at the coupling device 13 outputs an ON signal to the controller 20 when the tower boom 2 and the jib 3 are clamped to each other. The proportional solenoid valves 14*a*, 14*b* and 14*c* are each switched in response to an operation of an operating lever (not shown) for the corresponding winch by the operator, and they are also switched by the controller 20 so as to stop the drive of the corresponding winches when overwind safety devices to be detailed later are activated.

Furthermore, the display unit 30 and an input device 40 are also electrically connected to the controller 20.

The input device 40, which is located near the display unit 30, includes arrow keys 41 to 44 pointing upward, downward, left, and right and used to issue instructions for switching the display screen or selecting a display screen and keys (○, X, Δ, □) 45 to 48 operated to verify or select display contents. The operator operates the keys 41 to 48 in response to an image brought up on display at the display unit 30.

The controller 20 has an image processing function and generates an image to be displayed at the display unit 30 based upon signals input from the angle sensors 51 and 52, the tension detectors 53 and 54, the anemometer 55, the tachometer 56, the camera 58, the input device 40 and the limit switches 70 to 73 and 13*g*. The display unit 30 is constituted of, for instance, a liquid crystal display device and is a so-called multi-display unit capable of displaying an image and the like generated at the controller 20. In response to a key operation input through the input device 40, the controller 20 switches the contents of the display at the display unit 30 as necessary.

In addition, the controller 20 functions as an overload preventing device for the crane, i.e., as a moment limiter. Based upon the results of the detections executed by the angle sensors 51 and 52 and the tension detectors 53 and 54, the moment limiter calculates a load factor representing the ratio of the actual load of the suspended load relative to the working radius and the load limit of the crane, controls the proportional solenoid valves 14*a*, 14*b* and 14*c* based upon the results of the calculation and thereby controls the drive of the boom hoist winch 4, the jib hoist winch 10 and the hook hoist winch 15.

Figure 4:
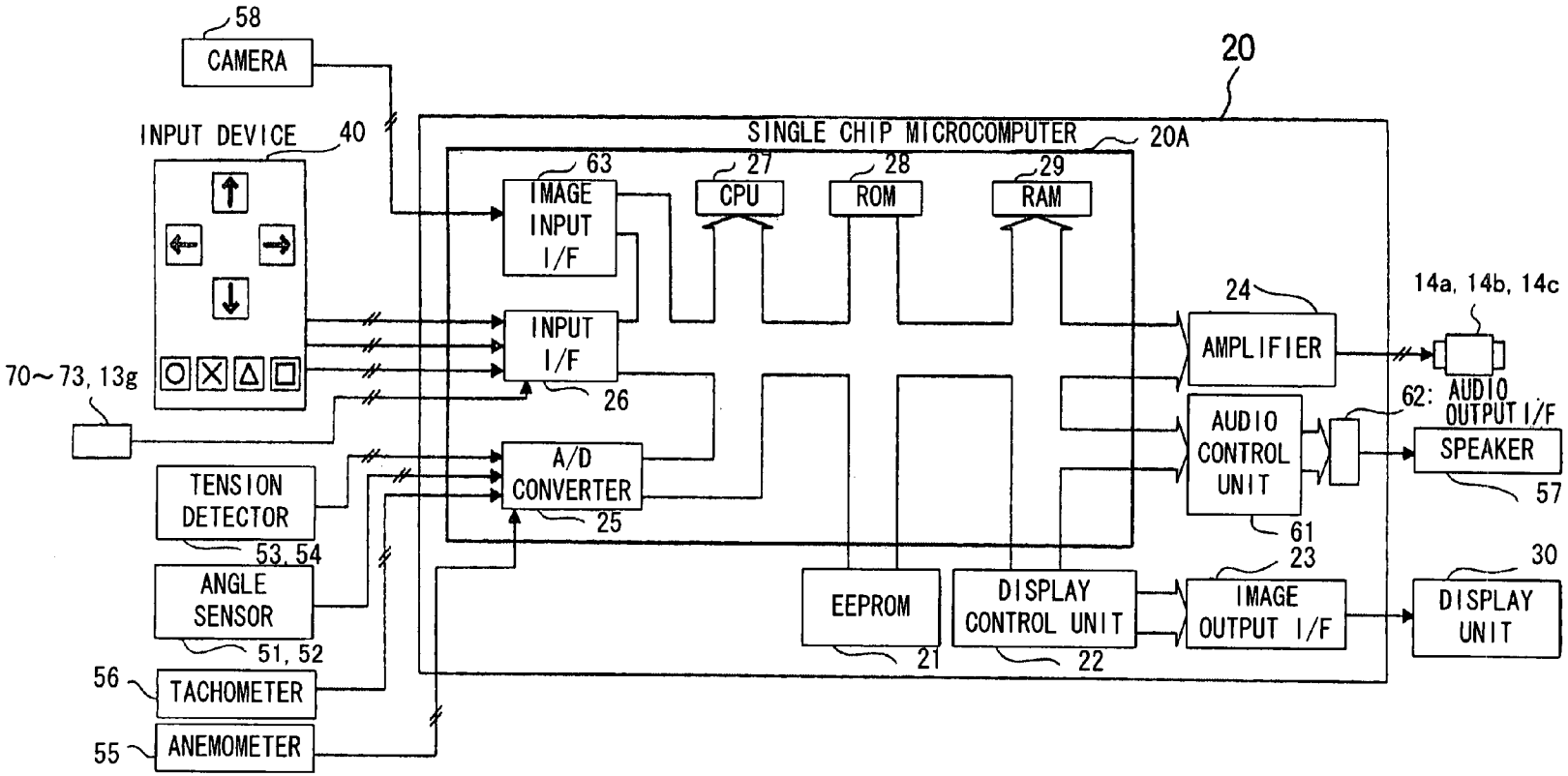
FIG. 4 is a block diagram of an internal structure of a controller in FIG. 3 and a structure assumed around the controller.

FIG. 4 shows the structure of the controller 20 and the structure around the controller 20. As shown in FIG. 4, the controller 20 comprises a single chip microcomputer 20A that generates synthesized images, calculates the load factor and the like, a nonvolatile memory 21 that allows data overwrite, a display control unit 22, an image output interface 23, an amplifier 24, an audio control unit 61, an audio output interface 62 and the like.

The nonvolatile memory 21, which may be an EEPROM (electrically erasable programmable read only memory), stores in memory screen numbers, etc., assigned to the screens displayed at the display unit 30 and the like. The display control unit 22 controls the screens displayed at the display unit 30 in conformance to commands issued by a CPU 27 of the single chip microcomputer 20A. The image output interface 23 connects the display control unit 22 and the display unit 30. The amplifier 24 amplifies a current command value from the single chip microcomputer 20A as necessary and outputs the amplified current command value to the proportional solenoid valves 14*a*, 14*b* and 14*c*. The audio control unit 61 converts an audio digital signal generated at the CPU 27 to an audio analog signal, and the audio output interface 62 outputs the audio analog signal to the speaker 57.

The single chip microcomputer 20A includes an A/D converter 25 that converts signals input thereto from the angle sensors 51 and 52, the tension detectors 53 and 54, the anemometer 55 and the tachometer 56 to digital signals, an input interface 26 to which digital signals from the input device 40 and the limit switches 70 to 73 and 13*g* are input and an image input interface 63 to which digital signals from the camera 58 are input. In addition, the single chip microcomputer 20A includes the CPU 27 that implements the overall control for the controller 20 and executes arithmetic operations in conformance to specific programs, a read only memory (ROM) 28 in which preset programs are stored and a random access memory (RAM) 29 in which numerical values and the like are temporarily stored while the CPU 27 executes the control and the arithmetical operations.

The display unit 30 displays text, an illustration and images such as a dynamic image and an image captured by the camera 58 in correspondence to a given operating procedure. It is to be noted that the term "text" as used in this context refers to characters, i.e., a sentence or message displayed to explain the operating procedure or the like. The program that controls the contents of the display brought up at the display unit 30 is stored in advance at the ROM 28 of the controller 20.

The CPU 27 of the controller 20 detects the posture of the tower crane in real-time based upon the tower length and the jib length set prior to the start of operation and signals indicating the tower angle and the jib angle input from the angle sensors 51 and 52. The tower crane posture thus detected in real time is displayed at the display unit 30 in the form of an illustration and numerical values. The real-time tower crane posture is temporarily stored into the RAM 29. If there is any change in either of the tower angle and the jib angle detected with the angle sensors 51 and 52 relative to the values stored in the RAM 29, the illustration in the display screen is manipulated in conformance to the change and the most recent values are stored into the RAM 29. In addition, the CPU 27 processes the image signals input from the camera 58 as necessary and displays the image constituted of the image signals at the display unit 30 together with other information.

The operation assist apparatus achieved in the embodiment of the present invention is structured as described above. Next, the operations of the operation assist apparatus executed in the embodiment of the present invention are explained in detail in reference to the drawings.

The operation assist apparatus achieved in the first embodiment of the present invention assists or prompts the operator to operate by providing illustration guidance, text guidance and audio guidance for the operating procedures of the tower crane setup operations. In addition, it displays quantities indicating the state of the crane such as the tilt angles of the tower boom 2 and the jib 3 and the cable tensions, the posture of the crane, the crane environment information and the like at the display unit 30 as images together with corresponding operating steps of a given setup operation.

It is to be noted that the operation assist apparatus according to the present invention is capable of displaying a moment limiter screen which provides information on the load applied to the tower crane at the display unit 30 as an image as well as the operating procedures of the setup operations. Details on how an operating procedure screen corresponding to a given setup operation and the moment limiter screen are switched from each other will be provided in the explanation of a second embodiment.

Figure 5:
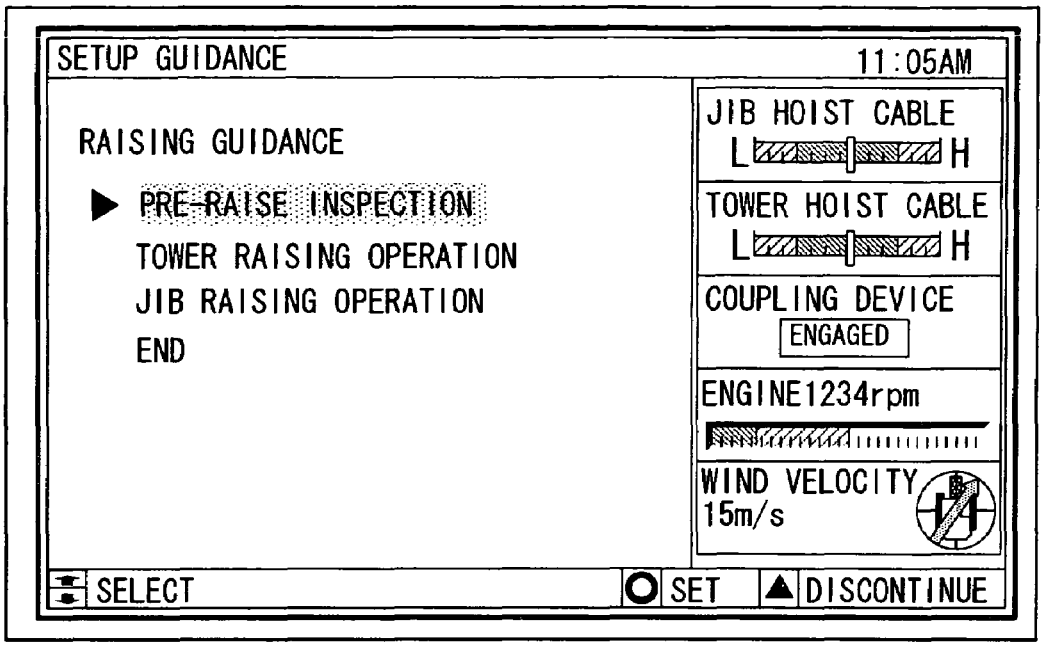
Figure 56:
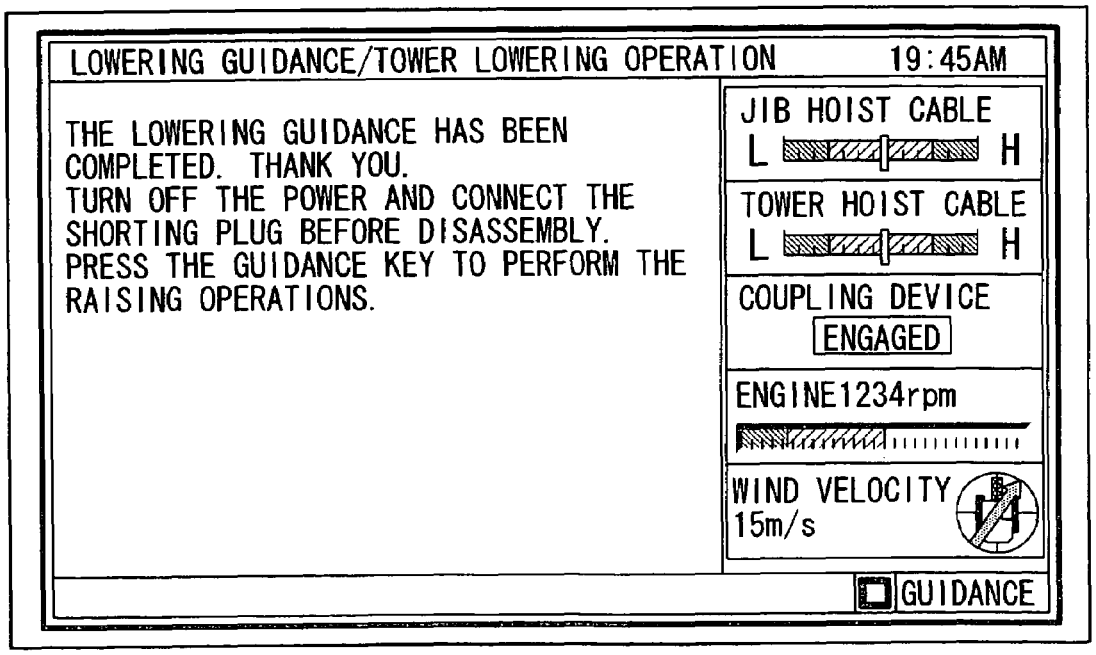

FIGS. 5 to 56 each present an example of an image that may be displayed at the display unit 30 of the operation assist apparatus achieved in the embodiment of the present invention to provide the operating procedure guidance for a setup operation, the quantities indicating that tower crane state and the like. As shown in FIGS. 5 to 56, the display screen at the display unit 30 includes a large main screen on the left side of the display and a smaller sub-screen on the right side of the display. The operating procedure, the operation details, the tower crane posture or the like are indicated in the form of text or illustration in the main screen, whereas state quantities indicating the current state of the tower crane, such as the cable tensions, and the information on the environment are provided in the sub-screen. In addition, when the state quantities are not indicated, the sub-screen is not used and instead, the operation details and the like are displayed over the entire display screen.

In the upper portion of the display screen, the types of setup guidance and the setup operation currently on display and the current time point are indicated, whereas keys used to switch the display screen are displayed in the lower portion of the display screen. The arrows pointing upward, downward, left and right, the "circle ○" key, the "cross X" key, the "triangle Δ" key and the "square □" key displayed in the lower portion of the screen respectively correspond to the arrow keys 41 to 44 and the keys 45 to 48 at the input device 40. The operator selects a given key among the keys 41 to 48 at the input device 40 to issue an instruction such as "select" or "set" corresponding to the selected key. It is to be noted that since the contents of the instruction corresponding to a given key may change as the display screen is switched in the embodiment, the operator must select a key among the keys 41 to 48 to issue a correct instruction by checking the screen currently on display at the display unit 30.

FIG. 5 shows a menu screen for the setup guidance. FIGS. 6 to 16 show screens brought up on display to provide guidance for the pre-raise inspection, which is executed while the tower boom 2 laying down on the ground before raising the tower boom 2. FIGS. 17 to 27 show the screens brought up on display to provide guidance for the raising operation executed to raise the tower boom 2 after finishing the pre-raise inspection. FIGS. 28 to 31 show the screens brought up on display to provide guidance for the raising operation executed to raise the jib 3 after raising the tower boom 2.

Figure 34:
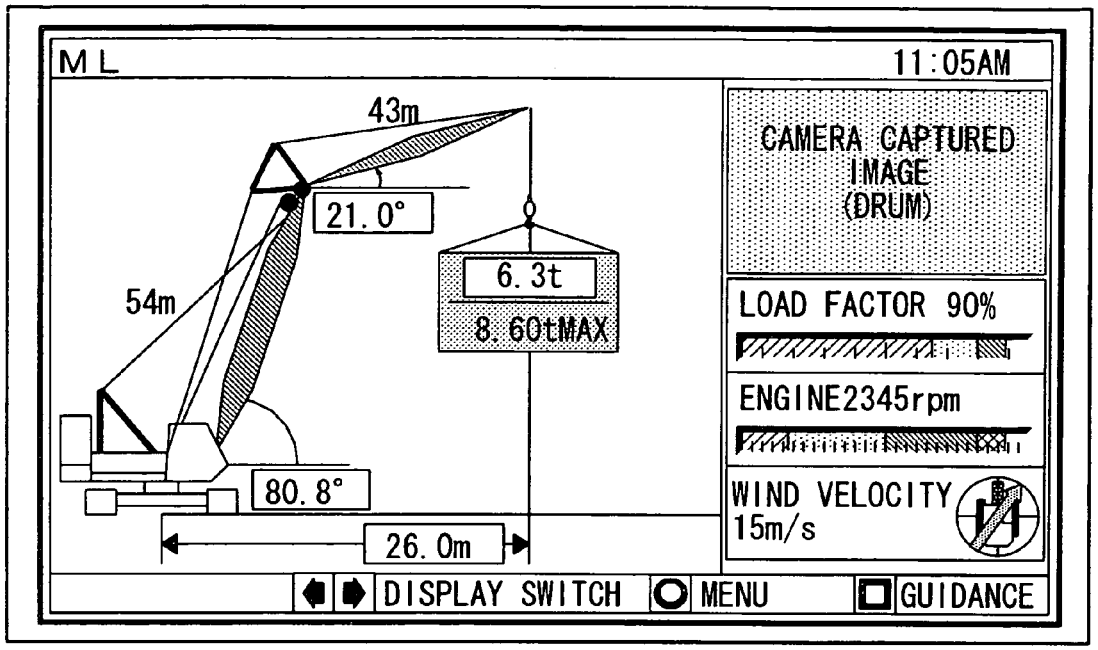
FIGS. 34 to 36 each present an example of a moment limiter screen that may be displayed at the display unit.
Figure 35:
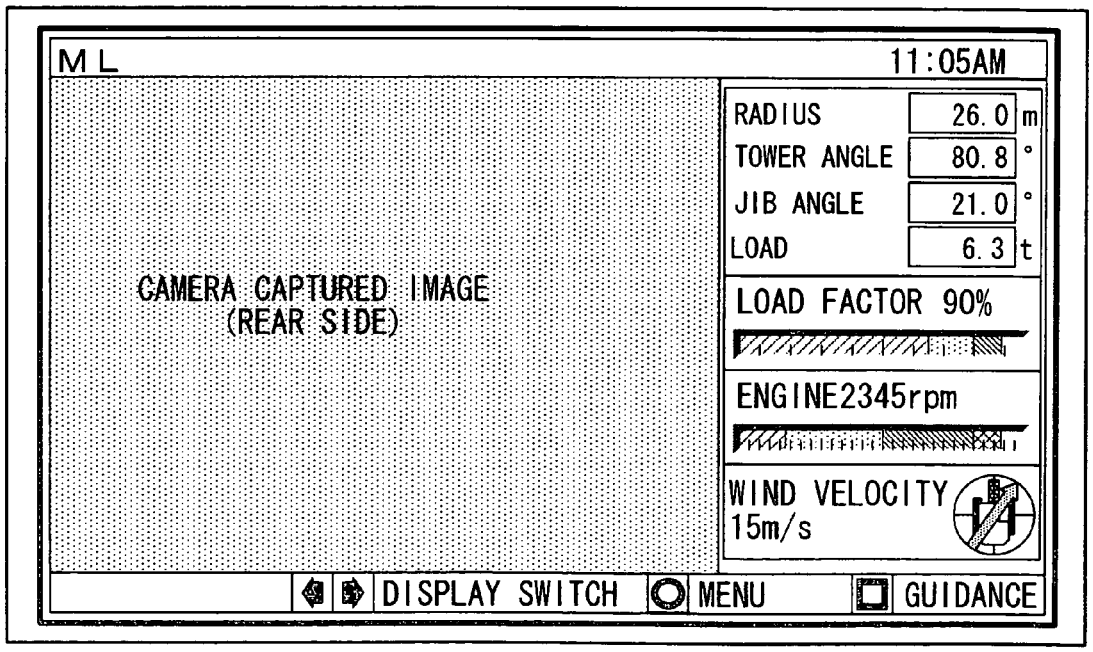
Figure 36:
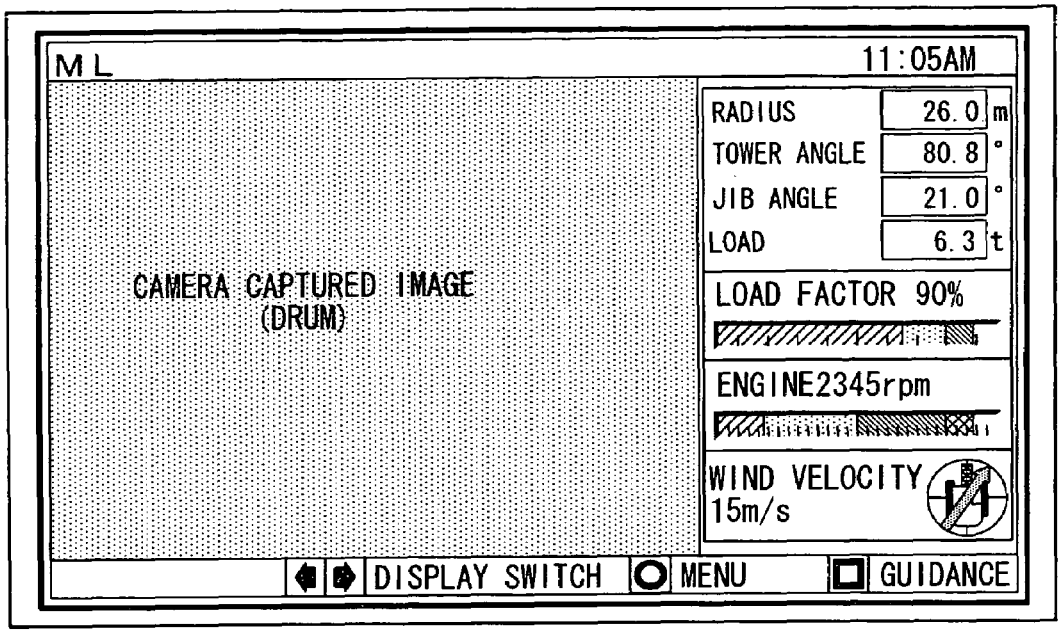

FIGS. 32 and 33 show the screens brought up on display to provide guidance for the pre-work inspection executed when the tower boom 2 and the jib 3 having been raised and the tower crane has assumed a work posture. FIGS. 34 to 36 show moment limiter screens brought up on display at the display unit 30 while the tower crane is working.

FIGS. 37 to 41 shows the screens brought up on display to provide guidance for the raising operation executed to raise the tower boom 2 before lowering the tower boom 2 when work by the tower crane has done. FIGS. 42 to 46 show screens brought up on display to provide guidance for the lowering operation executed to lower the jib 3 and FIGS. 47 to 56 show screens brought up on display to provide guidance for the lowering operation executed to lay down the tower boom 2 coupled with the jib 3.

When executing the tower crane raising setup operations, the setup guidance menu screen shown in FIG. 5 is first brought up on display at the display unit 30. In the setup guidance menu screen in FIG. 5, a menu of the operations included in the raising guidance for raising the tower crane up to a work state is displayed in the main screen, with information such as the quantities indicating the state of the crane displayed in the sub-screen. The operation menu for the raising guidance includes four items, i.e., "pre-raise inspection", "tower raising operation", "jib raising operation" and "end".

Under normal circumstances, the setup operations for raising the tower crane are executed in the order of: the pre-raise inspection, during which the crane main body 1 is inspected and the operations of the safety devices are checked with the tower boom 2 laid down on the ground, the tower raising operation during which the tower boom 2 is raised while coupled with the jib 3 and the jib raising operation during which the jib 3 is raised after releasing the lock between the tower boom 2 and the jib 3.

Figure 57:
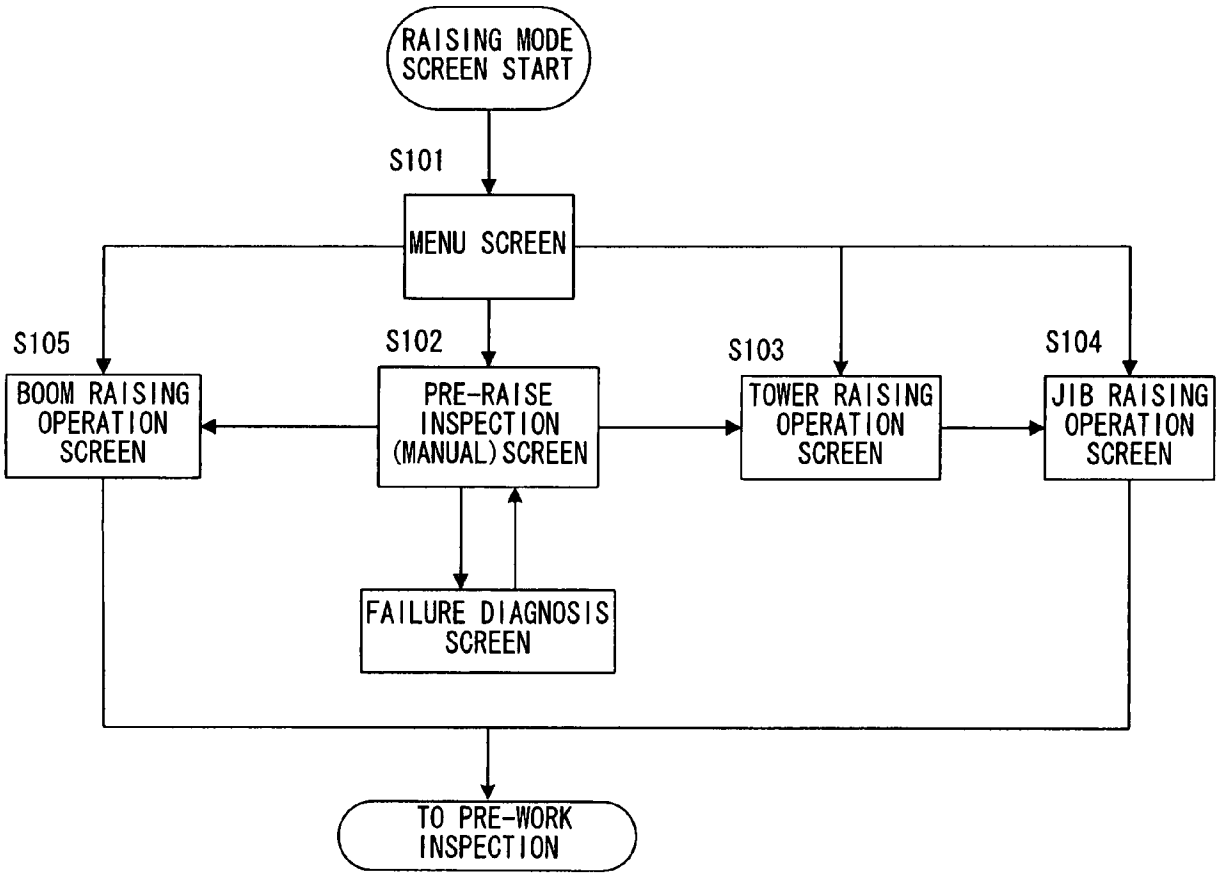
FIG. 57 presents a flowchart of the crane raising operation.

FIG. 57 presents a flowchart of the guidance screens for the tower crane raising operations which are brought up on display at the display unit 30. The controller 20 determines which guidance screen is to be displayed based upon the key entry performed by the operator at the input device 40.

After "pre-raise inspection" is selected in the operation menu screen (see FIG. 5) in step S 101, the operation proceeds to step S 102. In step S 102, the screens (FIGS, 6 to 16) providing the operating procedure guidance for the pre-raise inspection are displayed at the display unit 30. The operator performs the pre-raise inspection in conformance to the operating procedure displayed at the display unit 30. After the pre-raise inspection in step S 102 is completed, the operation proceeds to step S 103. In step S 103, the screens (FIG. 17 to FIG. 27) providing the operating procedure guidance for the tower raising operation are displayed at the display unit 30. The operator performs the tower raising operation in conformance to the operating procedure displayed at the display unit 30. Once the tower raising operation in step S 103 is completed, the operation proceeds to step S104. In step S104, the screens (FIG. 28 to FIG. 31) providing the operating procedure guidance for the jib raising operation are displayed at the display unit 30. The operator performs the jib raising operation in conformance to the operating procedure displayed at the display unit 30.

As the jib raising operation in step S 104 is completed and the posture of the tower crane is set within the work range, the operation proceeds to engage in the next operating procedure to start crane work. This aspect of operation will be described in detail later.

As described above, as "pre-raise inspection" is selected in the operation menu screen for the raising guidance shown in FIG. 5 in step S 101, the operating procedures, which include "pre-raise inspection", "tower raising operation" and "jib raising operation" in this order, are brought upon display at the display unit 30. Thus, the operator is able to perform the raising operation to set the tower crane, which has been in a lay-down state to a work posture with ease and reliability.

If the tower boom 2, laying down and coupled with the jib 3 is to be raised without performing the pre-raise inspection, "tower raising operation" is selected in the operation menu screen (see FIG. 5) in step S 101 in FIG. 57. After "tower raising operation" is selected in step S 101, the operation proceeds to step S 103. As a result, the display screens (FIGS. 17 to 27) of the operating procedure for the tower raising operation are brought up on display at the display unit 30 by skipping the display of the operating procedure for the pre-raise inspection. When the tower raising operation executed in step S 103 is completed, the operation proceeds to step S 104 to bring up the display screens (FIGS. 28 to 31) of the operating procedure for the jib raising operation at the display unit 30.

If, on the other hand, the operator wishes to raise the jib 3 with the tower boom 2 already raised, he selects "jib raising operation" in the operation menu screen (see FIG. 5) in step S 101 in FIG. 57. After "jib raising operation" is selected in step S 101, the operation proceeds to step S 104. As a result, the display screens (FIGS. 28 to 31) of the operating procedure for the jib raising operation are brought up on display at the display unit 30 by skipping the display of operating procedures for the pre-raise inspection and the tower raising operation.

It is to be noted that if an error occurs while performing the pre-raise inspection by following the guidance in the display screens in step S 102, the display can be switched to a failure diagnosis screen. For instance, if no warning buzzer sounds when the tower angle of the tower boom 2 exceeds 90°, i.e., is in a 90°-overwind state, the display at the display unit 30 may be switched to a selection screen which allows the operator to indicate whether or not a failure diagnosis is to be executed, such as that shown in FIG. 60. The operator then chooses whether or not the failure diagnosis is to be executed by operating the input device 40, and if the operator chooses to run a failure diagnosis, the display at the display unit 30 is switched to a failure diagnosis screen (not shown). Since the method that may be adopted when executing the failure diagnosis on the crane is of the known art, a detailed explanation of the method is not provided.

Namely, by selecting one of the operation menu items among "pre-raise inspection", "tower raising operation" and "jib raising operation" in the operation menus screen (see FIG. 5) for the raising guidance displayed at the display unit 30, the operating procedures for the selected operation and any subsequent operation can be brought up on display at the display unit 30. While the operation menu screen shown in FIG. 5 is on display at the display unit 30, the operator selects one of the operation menu items by operating the UP or DOWN arrow 41 or 43 at the input device 40. Once an operation menu item is selected, the operator presses the set key (○ key) 45 to move forward to the next screen (procedure).

It is to be noted that if a boom is attached to the crane main body 1 as a front attachment instead of the tower boom 2 and the jib 3 (if the work machine is utilized as a regular crane instead of as a tower crane), the operation proceeds from the menu screen on display in step S 101 to the pre-raise inspection screen which corresponds to the operation performed in step S 102 in the flowchart presented in FIG. 57. When the pre-raise inspection is completed by following the guidance provided in the display screens, a screen of the operating procedure for a boom raising operation performed in step S 105 is brought up on display. The operator then performs the boom raising operation by following the guidance provided in the screen. Alternatively, the operation may proceed from the menu screen corresponding to step S 101 directly to step S 105 during which the boom raising operation screen is up on display, without bringing up the pre-raise inspection screen in step S 102. However, since the setup operations performed to set up a regular crane are not nearly as complicated as those for a tower crane, the setup operating procedures do not need to be brought up on display at the display unit 30.

Now, an explanation is given in sequence on the raising guidance displayed at the display unit 30 when "pre-raise inspection" is selected in the operation menu screen in FIG. 5. As the pre-raise inspection is selected, the display at the display unit 30 is switched to the display screen shown in FIG. 6.

A: Pre-Raise Inspection (Raising Guidance)

Figure 6:
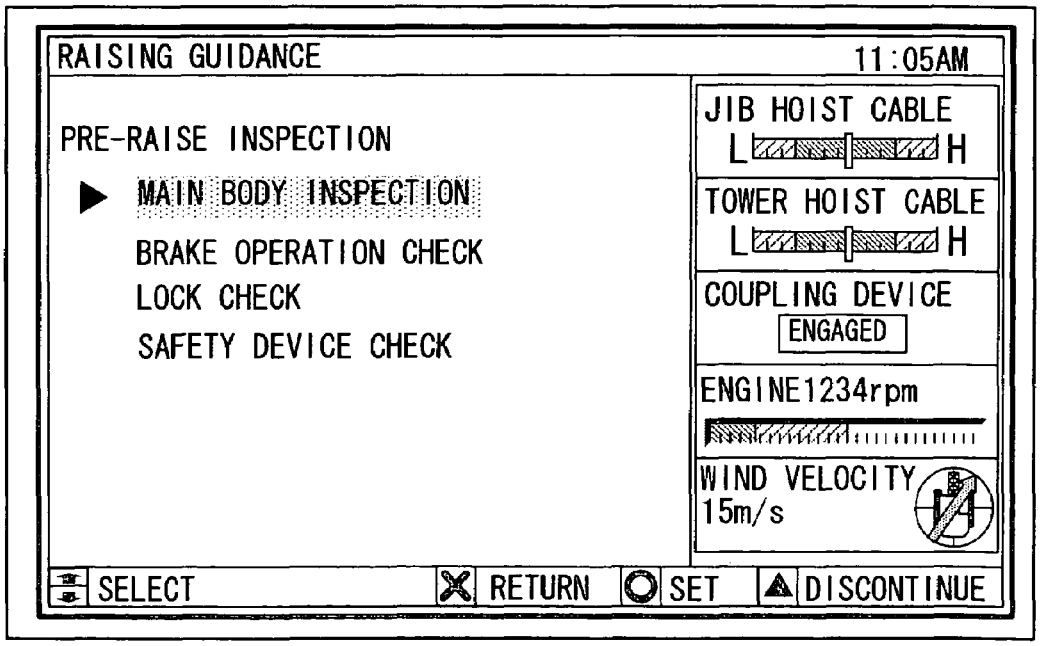

In FIG. 6, a list of the items to be inspected in the pre-raise inspection is displayed in the main screen and state quantities and the like similar to those in FIG. 5 are displayed in the sub-screen. During the pre-raise inspection performed for the tower crane, "main body inspection", "brake operation check", "lock check" and "safety device check" are performed. It is to be noted that the operator can select a given inspection item to be inspected during the pre-raise inspection. While the display screen of the pre-raise inspection list shown in FIG. 6 is up at the display unit 30, the operator selects a desired inspection item by operating the UP or DOWN arrow key 41 or 43. Once an inspection item is selected, the operator operates the set key (○ key) 45 to bring up the next screen, i.e., to move forward to the subsequent operating procedure. The explanation is given below on an assumption that "main body inspection" is selected in the display screen of the pre-raise inspection list shown in FIG. 6 and that display screens for "brake operation check", "lock check" and "safety device check" are sequentially brought up after displaying the guidance for the main body inspection.

Figure 7:
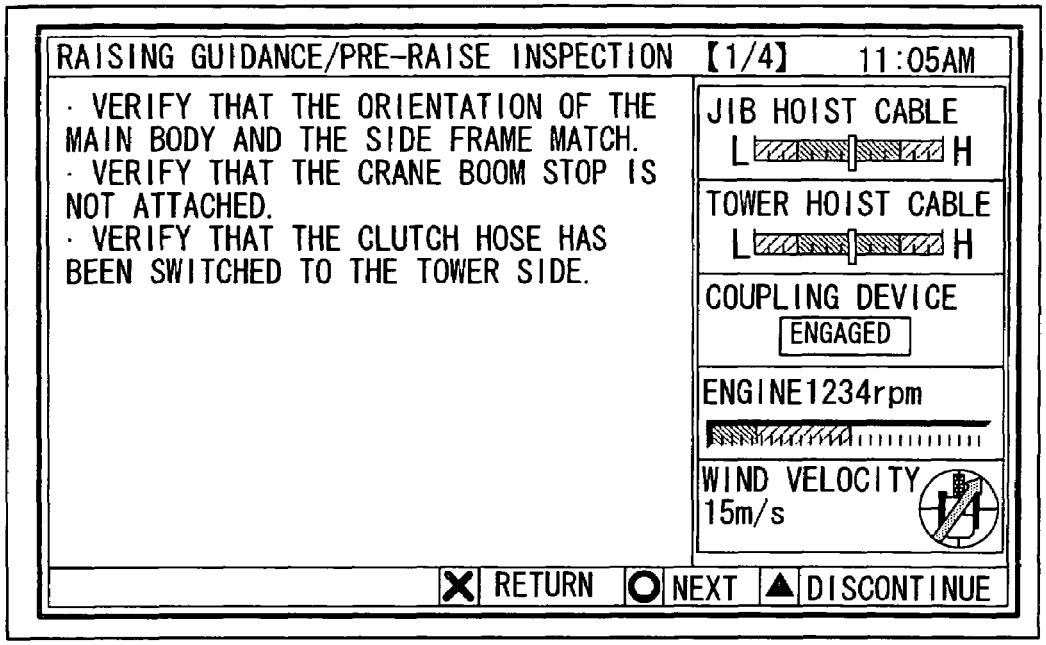

As the operator selects the main body inspection from the pre-raise inspection items shown in FIG. 6, the display switches to the display screen shown in FIG. 7. In FIG. 7, the guidance for the main body inspection is provided in the main screen and state quantities and the like similar to those in FIG. 6 are displayed in the sub-screen. The main body inspection guidance may be provided in the form of, for instance, the following messages on display.

Verify that the orientation of the main body and the orientation of the side frame match.

Verify that the crane boom stop is not attached.

Verify that the clutch hose has been switched to the tower side.

The operator performs a visual inspection of the individual details while checking the operating procedure by referring to the main body inspection guidance on display at the display unit 30. When all the inspection items have been checked, the operator operates the "next" key (○ key) 45 to proceed to the next operating procedure. In response to the operation of the "next" key 45, the display is switched to the display screen shown in FIG. 8. It is to be noted that if the operator operates the "return" key (X key) 46 at this point, the display is switched to return to the immediately preceding display screen, i.e., the display screen shown in FIG. 6.

Figure 8:
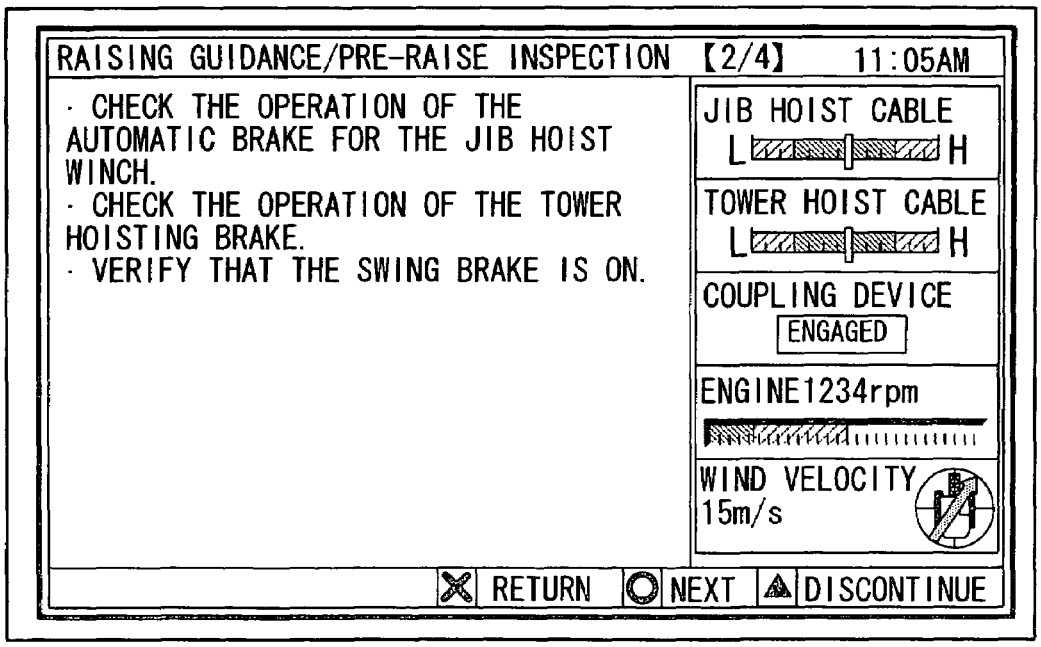

In FIG. 8, guidance for the brake operation check is provided in the main screen and the state quantities and the like indicating the state of the tower crane are displayed in the sub-screen. The brake operation check guidance may be provided in the form of, for instance, the following messages.

Check the operation of the automatic brake for the jib hoist winch.

Check the operation of the tower hoisting brake.

Verify that the swing brake is on.

The operator inspects the brakes to ensure that they operate normally by using the operating levers and the like while checking the operating procedure in reference to the brake operation check guidance on display at the display unit 30. In addition, the operator verifies that a swing brake, which holds an upper revolving superstructure of the crane main body 1 is in an ON state. When the entire brake operation check is completed, the operator operates the "next" key (○ key) 45. In response to the operation of the "next" key 45, the display is switched to the display screen shown in FIG. 9.

Figure 9:
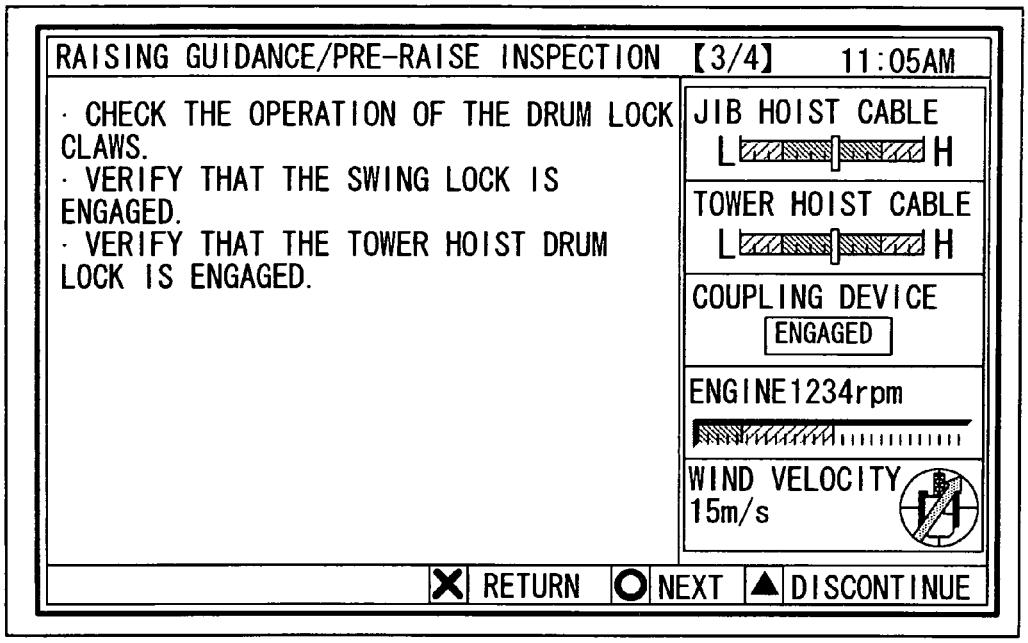

In FIG. 9, guidance for the lock check is provided in the main screen and state quantities and the like similar to those in FIG. 8 are displayed in the sub-screen. The lock check guidance may be provided in the form of, for instance, the following messages.

Check the operation of the drum lock claws.

Verify that the swing lock is engaged.

Verify that the tower hoist drum lock is engaged.

The operator verifies that a drum lock device for locking the winch drum and a swing lock device for disallowing rotation of the upper revolving superstructure are in a locked state by checking the operating procedure in reference to the lock check guidance on display at the display unit 30. Since switches for engaging the drum lock devices and the swing lock device are installed in the operator's cab 1*a*, the states of the lock devices may be judged by checking the operating states of those switches. As an alternative, a lock-on lamp may be lit in the sub-screen or the like at the display unit 30 when the lock devices are in an engaged state. When the entire lock check is completed, the operator operates the "next" key (○ key) 45. In response to the operation of the "next" key 45, the display is switched to the display screen shown in FIG. 10.

Figure 10:
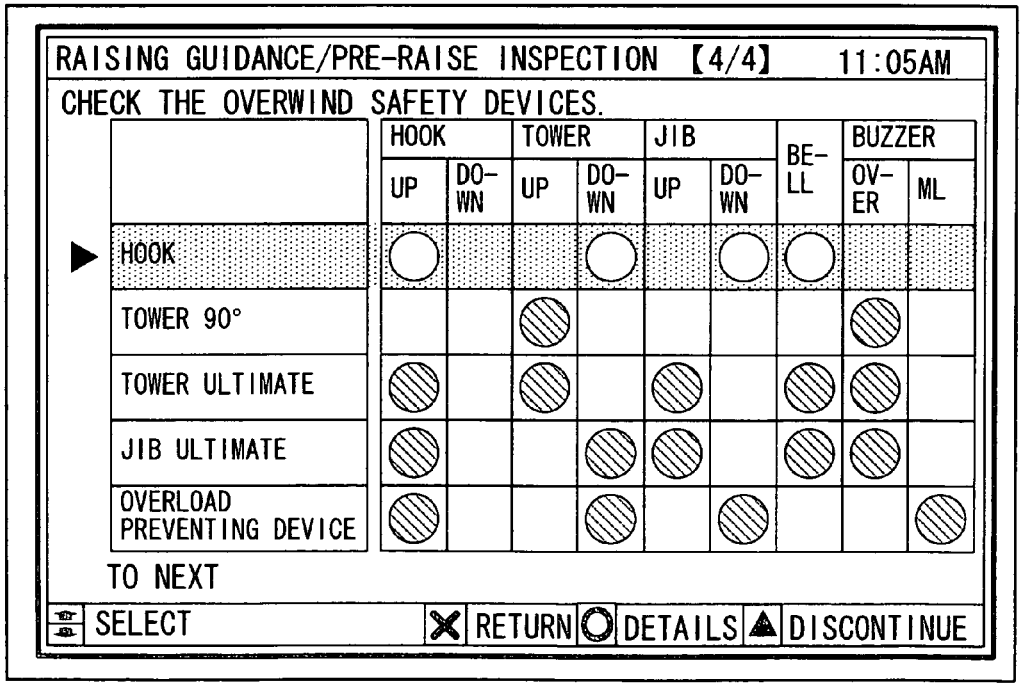

The display in FIG. 10 is not divided into the main screen and the sub-screen and is used to provide a schedule of the safety device operation check over the entire display screen. The safety devices of the tower crane inspected in the safety device check are "hook overwind preventing device", tower 90°-overwind preventing device", "tower ultimate-overwind preventing device", "jib ultimate-overwind preventing device" and "overload preventing device". The operator selects a safety device to be inspected by operating the UP or DOWN arrow key 41 or 43 at the input device 40. If the operator selects "hook overwind" as shown in FIG. 10 and operates the "details" key (○ key) 45, the display is switched to the display screen shown in FIG. 12.

As detail guidance for the safety device check, safety verification items to be checked when checking the operation of the hook overwind preventing device are displayed over the entire display screen as shown in FIG. 12. It is to be noted that the hook overwind preventing device is activated as a weight (not shown) hanging down from the front end of the jib 3 is lifted by the hook and the limit switch 70 becomes turned on as a result. As the hook overwind preventing device is switched on, the drive for winding up the hook, i.e., the take-up drive of the hook hoist winch 15, the take-down drive of the tower boom hoist winch 4 and the take-down drive of the jib hoist winch 10, is automatically stopped and an alarm bell sounds to alert the operator to the hook overwind.

The operator verifies that the hook overwind preventing device operates normally by checking the safety verification items displayed at the display unit 30. Namely, he verifies that the take-up drive of the hook hoist winch 15, the take-down drive of the tower boom hoist winch 4 and the take-down drive of the jib hoist winch 10 all stop by operating levers (not shown) while the weight is lifted up. In addition, he verifies that the alarm bell sounds when the hook overwind preventing device operates normally. It is to be noted that when the tower boom 2 is in a lay-down state, the jib 3 is resting on the ground together with the tower boom 2 and thus, an assistant operator or the like on the ground can lift the weight by hand.

After verifying that the hook overwind preventing device operates normally by checking all the safety verification items shown in FIG. 12, the operator operates the "next" key (○ key) 45. In response to the operation of the "next" key 45, the display is switched to the display screen shown in FIG. 13.

In the display screen shown in FIG. 13, safety verification items to be checked when checking the operation of the tower 90°-overwind preventing device are displayed. It is to be noted that when the limit switch 71 provided near the rotational center of the tower boom 2 detects that the tower angle of the tower boom 2 has reached 90°, the tower 90°-overwind preventing device automatically stops the take-up drive of the tower boom hoist winch 4 and sounds an alarm buzzer to alert the operator to the tower 90°-overwind.

The operator operates an operating lever (not shown) while the limit switch 71 is held down, i.e., while the limit switch 71 is in an ON state, to verify that the take-up drive of the tower boom hoist winch 4 stops and also that the alarm buzzer sounds. It is to be noted that the limit switch 71 is manually pressed down by the assistant operator or the like on the ground to set it in an ON state.

After verifying that the tower 90°-overwind preventing device operates normally by checking all the safety verification items shown in FIG. 13, the operator operates the "next" key (○ key) 45. In response to the operation of the "next" key 45, the display is switched to the display screen shown in FIG. 14.

In the display screen in FIG. 14, safety verification items to be checked to check the operation of the tower ultimate-overwind preventing device are displayed. It is to be noted that when the limit switch 72 provided near the rotational center of the tower boom 2 detects that the tower angle of the tower boom 2 has reached an ultimate limit value larger than 90°, the tower ultimate-overwind preventing device automatically stops the take-up drive of the jib hoist winch 10, the take-up drive of the tower boom hoist winch 4 and the take-up drive of the hook hoist winch 15 and also sounds an alarm bell and an alarm buzzer to alert the operator to the tower ultimate-overwind.

The operator operates the operating levers (not shown) while the limit switch 72 is held down, i.e., while the limit switch 72 is in an ON state, to verify that the take-up drive of the jib hoist winch 10, the take-up drive of the tower boom hoist winch 4 and the take-up drive of the hook hoist winch 15 all stop and also that the alarm bell and the alarm buzzer sound. It is to be noted that the limit switch 72 is manually pressed down by the assistant operator or the like on the ground to set it in an ON state.

After verifying that the tower ultimate-overwind preventing device operates normally by checking all the safety verification items shown in FIG. 14, the operator operates the "next" key (○ key) 45. In response to the operation of the "next" key 45, the display is switched to the display screen shown in FIG. 15.

In the display screen in FIG. 15, safety verification items to be checked to check the operation of the jib ultimate-overwind preventing device are displayed. It is to be noted that when the limit switch 73 provided near the rotational center of the jib 3 detects that the jib angle of the jib 3 has reached a predetermined ultimate limit value, e.g., 65°, the jib ultimate-overwind preventing device automatically stops the take-up drive of the jib hoist winch 10, the take-down drive of the tower boom hoist winch 4 and the take-up drive of the hook hoist winch 15 and also sounds an alarm bell and an alarm buzzer to alert the operator to the jib ultimate-overwind.

The operator operates the operating levers (not shown) while the limit switch 73 is held down, to verify that the take-up drive of the jib hoist winch 10, the take-down drive of the tower boom hoist winch 4 and the take-up drive of the hook hoist winch all stop and also that the alarm bell and the alarm buzzer sound. It is to be noted that the limit switch 73 is manually pressed down by the assistant operator or the like on the ground to set it in an ON state.

After verifying that the jib ultimate-overwind preventing device operates normally by checking all the safety verification items shown in FIG. 15, the operator operates the "next" key (○ key) 45. In response to the operation of the "next" key 45, the display is switched to the display screen shown in FIG. 16.

In the display screen shown in FIG. 16, a message with instructions for checking the operation of the overload preventing device is displayed in the main screen and the load factor and indicators indicating whether or not an alarm signal and an auto stop signal have been output are displayed in the sub-screen. It is to be noted that the overload preventing device functioning as the so-called moment limiter calculates the load based on the cable tensions and the like, which is applied to the jib 3, and stops operations that will further increase the load such as take-down drive of the tower boom hoist winch 4, take-down drive of the jib hoist winch 10 and take-up drive of the hook hoist winch 15 and sounds an alarm buzzer once the calculated load exceeds a limit value set in correspondence to the working radius in advance.

In the main screen in FIG. 16, the following message, for instance, may be displayed.

Check the overload preventing device. An alarm will sound 3 seconds after ○ key is pressed and an auto stop signal will be output 6 seconds after. Verify that the take-up drive and the hoist-down drive stop in response to operating the levers.

The operator operates the ○ key 45 at the input device 40 by following the instructions in the message displayed in the display screen of the display unit 30 to verify that the alarm is output and also that the take-down drive of the tower boom hoist winch 4, the take-down drive of the jib hoist winch 10 and the take-up drive of the hook hoist winch 15 are stopped. It is to be noted that information indicating whether or not the alarm signal and the auto stop signal have been output is displayed in the sub-screen.

Once the operation of the overload preventing device is checked, the inspection of all the items that need to be checked in the pre-raise inspection ends. Subsequently, if the tower boom 2 is to be raised, the "next" key, displayed in the lower portion of the display screen at the display unit 30 after the operation of the overload preventing device is checked, is selected to move forward to the display screen shown in FIG. 17, which provides the operating procedure guidance for the tower raising operation.

It is to be noted that while the display of the guidance for the safety device check in the pre-raise inspection proceeds from the list of safety devices to be checked, shown in FIG. 10, to provide more detailed guidance in correspondence to the individual safety devices, as shown in FIGS. 12 to 16, in the explanation given above, the detailed guidance in FIGS. 12 to 16 may be skipped. In such a case, the operator should check the operation of each safety device in reference to the list shown in FIG. 10, and once all the safety devices are checked, the operator should select "next" by operating the UP or DOWN arrow key 41 or 43. The selection of "next" brings up a display of the "next" key (○ key) in the lower portion of the display screen, as shown in FIG. 11, to allow the operator to move forward to the tower raising operation guidance screen shown in FIG. 17 by operating the "next" key 45 at the input device 40.

B: Tower Raising Operation (Raising Guidance)

Figure 17:
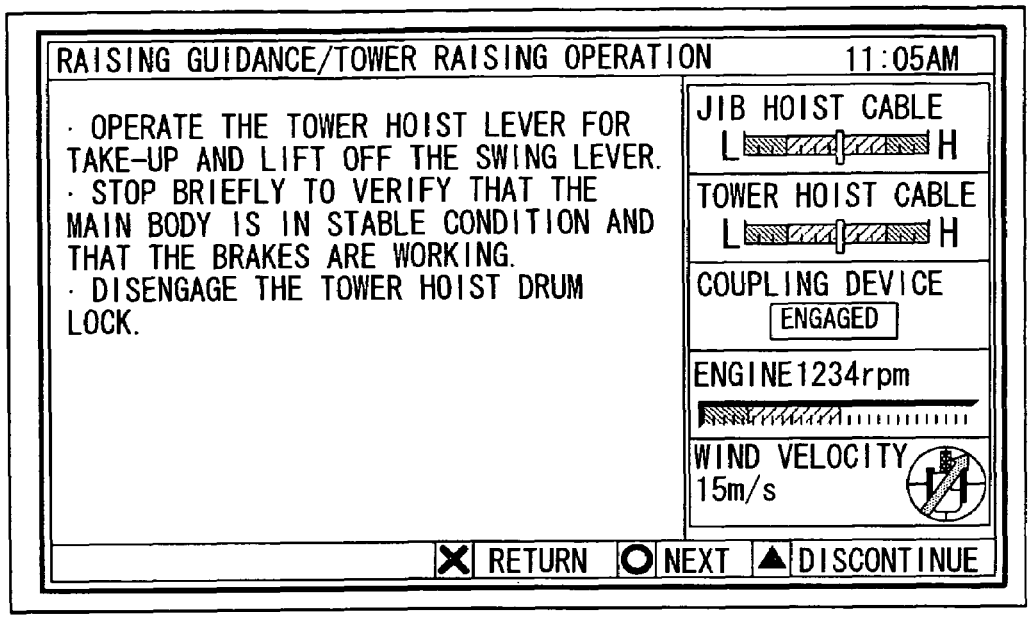

In FIG. 17, guidance with pre-tower raising operation instructions is provided in the main screen, whereas the state quantities indicating the changes in the cable tensions, indicating whether or not the coupling device has been engaged, the state quantities indicating the engine rotational speed, the wind velocity and the wind direction and the like are displayed in the sub-screen. The guidance with the pre-tower raising operation instructions may be provided in the form of, for instance, the following messages.

Operate the tower hoist lever for take-up and lift off the swing lever.

Stop briefly to verify that the main body is in stable condition and that the brakes are working.

Disengage the tower hoist drum lock.

After verifying the operating procedure in reference to the pre-tower raising operation guidance brought up on display at the display unit 30, the operator operates the "next" key (○ key) 45 to start the tower raising operation. In response to the operation of the "next" key 45, the display is switched to the display screen shown in FIG. 18. It is to be noted that if the "return" key (X key) 46 is operated in the display screen shown in FIG. 17, the display returns to the immediately preceding screen, i.e., the screen shown in FIG. 16.

Figure 18:
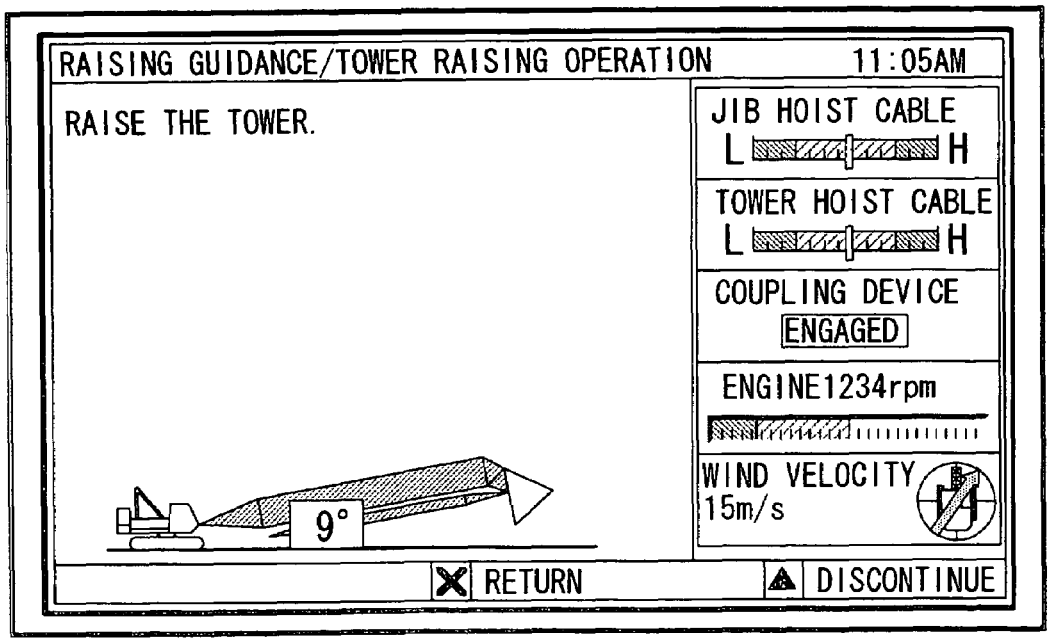

In FIG. 18, tower raising operation guidance is provided in the main screen and state quantities and the like similar to those in FIG. 17 are displayed in the sub-screen. The tower raising operation guidance is provided in the form of a message "Raise the tower" and an illustration of the tower crane shown in FIG. 18. The operator starts the tower raising operation by operating the tower hoist lever and lifts off the tower boom 2 by following the pre-raising operation guidance shown in FIG. 17. The illustration displayed in the main screen at the display unit is synthesized at the controller 20 based upon the tower angle of the tower boom 2 detected by the boom angle sensor 51 and the like. It is to be noted that the real-time tower angle detected by the boom angle sensor 51 is also indicated in the main screen.

Figure 19:
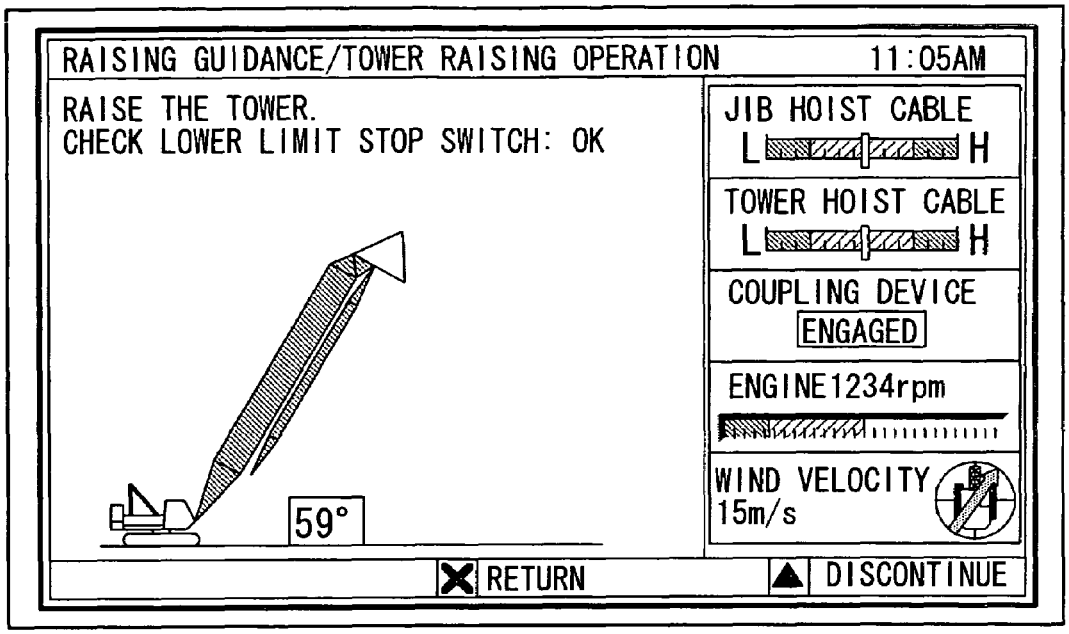

The tower boom 2 in the display screen shown in FIG. 18, which is coupled with the jib 3 as an integrated unit, achieves a tower angle of 9° with the swing lever 7 having been lifted off. As the tower hoist lever is operated for further take-up in this state, the tower boom 2 is raised gradually together with the jib 3 as an integrated unit. While the tower boom 2 is being raised, the tower boom in the illustration displayed at the display unit 30 also moves, as shown in FIG. 19. It is to be noted that the display screen in FIG. 19 shows the tower boom with a tower angle of 59°. As the tower hoist lever is further engaged in the take-up operation, the tower boom 2 is raised even higher and the tower boom in the illustration is made to move further as well.

Figure 20:
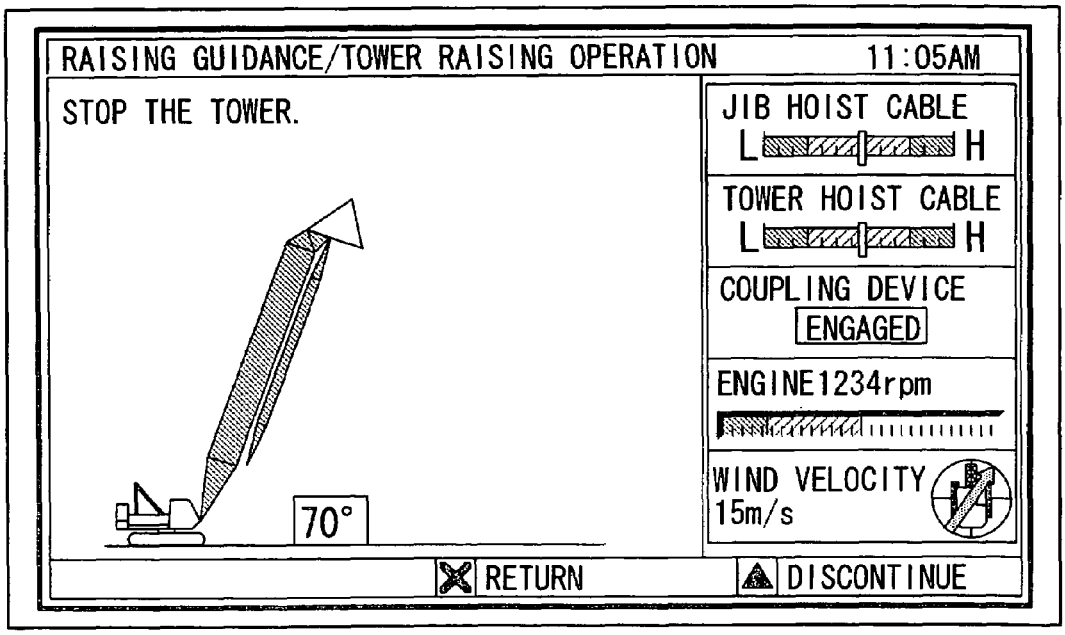

As the tower boom 2 is raised to achieve a tower angle of a predetermined value, e.g., 70°, a message "Stop the tower" is brought up on display in the main screen at the display unit 30, as shown in FIG. 20. The operator, prompted by this message, stops the take-up operation of the tower hoist lever. As the operation for raising the tower boom 2 stops in the display screen shown in FIG. 20, the display at the display unit 30 is switched to the display screen shown in FIG. 21.

Figure 21:
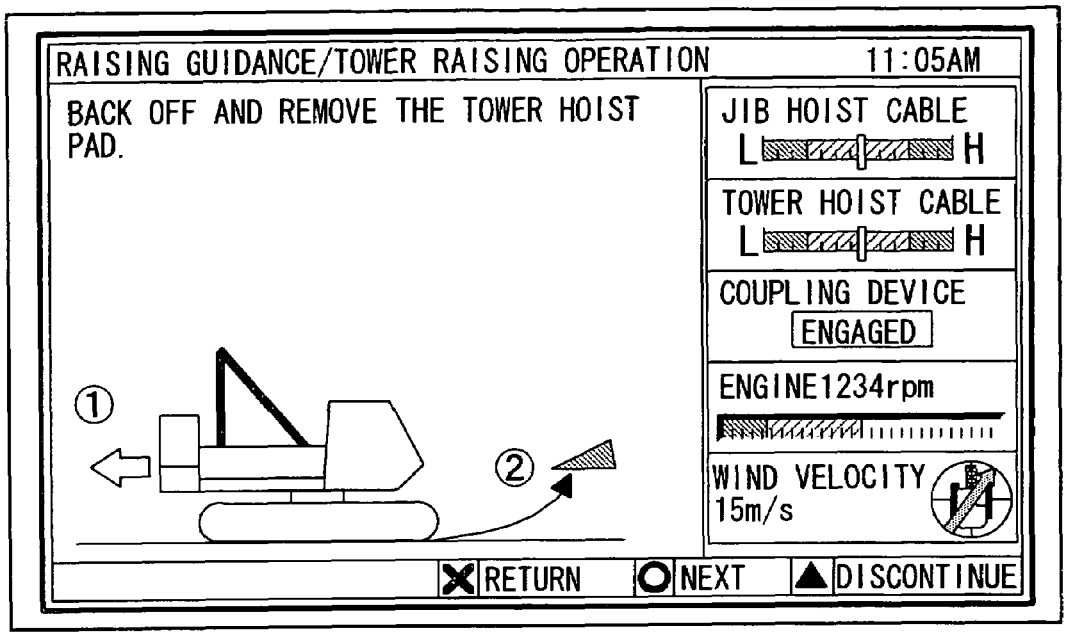

In the display screen shown in FIG. 21, a message "Back off and remove the tower hoist pad" and an illustration of the crane main body 1 is displayed in the main screen. The operator (1) backs off the crane main body 1 and (2) removes a tower hoist pad by following the tower raising operation guidance provided in the display screen shown in FIG. 21. Once the tower hoist pad is removed, the operator operates the "next" key (○ key) 45 at the input device 40 to proceed to the next operating procedure. In response to the operation of the "next" key 45, the display is switched to the display screen shown in FIG. 22. It is to be noted that the tower hoist pad is utilized to prevent the rear side of the crane main body 1 from becoming lifted up due to the weight of the tower boom 2 when raising the tower boom 2.

Figure 22:
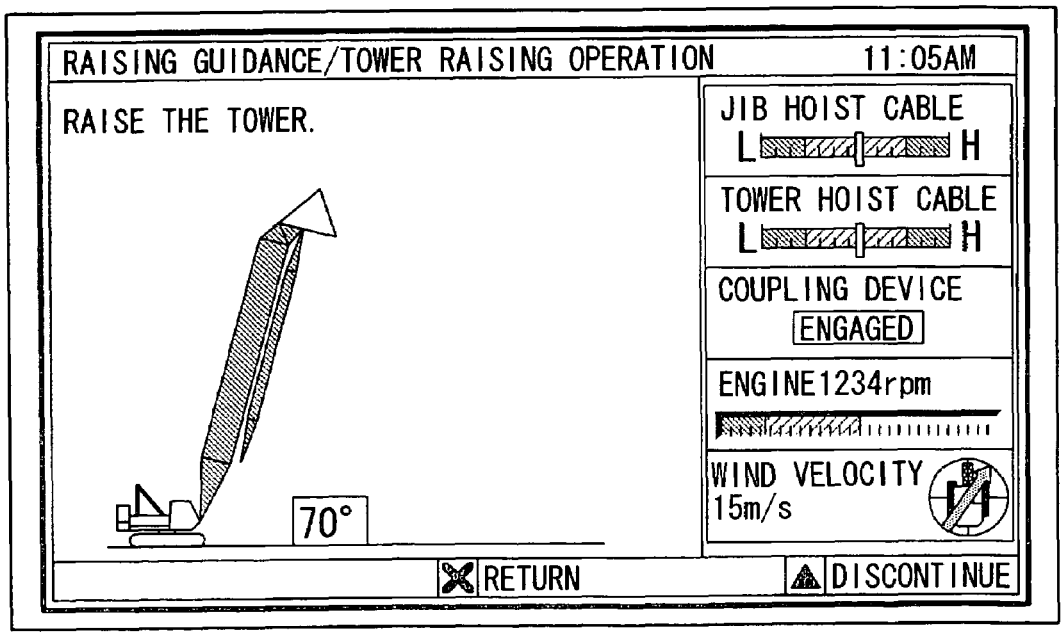

A message "Raise the tower" and an illustration of the tower crane are displayed in the main screen in the display screen shown in FIG. 22 in a format similar to that shown in FIGS. 18 to 20. The operator continues with the operation for raising the tower boom 2 as instructed in the message. It is to be noted that the tower angle of the tower boom displayed in the display screen in FIG. 22 is 70°.

During the tower raising operation, the tower boom 2 coupled with the jib 3 is raised by taking up the boom hoist cable 5. At this time, it is also necessary to take-up the jib hoist cable 11 concurrently so as to ensure that the jib hoist cable 11 does not become slack as the tower boom 2 is raised. The operator checks the extent of changes in the jib hoist cable tension and the tower hoist cable tension displayed in the sub-screen at the display unit 30 and operates the corresponding operating levers to prevent the cables from becoming too slack or too taut. In the embodiment, a warning is brought up on display at the display unit 30 if either of the boom hoist cable tension and the jib hoist cable tension detected by the tension detectors 53 and 54 becomes abnormal. It is to be noted that the warning for an abnormal cable tension may be provided as an audio message.

Figure 23:
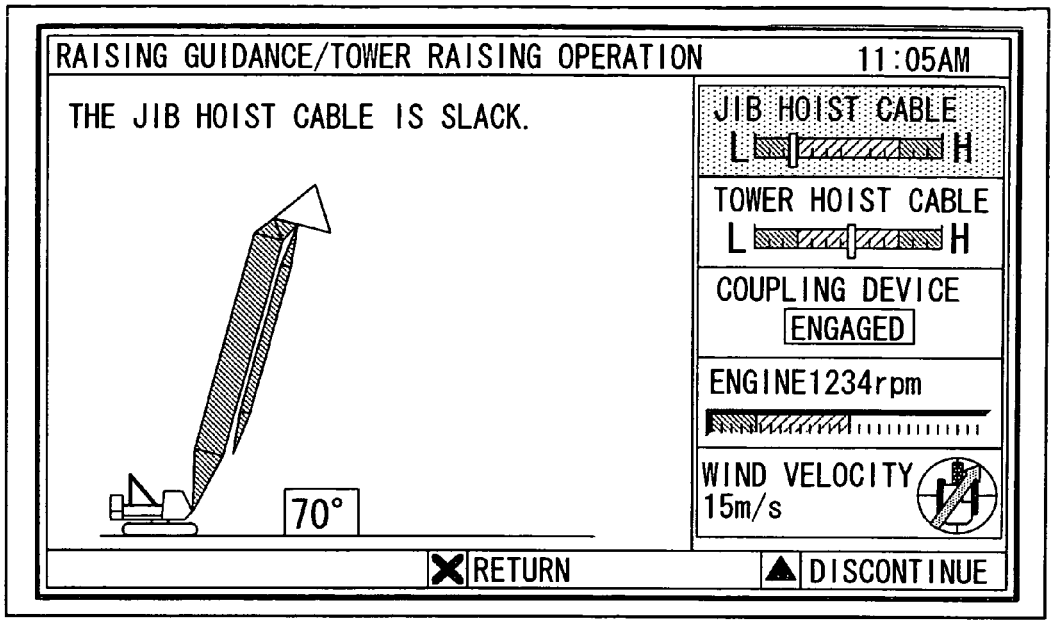

FIG. 23 presents an example of a warning that may be displayed at the display unit 30 when an abnormality is detected in the jib hoist cable tension. The display screen in FIG. 23 includes an illustration of the tower crane and a warning message "The jib hoist cable is slack" displayed in the main screen. In addition, the indicator of the extent of change in the jib hoist cable tension in the sub-screen shifts to the L (low) side and the graph of the jib hoist cable tension change becomes lit to indicate an abnormal cable tension. In response to the warning message displayed at the screen of the display unit 30, the operator operates the operating lever to take-up the jib hoist cable 11 so as to adjust the jib hoist cable tension. Once the jib hoist cable tension returns to normal, the display at the display unit 30 is switched to a tower raising operation guidance screen such as that shown in FIG. 22. Accordingly, the operator resumes the tower raising operation by operating the operating levers.

Figure 24:
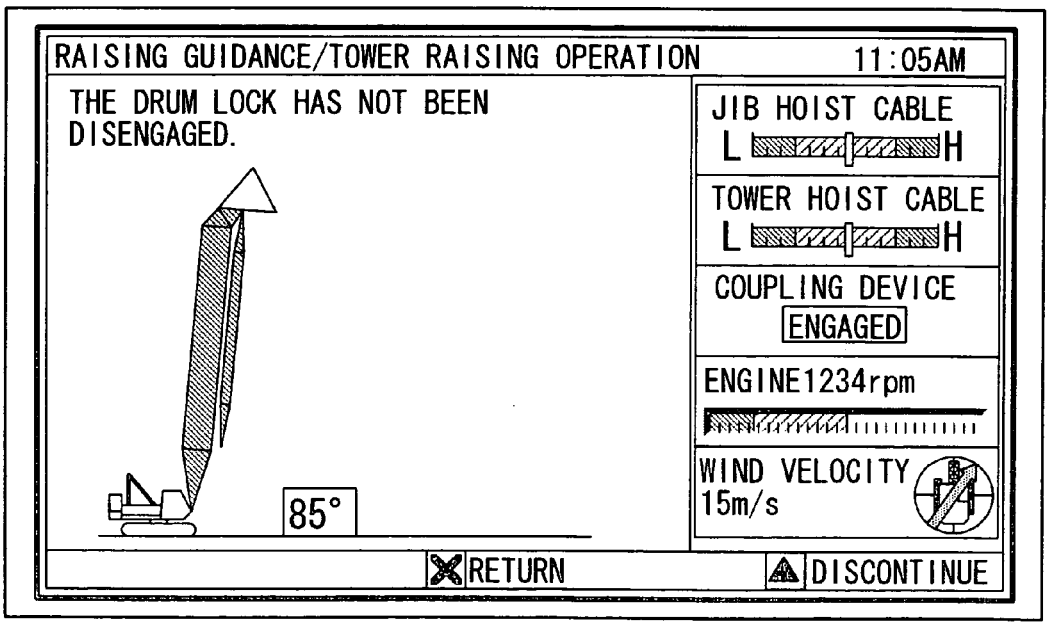

The display screen in FIG. 24 is an example of a warning output if the tower hoist drum lock has not been disengaged before the tower boom 2 enters a state of a 90°-overwind, e.g., when the tower angle is 85°. Unless the tower hoist drum lock is disengaged, the lock claw may be caught at the winch drum and the take-down operation may be disabled when the tower boom has entered a state of 90°-overwind. While the message "Disengage the tower hoist drum lock" is displayed in the pre-tower raising operation guidance shown in FIG. 17, a warning message such as "The drum lock has not been disengaged" is brought up on display together with an illustration of the tower crane if the operator inadvertently fails to disengage the tower hoist drum lock in spite of the message in FIG. 17.

As the operator disengage the tower hoist drum lock in response to the message, the display at the display unit 30 is switched to a tower raising operation guidance screen such as that shown in FIG. 22. However, the illustration and the tower angle actually displayed in the main screen at this time reflects the real-time angle of the tower boom 2 detected by the boom angle sensor 51.

Figure 25:
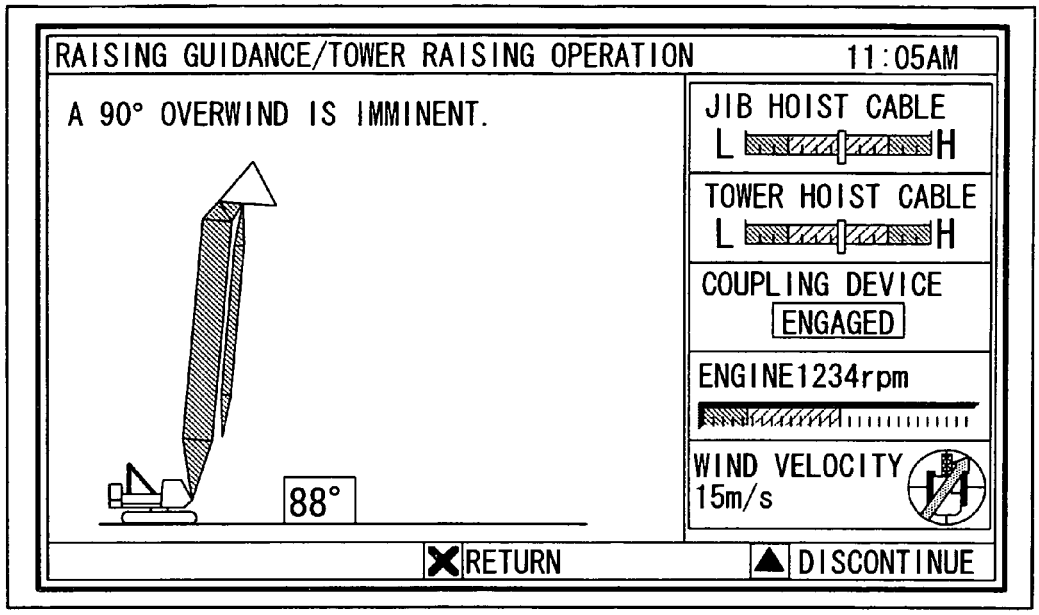

As the tower boom 2 coupled with the jib 3 is further raised and the tower angle reaches a predetermined value, e.g., 88°, the display at the display unit 30 is switched to the display screen shown in FIG. 25. In the display screen shown in FIG. 25, an illustration of the tower crane with a tower angle of 88° and a message "A 90°-overwind is imminent" are displayed in the main screen.

Figure 26:
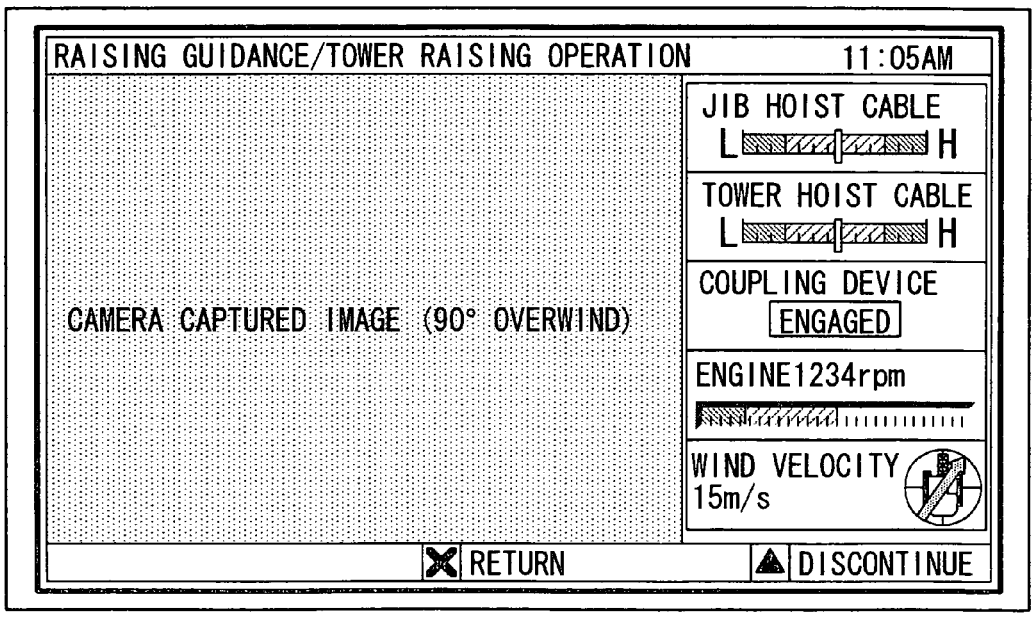

As the tower boom 2 is further raised from this state, the display at the display unit 30 is switched to the display screen shown in FIG. 26 immediately before the tower angle reaches 90°. In the display screen in FIG. 26, an image of the vicinity of the limit switch 71 which detects a 90°-overwind of the tower boom 2, captured by the camera 58, is displayed in the main screen. The operator verifies that the limit switch 71 has been pressed and the tower angle of the tower boom 2 has reached 90° by observing the captured image displayed at the display unit 30. Once the tower angle of the tower boom 2 reaches 90°, the display at the display unit 30 is switched to the display screen shown in FIG. 27. It is to be noted that as the limit switch 71 is pressed, the tower 90°-overwind preventing device is activated and stops the take-up drive of the tower boom hoist winch 4, thereby stopping the raising operation of the tower boom 2.

Figure 27:
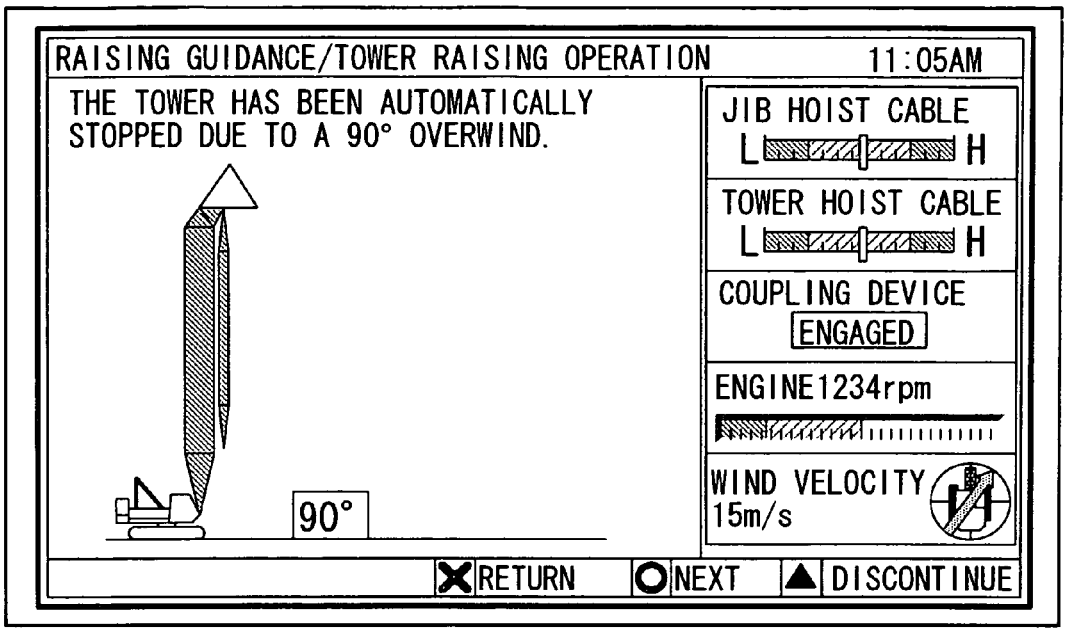

In the display screen shown in FIG. 27, a message "The tower has been automatically stopped due to a 90°-overwind" is displayed together with an illustration of the tower crane with a 90° tower angle in the main screen. As the display screen in FIG. 27 is brought up on display at the display unit 30, the tower raising operation guidance ends. Subsequently, the "next" key (○ key) displayed in the lower portion of the display screen in FIG. 27 is selected to move forward to the display screen of the jib raising operation procedure in FIG. 28 to raise the jib 3.

C: Jib Raising Operation (Raising Guidance)

Figure 28:
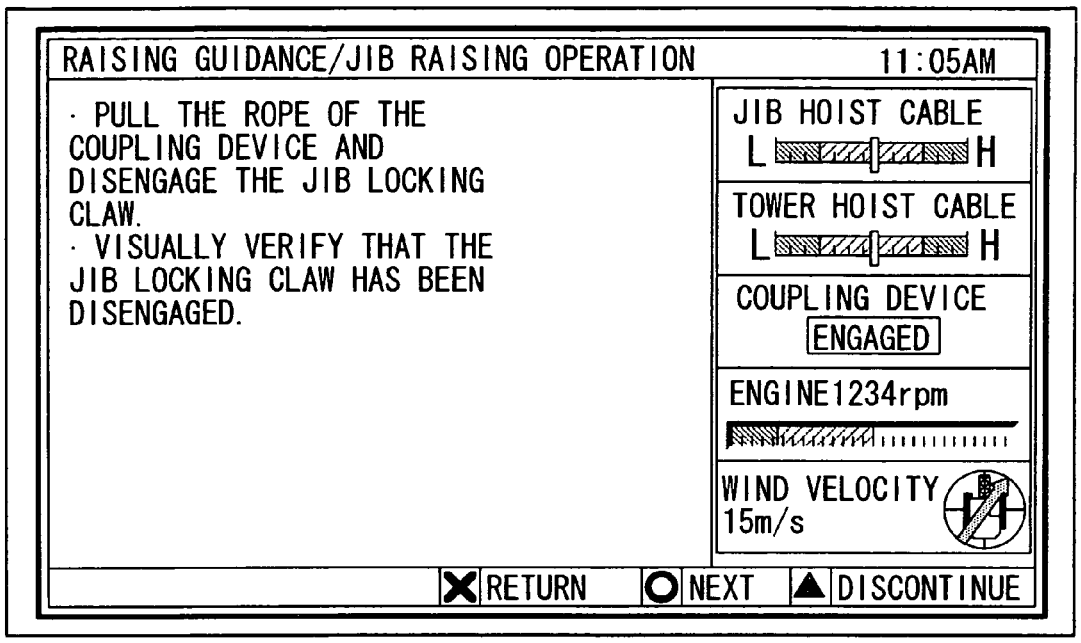

In FIG. 28, guidance for the jib raising operation is provided in the main screen and the state quantities and the like are displayed in the sub-screen. The jib raising operation guidance may be provided in the form of, for instance, the following messages.

Pull the rope of the coupling device and disengage the jib locking claw.

Visually verify that the jib locking claw has been disengaged.

Before starting the operation for raising the jib 3, the operator ensures that the tower boom 2 and the jib 3 are disengaged from each other by checking the operating procedure in reference to the jib raising operation guidance displayed at the display unit 30. The tower boom 2 and the jib 3 in the coupled state are released from each other by, for instance, the assistant operator on the ground. Upon releasing the coupling device 13 by following the guidance, the operator operates the "next" key (○ key) 45 to proceed to the next operating procedure. If, on the other hand, he selects the "return" key (X key), the display returns to the immediately preceding display screen, i.e., the display screen shown in FIG. 27. In response to the operation of the "next" key 45, the display is switched to the display screen shown in FIG. 30. However, if the "next" key 45 is operated without first disengaging the coupling device 13, the display is switched to the display screen shown in FIG. 29.

Figure 29:
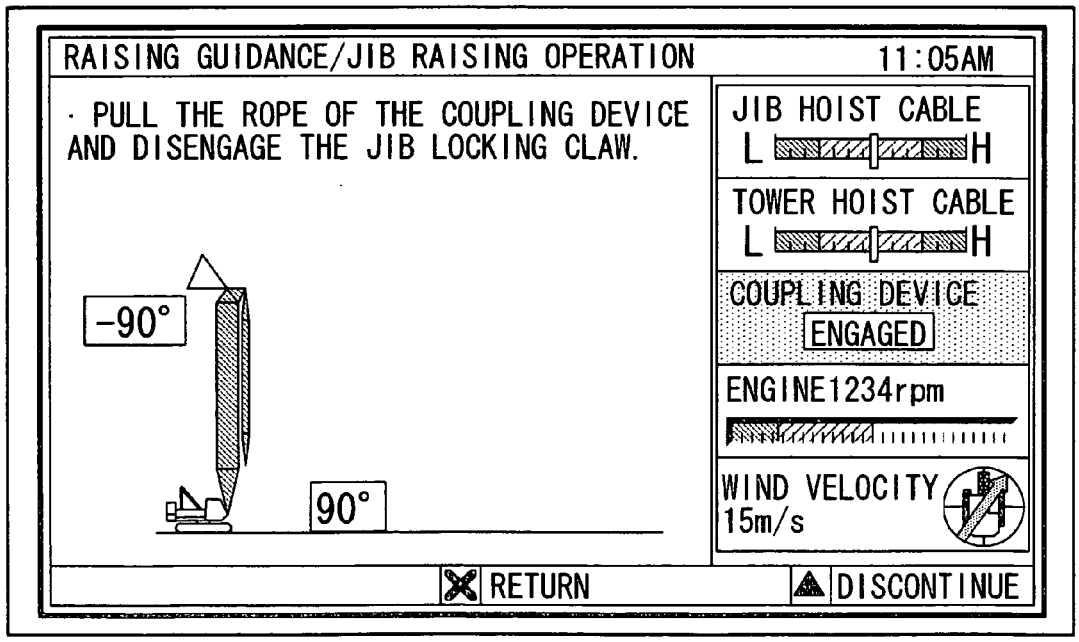

In FIG. 29, an illustration of the tower crane with a 90° tower angle and a warning message "Pull the rope of the coupling device and disengage the jib locking claw" are displayed in the main screen, together with the ground angle of the jib 3 relative to the ground surface, i.e., the jib angle, in addition to the tower angle. The jib angle is −90° when the jib 3 and the tower boom 2 are in a coupled state, as shown in FIG. 29. In addition, an indicator, which indicates that the coupling device 13 is engaged, is lit in the sub screen to alert the operator that the coupling device 13 is still in an engaged state. The warning that the coupling device 13 has not been disengaged yet may be instead provided as an audio message.

Figure 30:
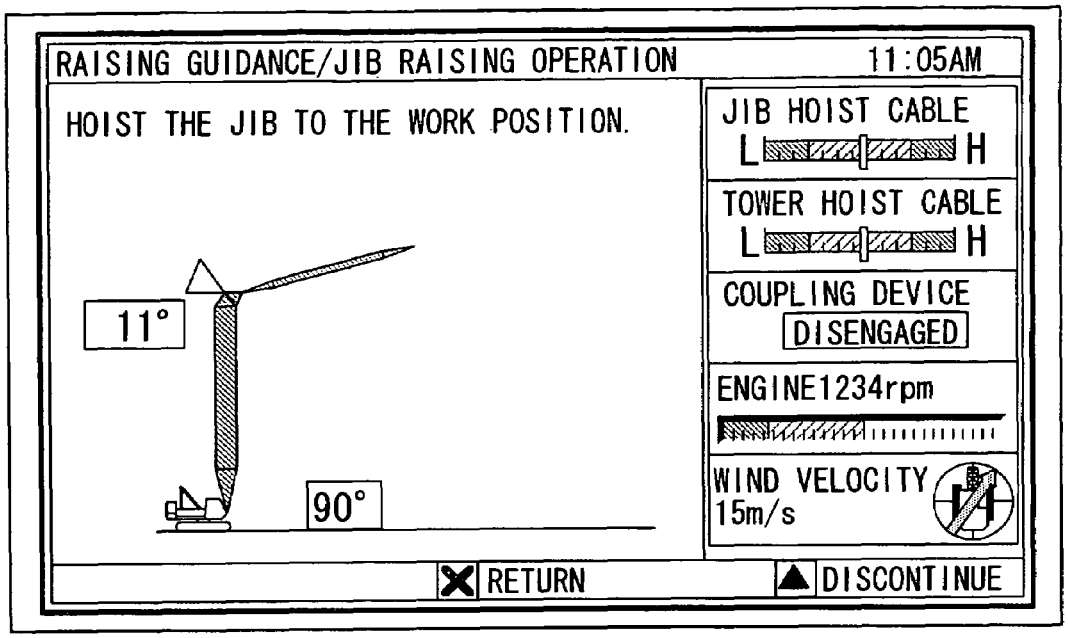

As the coupling device 13 becomes released by pulling the rope 13*f* at the coupling device 13 by following the instructions in the display screen shown in FIG. 29, the display at the display unit 30 is switched to the display screen shown in FIG. 30.

In FIG. 30, a message "Hoist the jib to the work position" is displayed together with an illustration of the tower crane in the main screen. An indicator indicating that the coupling device has been disengaged is displayed in the sub-screen. It is to be noted that the illustration displayed in the main screen in FIG. 30 shows the jib 3 having been taken up through an operation of the operating lever to achieve a jib angle of 11°.

In the state shown in FIG. 30, the operating lever is engaged in a further take-up operation to raise the jib 3. As the jib angle of the jib 3 reaches a predetermined value, e.g., 15°, the display at the display unit 30 is switched to the display screen shown in FIG. 31. At the display screen shown in FIG. 31, the following messages are displayed to inform the operator that the raising guidance has been completed.

The raising guidance has been completed.

Check the overwind preventing devices.

Figure 31:
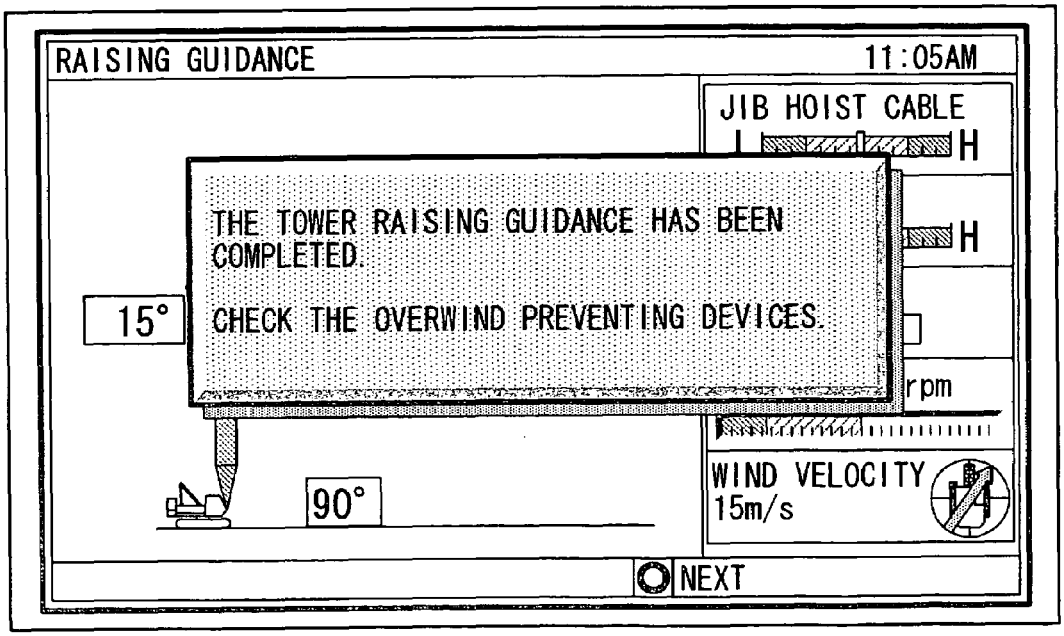

With the display screen in FIG. 31 brought up on display at the display unit 30, the tower crane raising guidance ends. Subsequently, for shifting into the crane work the operator selects the "next" key (○ key) displayed in the lower portion of the display screen in FIG. 31 to move forward to the display screen providing the pre-work inspection guidance in FIG. 32.

As explained in reference to FIGS. 5 to 31 above, the operator can perform the pre-raise inspection and the raising operation with ease and reliability by following the raising guidance brought up on display at the display unit 30. It is to be noted that the operation assist apparatus according to the present invention provides moment limiter screens during the crane work or operation, in addition to displaying the operating procedures of the raising setup operations.

It is to be also noted that before starting the crane work upon completing the tower crane setup operations, a pre-work inspection must be performed on the tower crane assuming the work posture. Accordingly, if the "next" key 45 is operated at the input device after the raising guidance ends, guidance for the pre-work inspection is displayed at the display unit 30.

D: Work Range

FIG. 32 shows a list of safety devices to be checked in the pre-work inspection, which is displayed over the entire display screen. As in the pre-raise inspection performed by referring to the display screens in FIGS. 10 to 16, the operations of the hook overwind preventing device, the tower 90°-overwind preventing device, the tower ultimate-overwind preventing device, the jib ultimate-overwind preventing device and the overload preventing device are checked in the pre-work inspection. As the operator selects a safety device in the list by operating the UP or DOWN arrow key 41 or 43 at the input device 40 while the display screen in FIG. 30 is up on display at the display unit 30 and then operates the "details" key (○ key) 45, the display is switched to a details screen, such as one of those shown in FIGS. 12 to 16, to be used to inspect the corresponding safety device.

It is to be noted that the pre-work inspection may be performed by checking the detailed safety verification items displayed in correspondence to each safety device at the display screen of the display unit 30 as in the case of the pre-raise inspection, or the inspection may be performed by checking the safety verification items for each safety device in reference to the list in the display screen shown in FIG. 32. We assume that the operator checks the operations of the individual safety devices by referring to the list of the pre-work inspection items in FIG. 32 and, accordingly, an explanation of images providing verification details is omitted.

Once the operations of the safety devices are all checked, the operator operates the UP or DOWN arrow key 41 or 43 at the input device 40 to select "to next". As "to next" is selected, the display at the display unit 30 is switched to the display screen shown in FIG. 33. Subsequently, the operator selects the "next" key (○ key) while the display screen in FIG. 33 is up on display to start a crane work. In response to the operation of the "next" key 45, the display at the display unit 30 is switched to a moment limiter screen, such as that shown in FIG. 34.

As shown in FIG. 34, information related to the load applied to the tower crane is displayed in the moment limiter screen. The operator drives the tower boom 2, the jib 3 and the like as appropriate so as to ensure that an excessive load is not applied to the tower crane by checking the information displayed in the moment limiter screen during the crane work.

In the display screen shown in FIG. 34, an illustration of the tower crane, which is synthesized at the controller 20, is displayed in the main screen, whereas the image of a winch drum captured by the camera 58 is displayed together with the quantities indicating the state of the tower crane and the environment information in the sub-screen. In the illustration of the tower crane displayed in the main screen, the tower length, the jib length and the tower angle and the jib angle respectively detected at the boom angle sensor 51 and the jib angle sensor 52 are indicated. In addition, the working radius, which is calculated based upon the tower length, the jib length, the tower angle and the jib angle, is indicated in the main screen. The load limit corresponding to the current working radius and the actual load of the suspended load, which are calculated based upon the cable tensions of the boom hoist cable 5 and the jib hoist cable 11 detected by the tension detectors 53 and 54, are also indicated in the main screen. The load factor calculated based upon the load limit and the actual load of the suspended load is provided in the sub-screen. A rated load table to be referenced to determine the load limit corresponding to the current working radius is stored in advance at the ROM 28 of the controller 20. It is to be noted that the illustration of the tower crane displayed in the moment limiter screen such as that shown in FIG. 34 does not need to be animated to reflect the movement of the tower crane.

It is to be also noted that the extents of the changes in the tensions of the boom hoist cable 5 and the jib hoist cable 11 are not displayed in the sub-screen at the moment limiter screen shown in FIG. 34. However, the operator is enabled to monitor for any irregular winding and the like of the cables by checking the states of the winches 4, 10 and 15 in the image captured by the camera 58.

In addition, by operating a display switch key (left or right arrow key) displayed in the lower portion of the display screen shown in FIG. 34, the image captured by the camera 58 can be displayed in the main screen at the display unit 30. For instance, if the operator operates the right arrow key 42 at the input device 40 while the display screen in FIG. 34 is up on display, a captured image of the rear side of the crane main body 1 is displayed in the main screen, as shown in FIG. 35. At this time, information such as the working radius, the tower angle, the jib angle and the actual load of the suspended load is displayed together with the load factor, the engine rotational speed, the wind velocity and the wind direction in the sub-screen.

If the left arrow key 44 at the input device 40 is operated in the moment limiter screen shown in FIG. 35, the display returns to the display screen shown in FIG. 34, whereas if the operator operates the right arrow key 42, an image of the winch 4, 10 or 15 is brought up on display in the main screen, as shown in FIG. 36. In FIG. 36, the image displayed in the main screen may be an image showing any of the winches 4, 10 and 15 or the main screen may be split into three areas to display images of the winches 4, 10 and 15 all at once. In the sub-screen in FIG. 36, too, the quantities indicating the state of the tower crane and the like are displayed as in the display screen shown in FIG. 35. As the operator operates the LEFT or RIGHT arrow key 42 or 44 at the input device 40 in the moment limiter screen shown in FIG. 36, the display is switched to the display screen in FIG. 34 or FIG. 35.

The operator is enabled to conduct the crane work without moving beyond the work range or causing an overload by monitoring the work posture of the tower crane and the states of the winch drums in the moment limiter screens in FIGS. 34 to 36 brought up on display at the display unit 30. If the tower boom 2 is to be lowered together with the jib 3 after the crane work, guidance for the lowering operation is brought up on display at the display unit 30 and, accordingly, the operator performs lowering setup operations by following the lowering guidance.

A guidance key (□ key) is displayed in the lower portion of the display screens in FIGS. 34 to 36. As the operator operates the guidance key (□ key) 48 at the input device 40, lowering guidance for lowering the tower crane is brought up on display at the display unit 30. Normally, the jib 3 is first taken down to be coupled with the tower boom 2 after raising the tower boom 2 in order to lower the tower crane. Then, the tower boom 2 now coupled with the jib 3 lowered onto the ground. However, the instructions in the lowering guidance displayed at the display unit 30 may need to be changed depending upon the tower crane posture and the like. Accordingly, the controller 20 determines the lowering guidance screen to be brought up on display at the display unit 30 based upon the state, the posture and the like of the tower crane when the guidance key 48 is operated.

Figure 58:
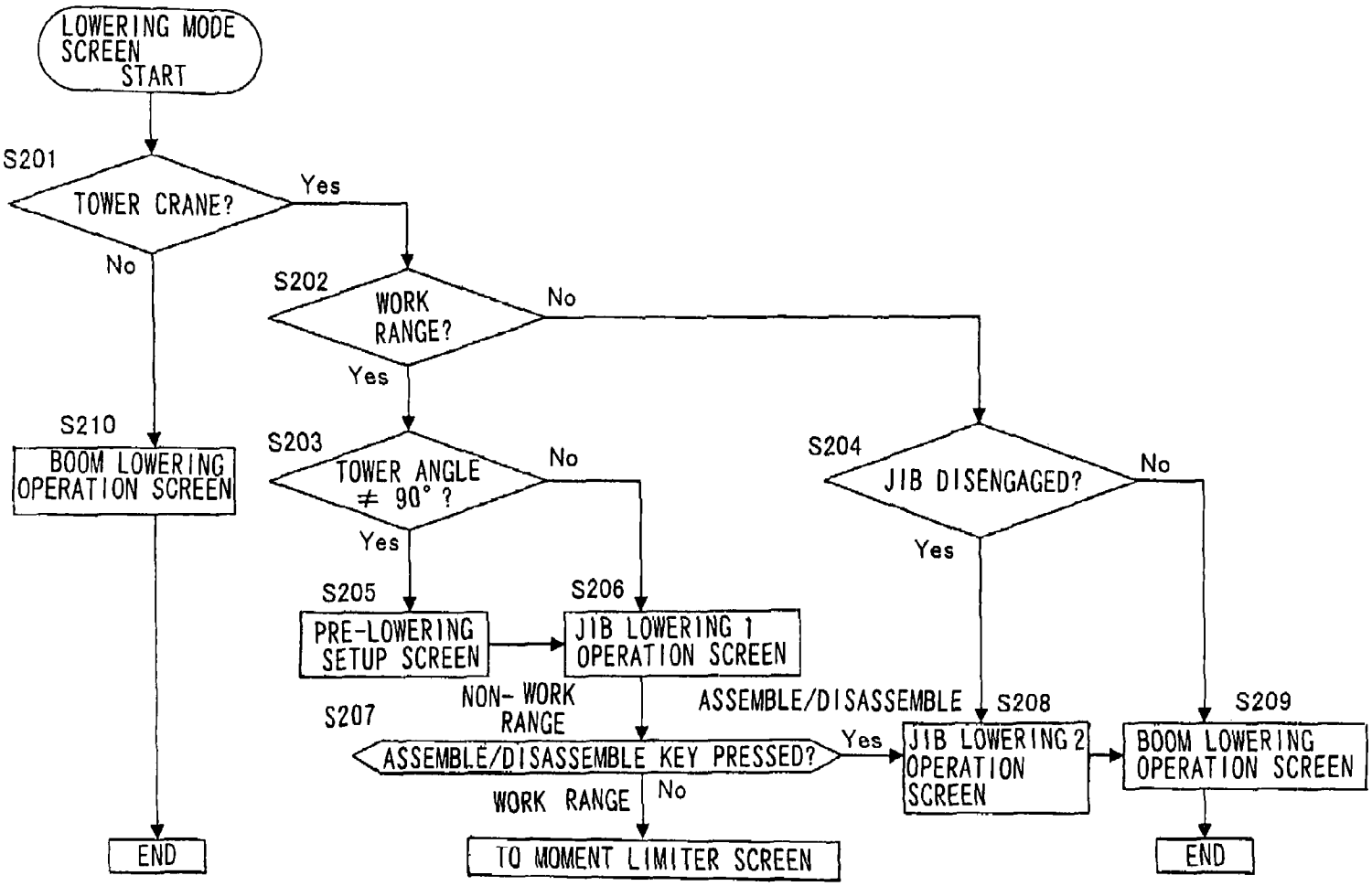
FIG. 58 presents a flowchart of the crane lowering operation.

FIG. 58 presents a flowchart showing the flow of the lowering operation guidance screens displayed at the display unit 30 in correspondence to the state of the tower crane. The controller 20 judges which specific guidance screen should be displayed. The flow in the flowchart presented in FIG. 58 starts as the operator selects the guidance key 48 at the input device 40 while one of the moment limiter screens in FIGS. 34 to 36 is on display.

First, in step S 201, a decision is made as to whether or not the construction machine is a tower crane having the tower boom 2 and the jib 3 attached as a front attachment to the crane main body 1. If an affirmative decision is made in step S 201 that the construction machine is a tower crane, the operation proceeds to step S 202. In step S 202, a decision is made as to whether or not the current working radius of the tower crane, which is calculated based upon the data provided by the boom angle sensor 51, the jib angle sensor 52 and the like, is within the work range. This decision is made by comparing the current working radius with the working radius limit calculated at the moment limiter, and it is decided that the current working radius is within the work range if the deviation of the current working radius is within a predetermined value set relative to the working radius limit. If an affirmative decision is made in step S 202, the operation proceeds to step S 203.

In step S 203, a decision is made as to whether or not the tower angle is other than 90°. If an affirmative decision is made in step S 203, the operation proceeds to step S 205 to display the pre-lowering setup operation screens, i.e., the tower raising operation screens in FIGS. 37 to 41 at the display unit 30. When the tower raising operation performed by following the instructions provided in the display screens is completed, the operation proceeds to step S 206. In step S 206, a screen (see FIG. 42) showing the first step in the jib lowering operating procedure is displayed at the display unit 30.

It is to be noted that if a negative decision is made in step S 203, i.e., if the tower angle is 90°, the operation proceeds to step S 206 to display the screen (see FIG. 42) of the jib lowering operating procedure at the display unit 30.

As the jib 3 is taken down to achieve a predetermined jib angle in step S 206, the operation proceeds to step S 207 to make a decision as to whether or not an "assemble/disassemble key", i.e., the ○ key 45, has been operated. If an affirmative decision is made in step S 207, the operation proceeds to step S 208 to display the screens (FIGS. 43 to 46) of the subsequent steps in the jib lowering operating procedure at the display unit 30. When the jib lower in a operation performed by following the instructions provided in the display screens is completed, the operation proceeds to step S 209. In step S 209, screens (FIGS. 47 to 56) of the tower lowering operating procedure are displayed at the display unit 30. Once the tower lowering operation performed by following the instructions provided in the display screens is completed, the sequence of the lowering setup operation ends.

If, on the other hand, a negative decision is made in step S 202, i.e., if the tower crane is not within the work range, the operation proceeds to step S 204. In step S 204, a decision is made as to whether or not the jib 3 is disengaged from the tower boom 2, i.e., whether or not the tower boom 2 and the jib 3 are in an uncoupled state. If an affirmative decision is made in step S 204 that the tower boom 2 and the jib 3 are in an uncoupled state, the operation proceeds to step S 208 to lower the jib 3. If a negative decision is made in step S 204 with the jib 3 having already been taken down and coupled with the tower boom 2 via the coupling device 13, the operation proceeds to step S 209 to display the screens of the tower lowering operation procedure.

It is to be noted that if a negative decision is made in step S 207 that the assemble/disassemble key 45 has not been operated, it is judged that the crane work is to be continued and the moment limiter screen in FIG. 34 is brought up on display.

In addition, if a negative decision is made in step S 201, i.e., if the construction machine is a regular crane instead of a tower crane, the operation proceeds to step S 210 to display screens of the boom lowering operation procedure at the display unit 30. As the boom lowering operation performed by following the instructions provided in the display screens is completed, the sequence of lowering setup operation ends. It is to be noted that since the setup operations that must be performed to lower a regular crane are not as complicated as the setup operations required for a tower crane, displaying the operation procedures at the display unit 30 may not be necessary in the case of a regular crane.

The following is an explanation of the lowering guidance displayed at the display unit 30 to assist the lowering operations to be performed when the tower crane is within the work range and the tower angle of the tower boom 2 is not 90°. As the guidance key (□ key 48) is selected in one of the moment limiter screens shown in FIGS. 34 to 36, the display screen in FIG. 37 is brought up on display at the display unit 30.

F: Tower Raising Operation (Lowering Guidance)

Figure 37:
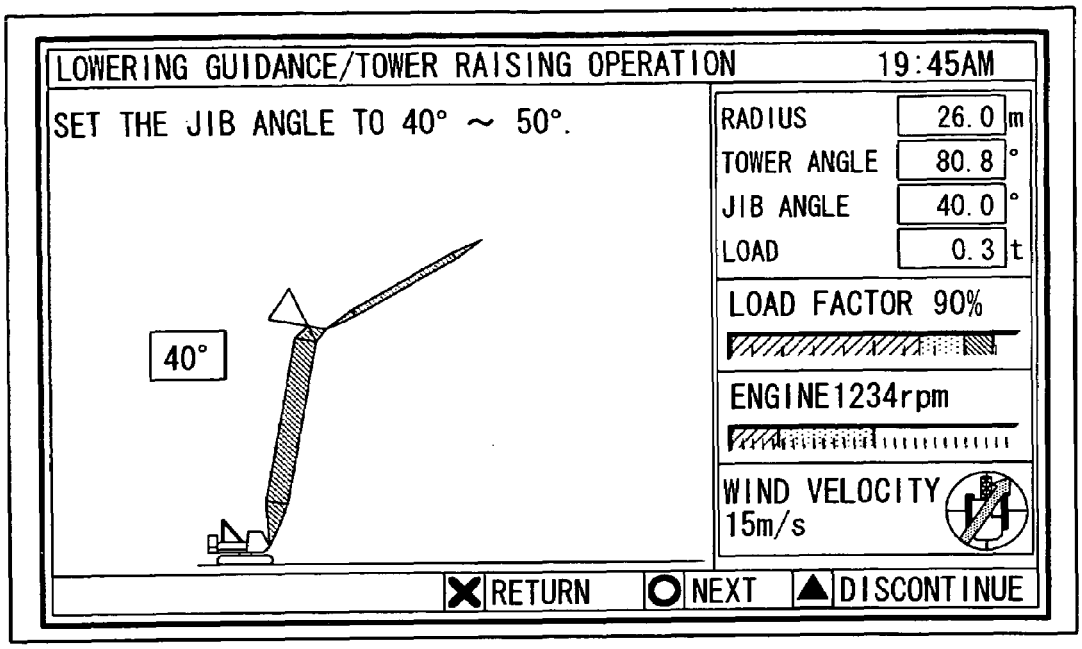
FIGS. 37 to 56 each present an example of an operating procedure screen that may be displayed at the display unit.

FIG. 37 shows guidance for the tower raising operation brought up on display together with an illustration of the tower crane in the main screen. Information similar to that displayed in the moment limiter screen, such as the working radius, the tower angle, the jib angle and the actual load of the suspended load as well as the load factor, the engine rotational speed, the wind velocity and the wind direction, is displayed in the sub-screen. The tower raising guidance may be provided in the form of, for instance, a message "Set the jib angle to 40°-50°". At this time, the jib angle is displayed in the tower crane illustration. After the operator takes up or takes down the jib 3 so as to achieve a jib angle of 40° to 50° and operates the "next" key (○ key 45), the display is switched to the display screen shown in FIG. 38.

Figure 38:
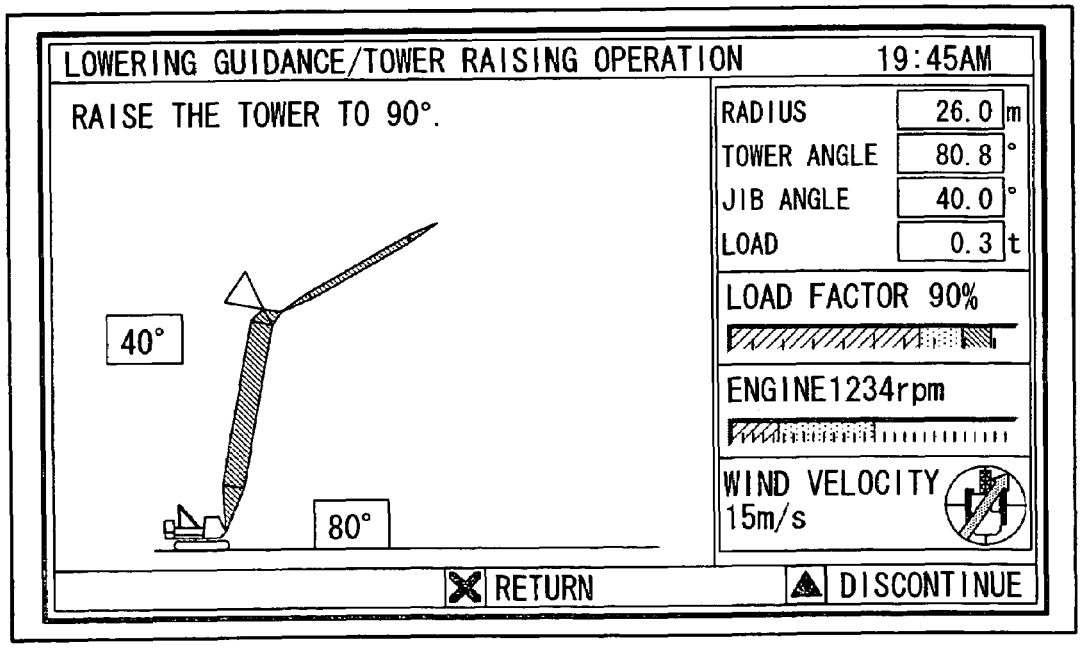

In the display screen shown in FIG. 38, a message "Raise the tower to 90°" is displayed together with an illustration of the tower crane indicating the jib angle and the tower angle in the main screen. As the tower boom 2 is hoisted up to achieve a predetermined tower angle of, for instance, 88°, the display at the display unit 30 is switched to the display screen shown in FIG. 39.

Figure 39:
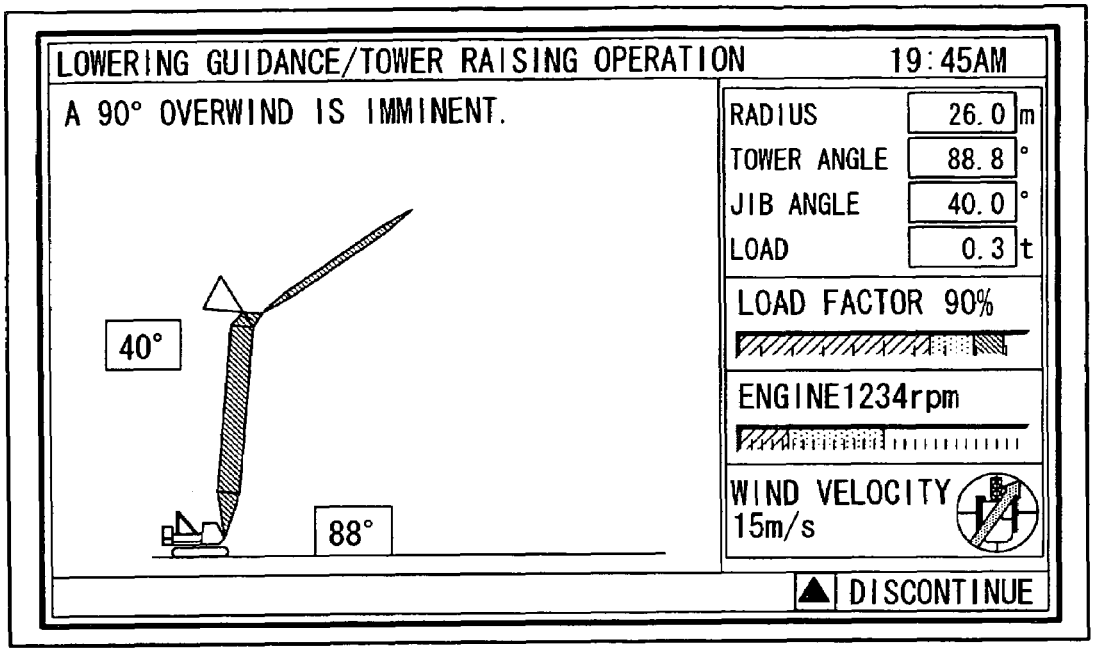

In the display screen shown in FIG. 39, a message "A 90°-overwind is imminent" is displayed together with an illustration of the tower crane indicating the tower angle of 88° in the main screen. As the tower boom 2 is further raised in this state, the display at the display unit 30 is switched to an image captured by the camera shown in FIG. 40 immediately before the tower angle reaches 90°.

Figure 40:
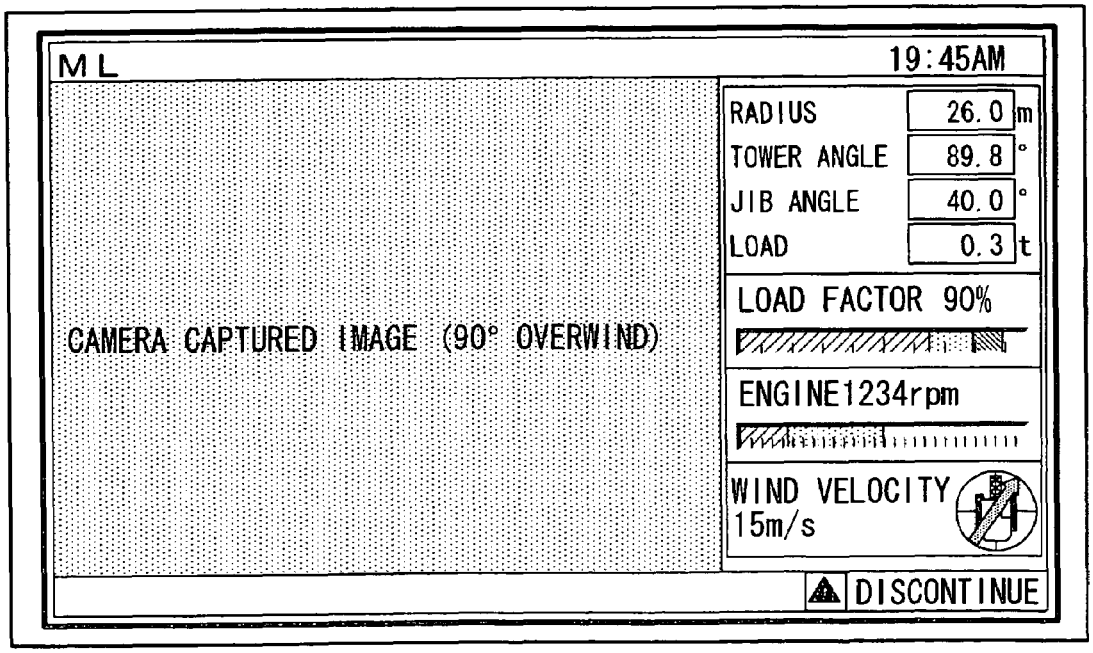

The operator observing the captured image of the area around the limit switch for 90°-overwind detection displayed in the main screen in FIG. 40 verifies that the limit switch has been pressed and the tower angle of the tower boom 2 has reached 90°. Once the tower angle reaches 90°, the tower 90°-overwind preventing device is activated to stop the take-up drive of the tower boom hoist winch 4, and the display at the display unit 30 is switched to the display screen shown in FIG. 41.

Figure 41:
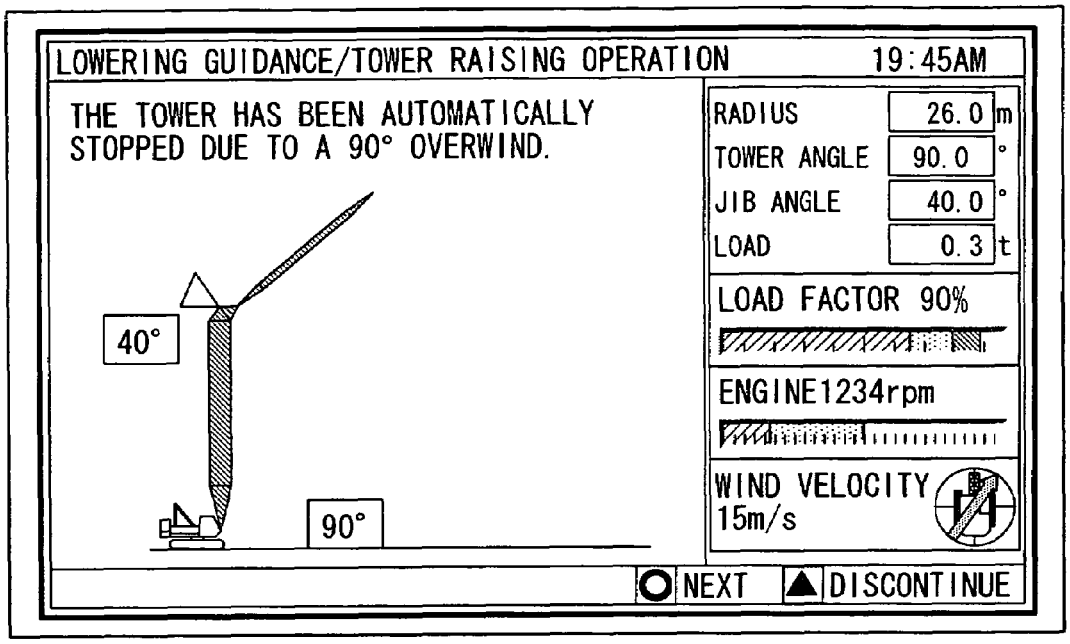

In the display screen shown in FIG. 41, a message "Tower has been automatically stopped due to a 90°-overwind" is displayed together with an illustration of the tower crane indicating the tower angle of 90° in the main screen. With this, the tower raising operation guidance ends. Subsequently, if the jib 3 is to be lowered, the operator selects the "next" key (○ key 45) displayed in the display screen shown in FIG. 41 to move forward to the display screen of the jib lowering operation procedure shown in FIG. 42.

G: Jib Lowering Operation (Lowering Guidance)

Figure 42:
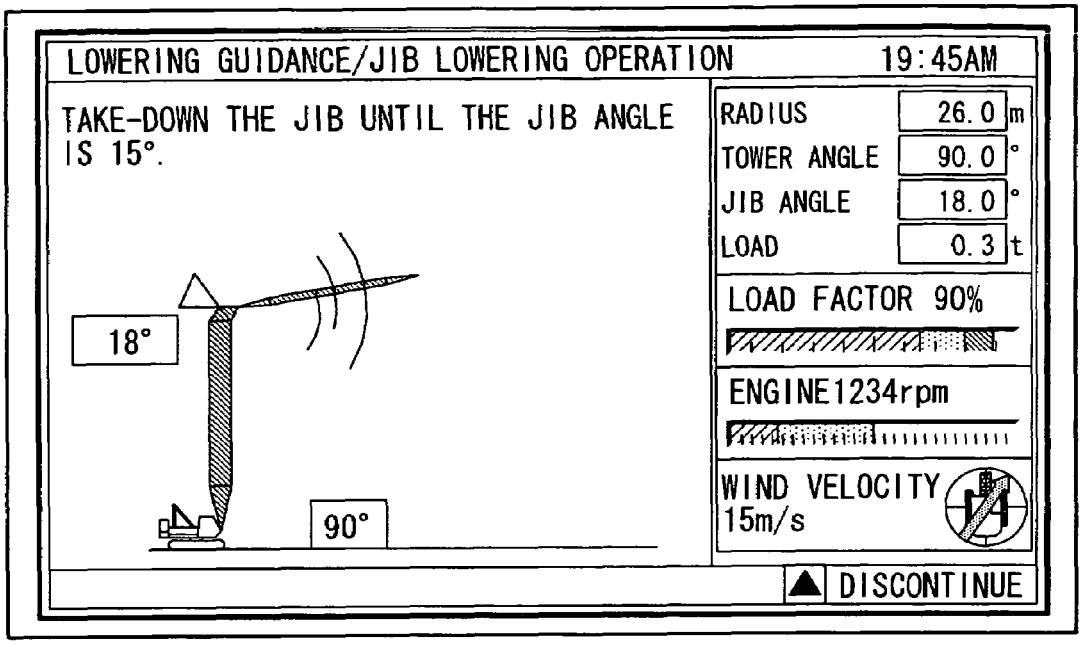

In the jib lowering operation guidance screen shown in FIG. 42, a message "Take down the jib until the jib angle is 15°" is displayed together with an illustration of the tower crane in the main screen. Quantities indicating the tower crane state and the like similar to those in FIG. 41 are displayed in the sub-screen. It is to be noted that the illustration of the tower crane and the jib angle displayed in the main screen change by reflecting the progress of the take-down operation of the jib 3.

Figure 43:
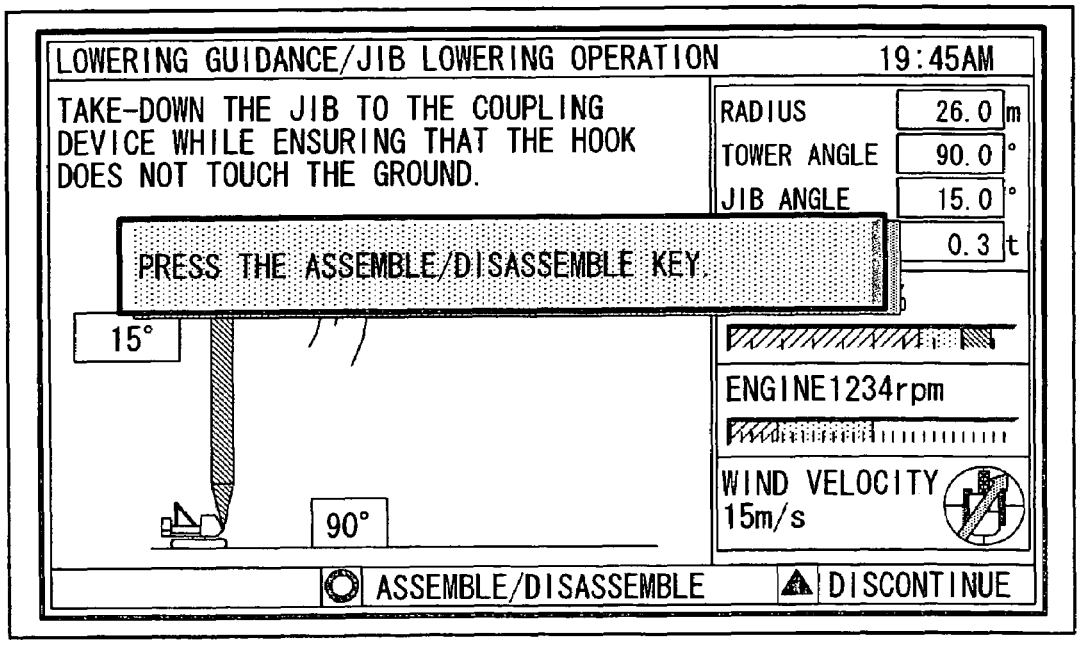

As the jib 3 is taken down to achieve a jib angle of 15°, the display at the display unit 30 is switched to the display screen shown in FIG. 43. In FIG. 43, a message "Press the assemble/disassemble key" is displayed over the entire display screen as a pop-up. As the operator presses the assemble/disassemble key (○ key) 45 at the input device 40 with this screen up on display, the display at the display unit 30 is switched to the display screen shown in FIG. 44.

Figure 44:
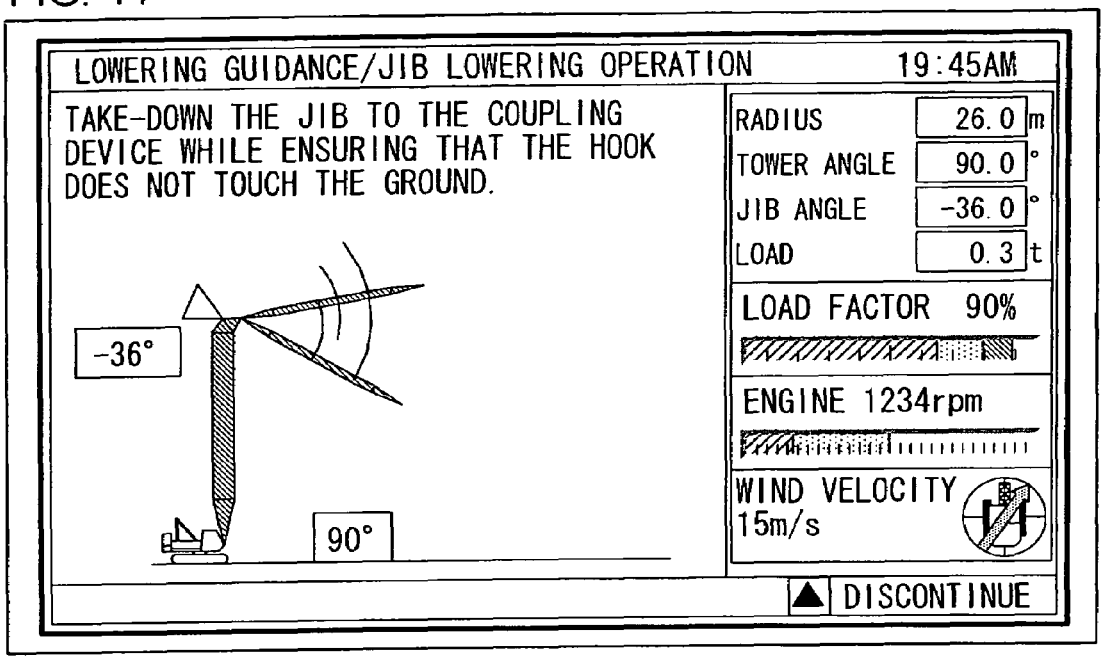

In FIG. 44, a message "Take-down the jib to the coupling device while ensuring that the hook does not touch the ground" is displayed together with an illustration of the tower crane in the main screen. The jib 3 is lowered until it becomes coupled with the tower boom 2 while the operator visually ensures that the hook (not shown) suspended at the front end of the jib 3 does not touch the ground. It is to be noted that the illustration in the main screen shown in FIG. 44 indicates that the jib 3 has been lowered to an angle of −36°. As the jib 3 is further lowered to achieve a jib angle of −90°, the display at the display unit 30 is switched to the display screen shown in FIG. 45.

Figure 45:
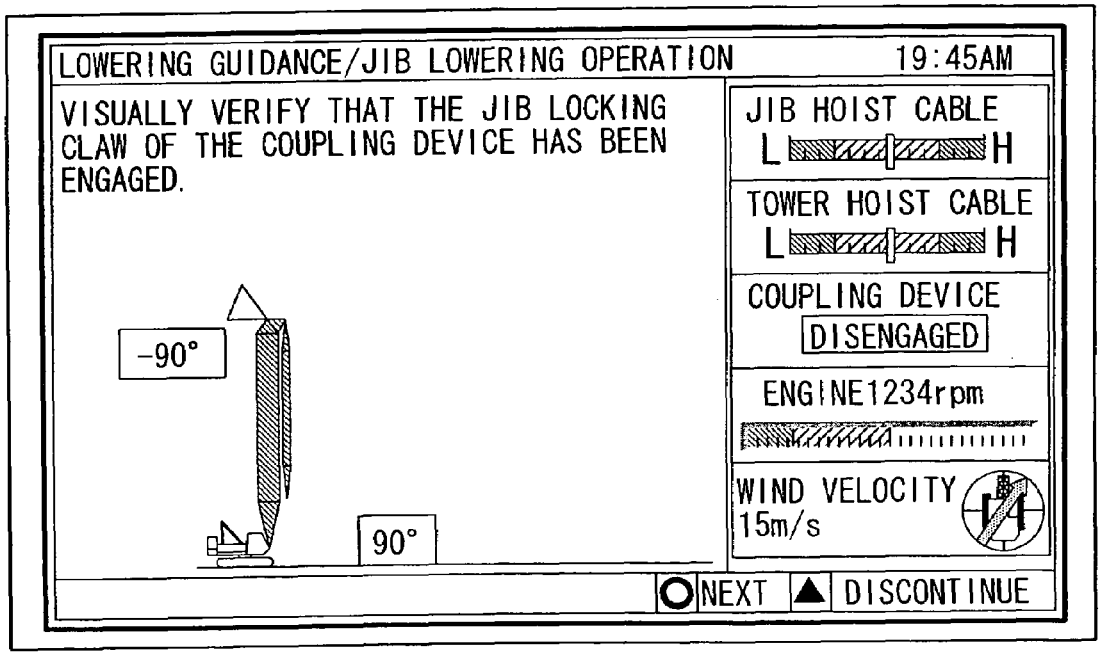

In FIG. 45, a message "Visually verify that the jib locking claw of the coupling device has been engaged" is displayed together with an illustration of the tower crane indicating the jib angle of −90° in the main screen. At this time, the extents of changes in the tensions of the jib hoist cable 11 and the boom hoist cable 5, the state of the coupling device 13, the engine rotational speed, the wind velocity, the wind direction and the like, instead of the working radius, the tower angle, the jib angle and the load, are displayed in the sub-screen. Before the jib locking claw 13*c* at the coupling device 13 is engaged, "coupling device disengaged" is displayed in the sub-screen. After visually verifying that the jib locking claw 13*c* has been engaged, the operator selects the "next" key (○ key 45).

Figure 46:
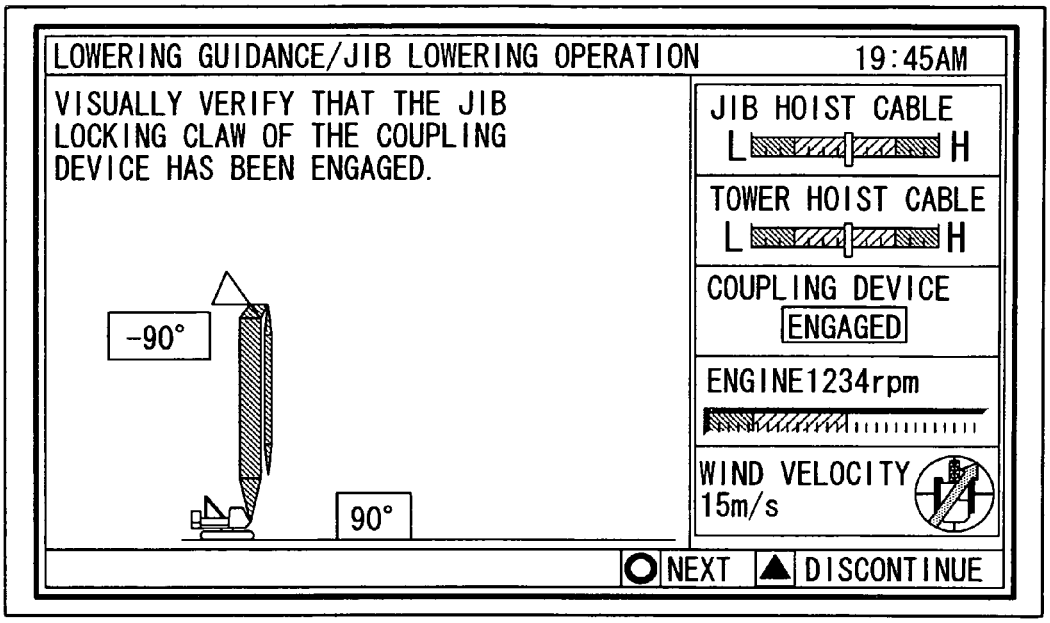

In response to the operation of the "next" key 45, the display is switched to the display screen shown in FIG. 46. If the jib locking claw 13*c* has been engaged, "coupling device engaged" is displayed in the sub-screen shown in FIG. 46. With this, the jib lowering operation guidance ends. Subsequently, if the tower boom 2 is to be lowered, the operator selects the "next" key (○ key 45) displayed in the display screen shown in FIG. 46 to move forward to bring up the display screen of the tower lowering operation procedure shown in FIG. 47.

H: Tower Lowering Operation (Lowering Guidance)

Figure 47:
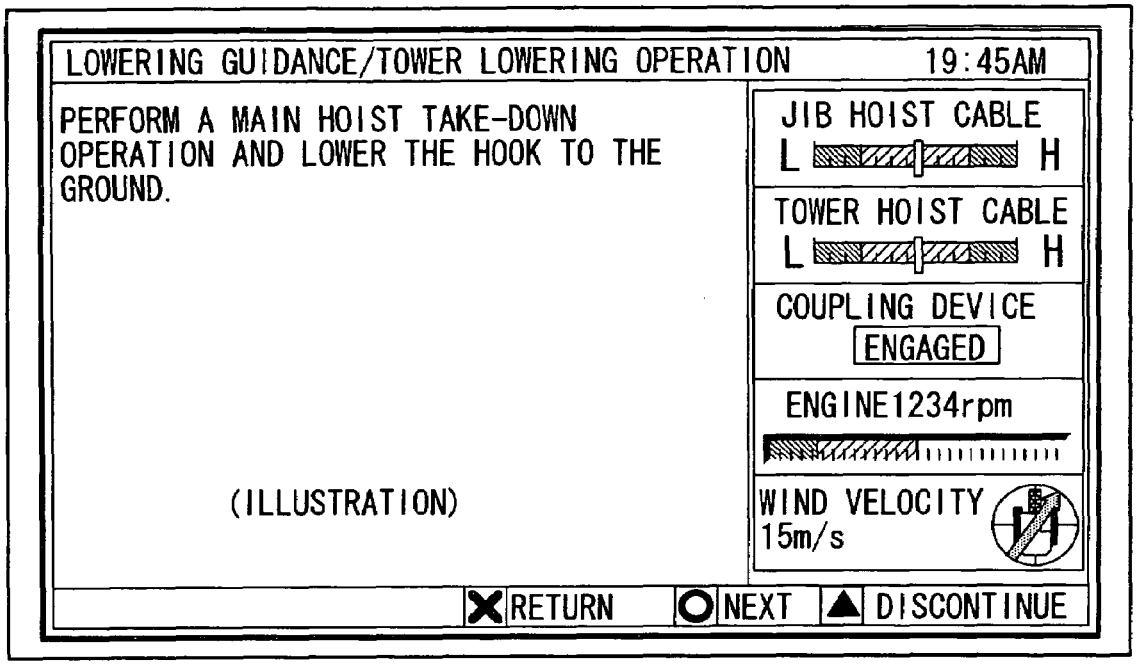

In the tower lowering operation guidance screen shown in FIG. 47, a message "Performa main hoist take-down operation and lower the hook to the ground" is displayed together with an illustration in the main screen. State quantities and the like similar to those in FIG. 46 are displayed in the sub-screen. The operator performs a take-down operation of the hook hoist winch 15 by following the instructions in the guidance on display and then selects the "next" key (○ key 45) after the hook (not shown) is set on the ground. In response to the operation of the "next" key 45, the display at the display unit 30 is switched to the display screen shown in FIG. 48.

Figure 48:
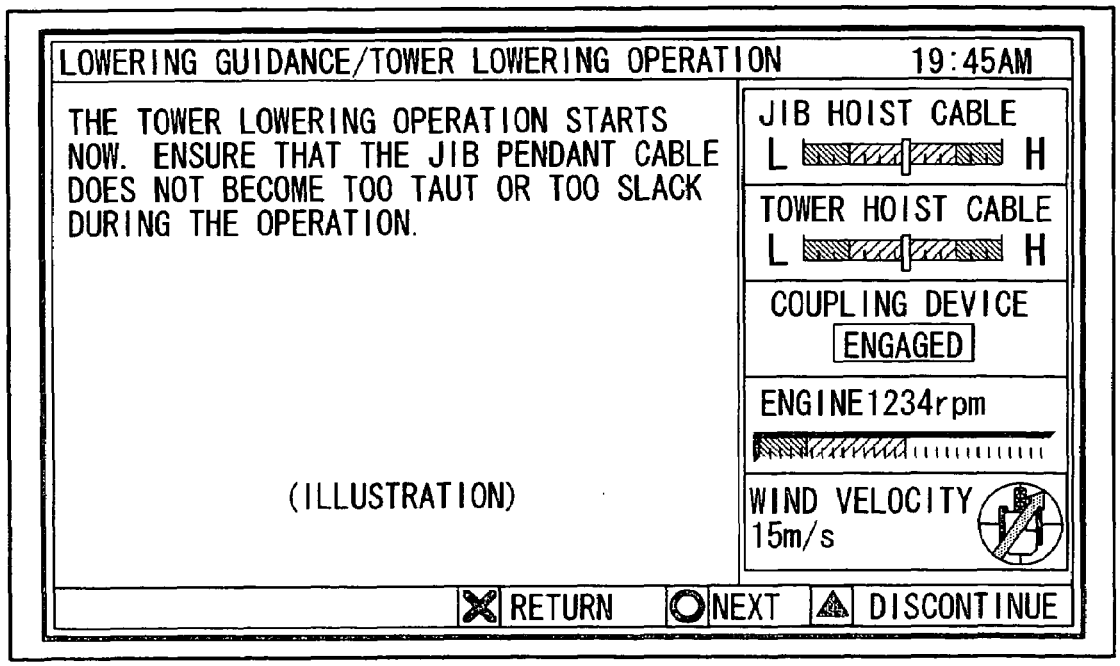

In FIG. 48, the following message is displayed together with an illustration in the main screen; "The tower lowering operation starts now. Ensure that the jib pendant cable does not become too taut or too slack during the operation". The operator having checked the message selects the "next" key (○ key 45) in the lower portion of the display screen to start the tower lowering operation. In response to the operation of the "next" key 45, the display is switched to the display screen shown in FIG. 49.

Figure 49:
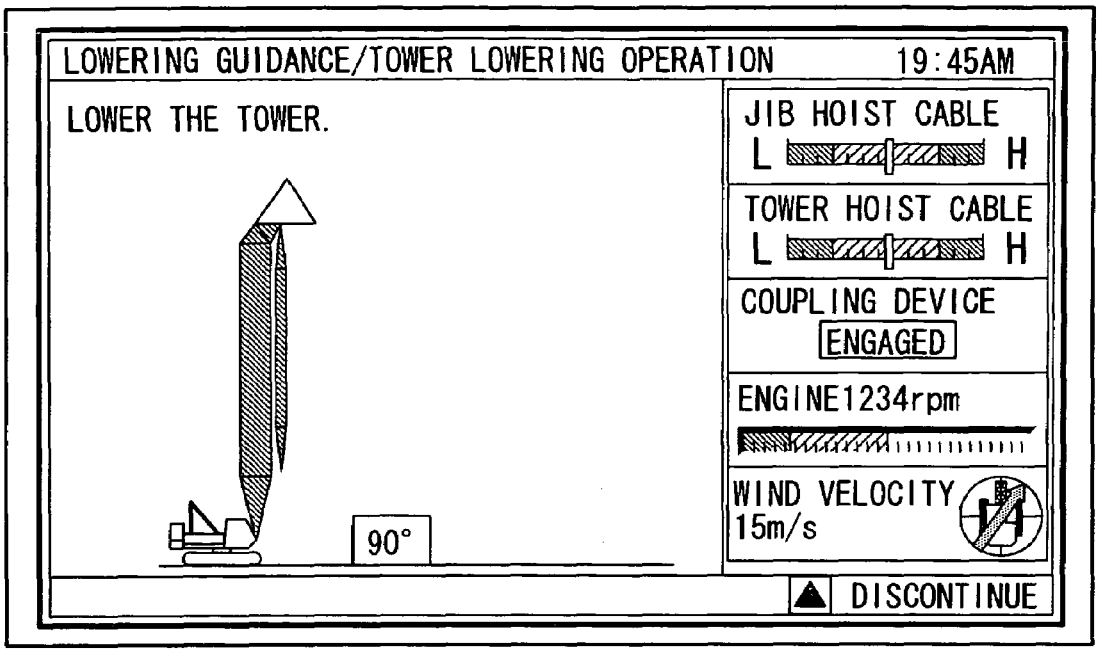

In FIG. 49, a message "Lower the tower" is displayed together with an illustration of the tower crane indicating the tower angle in the main screen. The operator performs a take-down operation with the tower hoist operating lever to lower the tower boom 2 while checking for any changes in the cable tensions displayed in the sub-screen. At this time, the operator operates the jib hoist operating lever as appropriate so as to maintain the tension of the lib pendant cable 8 at the normal level. It is to be noted that the illustration in the main screen changes to reflect the progress in the lowering operation of the tower boom 2. As the tower boom 2 is lowered to achieve a predetermined tower angle of, for instance, 70°, the display is switched to the display screen shown in FIG. 50.

Figure 50:
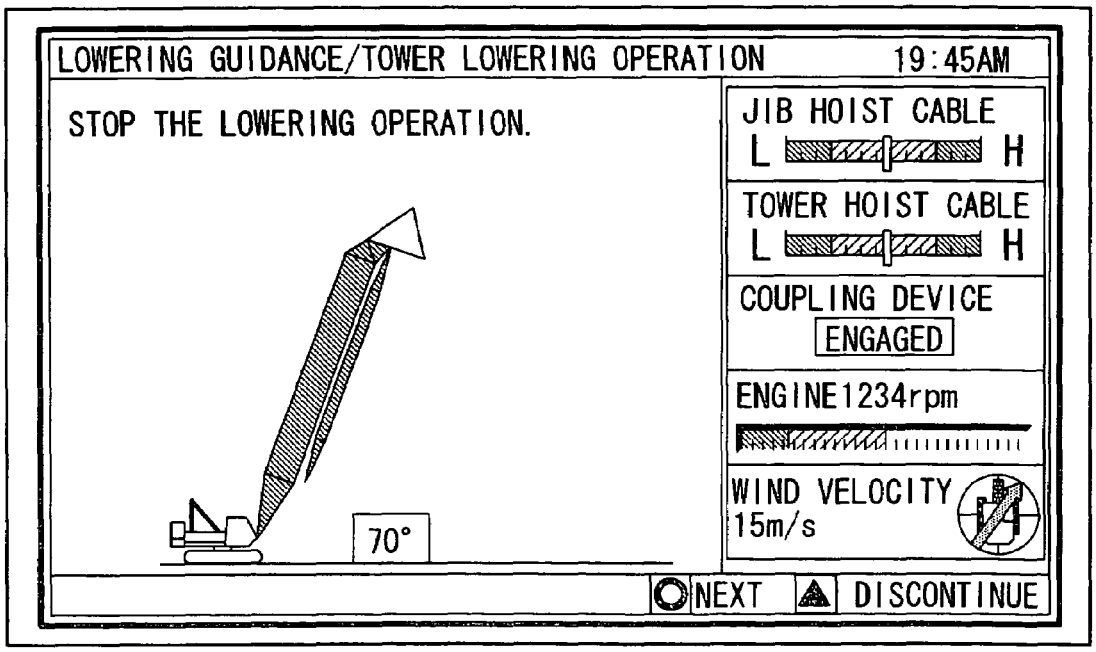

In FIG. 50, a message "Stop the tower lowering operation" is displayed together with an illustration of the tower crane indicating the tower angle of 70° in the main screen. As the operator stops the lowering operation of the tower boom 2 in response to the message and selects the "next" key (○ key 45), the display is switched to the display screen shown in FIG. 51.

Figure 51:
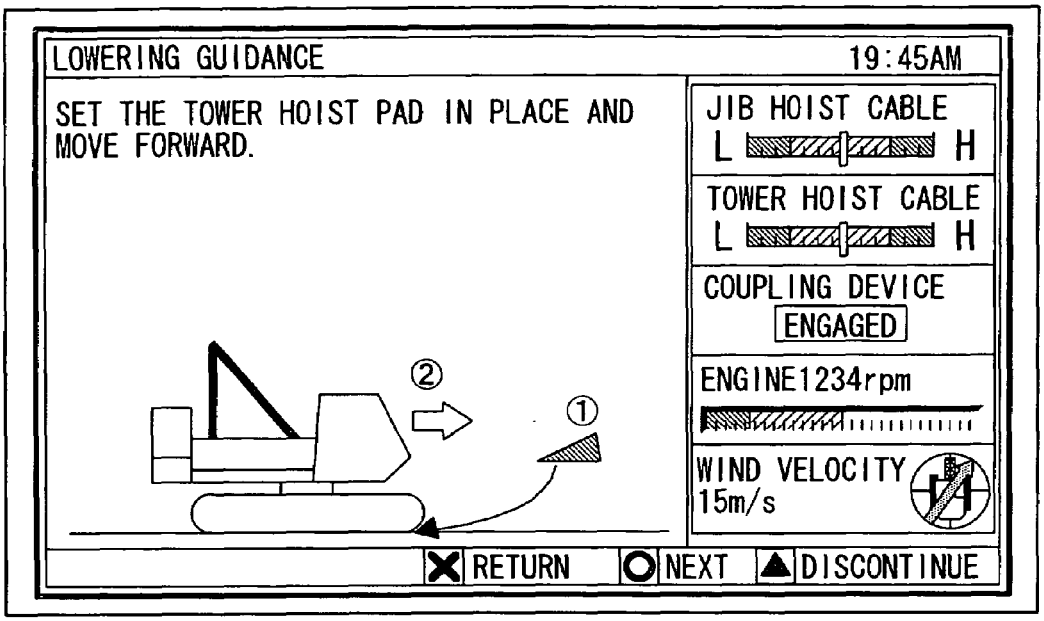

In FIG. 51, a message "Set the tower hoist pad in place and move forward" is displayed together with an illustration of the crane main body 1 in the main screen. In response to the message, the operator (1) places the tower hoist pad in front of the crane main body 1 and (2) drives the crane main body 1 forward so as to set the crane main body 1 on the tower hoist pad. As the crane main body 1 is positioned on the tower lower pad and the operator selects the "next" key (○ key 45), the display is switched to the display screen shown in FIG. 52.

Figure 52:
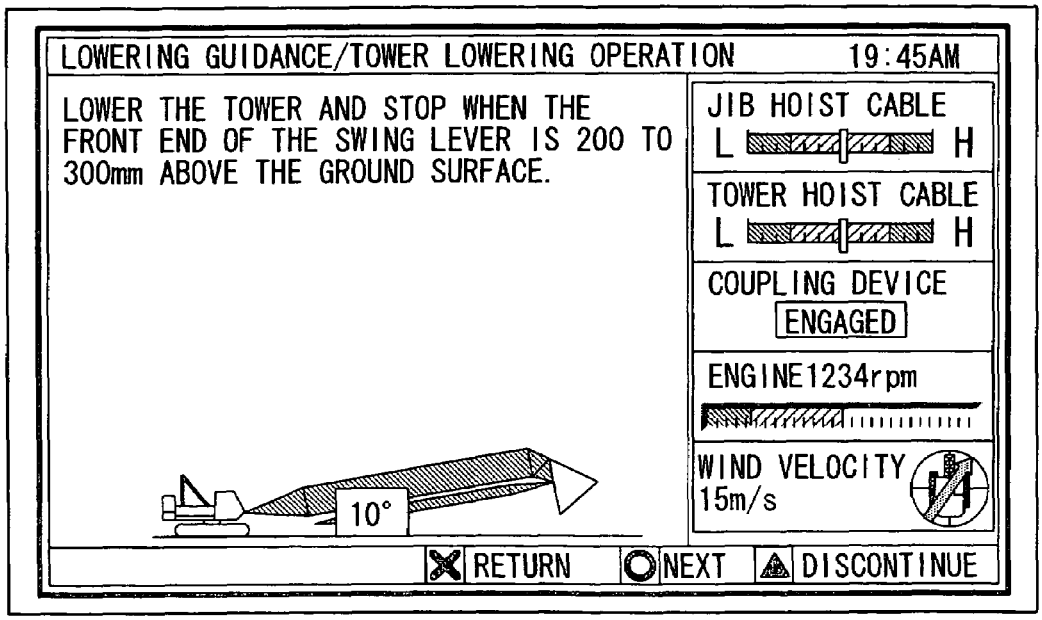

In FIG. 52, the following message is displayed together with an illustration of the tower crane in the main screen; "Lower the tower and stop when the front end of the swing lever is 200 to 300 mm above the ground surface". It is to be noted that the illustration shows the tower boom 2 having been lowered to achieve a tower angle of 10°. The operator stops lowering the tower boom 2 when the front end of the swing lever 7 is lowered to a point 200 to 300 mm above the ground surface by following the instructions in the message, and then selects the "next" key (○ key 45). In response to the operation of the "next" key 45, the display is switched to the display screen shown in FIG. 53. It is to be noted that the assistant operator or the like on the ground ascertains the distance between the front end of the swing lever 7 and the ground surface.

Figure 53:
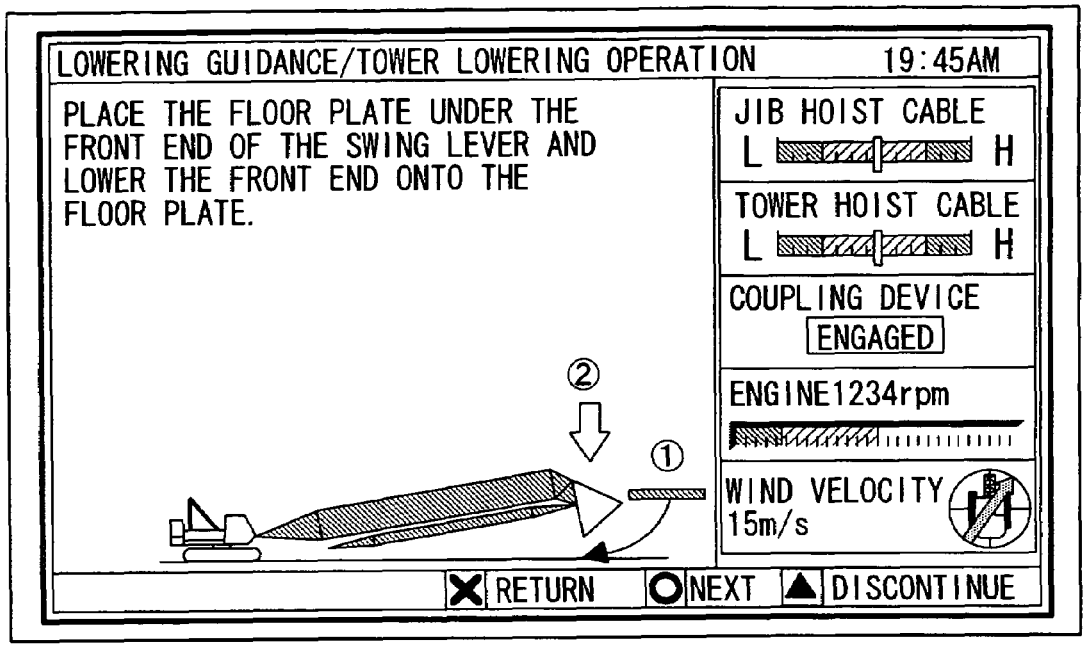

In FIG. 53, a message "Place the floor plate under the front end of the swing lever and lower the front end onto the floor plate" is displayed together with a tower crane illustration in the main screen. By following the instructions in the message, the operator (1) positions the floor plate under the front end of the swing lever 7 and (2) lowers the tower boom 2 so as to set the front end of the swing lever 7 onto the floor plate. As the front end of the swing lever 7 is lowered onto the floor plate and the operator selects the "next" key (○ key 45), the display is switched to the display screen shown in FIG. 54.

Figure 54:
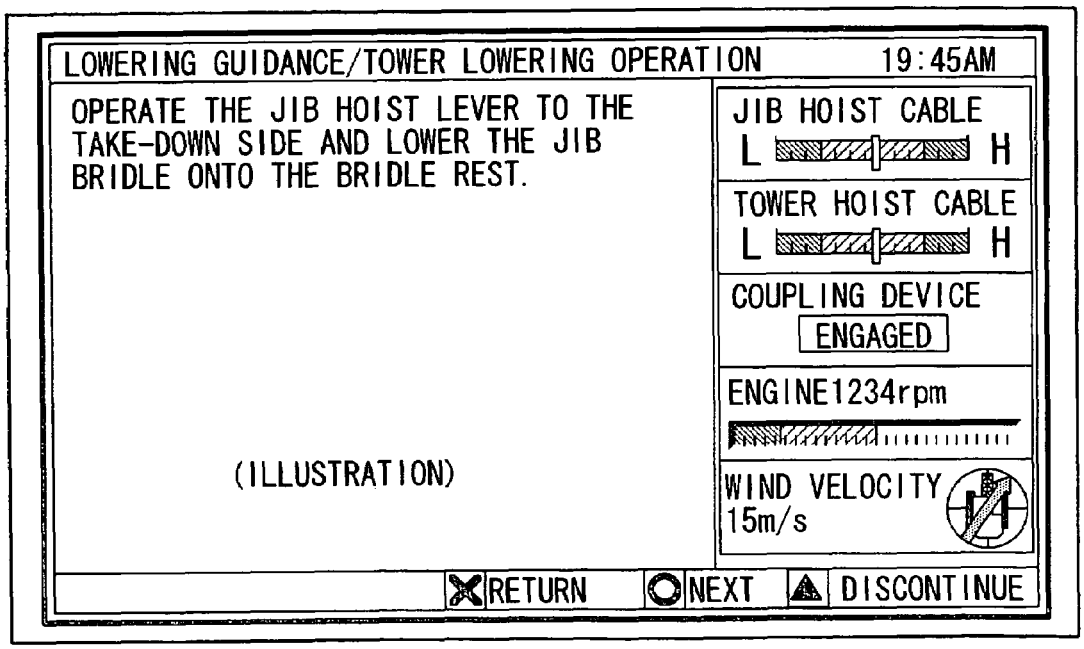

In FIG. 54, a message "Operate the jib hoist lever to the take-down side and lower the jib bridle onto the bridle rest" is displayed together with an illustration in the main screen. The operator drives the jib hoist winch 10 to take it down by operating the jib hoist operating lever and lowers the bridle device 12 onto a bridle rest (not shown). Then, the operator selects the "next" key (○ key 45). In response to the operation of the "next" key 45, the display is switched to the display screen shown in FIG. 55.

Figure 55:
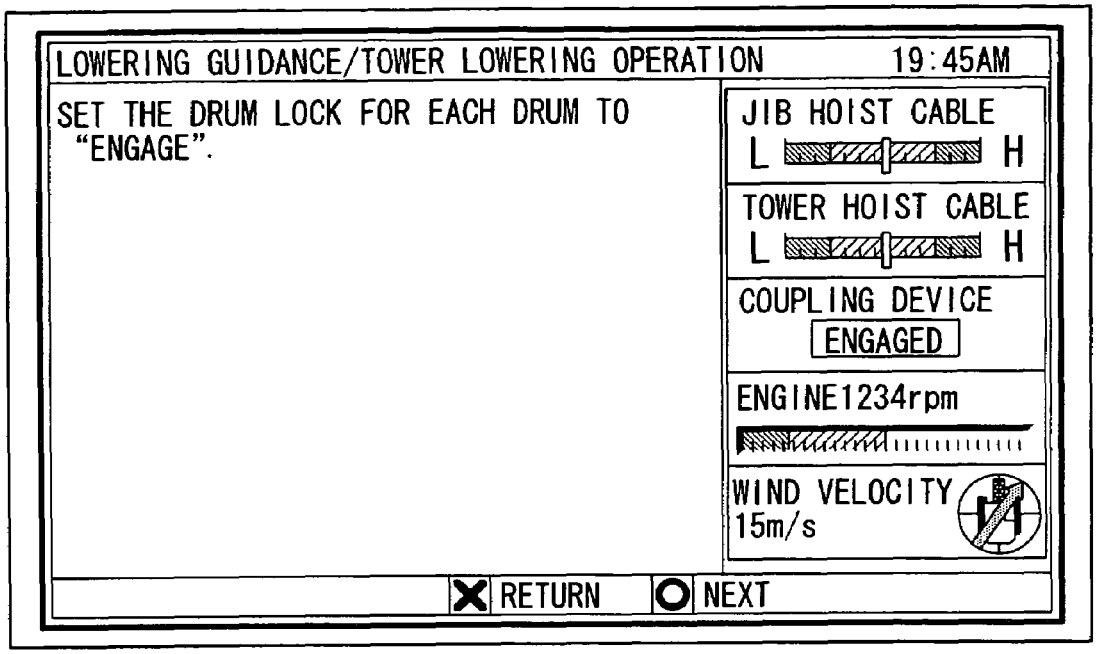

In FIG. 55, a message "Set the drum lock for each drum to "engage" is displayed in the main screen. As the drum lock device of each winch drum is set in a locked state and the operator selects the "next" key (○ key 45), the display is switched to the display screen shown in FIG. 56.

In FIG. 56, the following message is displayed in the main screen; "The lowering guidance has been completed. Thank you. Turn off the power and connect the shorting plug before disassembly. Press the guidance key to perform the raising operations". With the display screen shown in FIG. 56 brought upon display at the display unit 30, the sequence of the lowering operation guidance ends. If the operator operates the guidance key (□ key) 48 at the input device 40 while the screen in FIG. 56 is on display, the raising guidance menu screen in FIG. 5 is brought up on display.

It is to be noted that each time the tension level of either cable becomes abnormal while performing the lowering operations by following the instructions provided in the lowering operation guidance, a warning screen such as that shown in FIG. 23 is brought up on display to warn the operator. In addition, the setup operations such as the raising operations and the lowering operations explained above are normally performed while the engine is rotating at low speed and, accordingly, a warning screen may be brought up on display if the engine rotational speed exceeds a predetermined rotational speed. Furthermore, if a cable tension becomes abnormal, or if the engine rotational speed becomes excessively high, the operator may be warned with an audio message as well as a text message. The alarm output when an overwind preventing device is activated may be provided in the form of an audio message in addition to the buzzer and the bell.

The operator selects a discontinue key (Δ key) displayed in the lower portion of the display screen to halt an operation currently in progress in conformance to the operating procedure guidance displayed in any of FIGS. 5 to 56, as detailed above. If the Δ key 47 at the input device 40 is operated in a given display screen, the display is switched to the moment limiter screen shown in FIG. 34. The number assigned to the display screen in which the discontinue key (Δ key) 47 is operated is stored into the EEPROM 21 of the controller 20, and the guidance screen on display immediately before switching to the moment limiter screen is brought up on display again if the operator selects the guidance key (□ key) 48 in the moment limiter screen in FIG. 34. In addition, if a setup operation in progress with the corresponding setup guidance on display in the display screen is halted and the power is turned off or if the power is cut off due to a temporary disconnection or the like, the number assigned to the screen on display when the power went off is stored into the EEPROM 21 of the controller 20. As a result, when the setup operation is resumed by turning on the power again, the setup guidance having been on display before the power went off is brought up on display to allow the setup operation to be resumed from that point on.

FIGS. 59A-59C present a list of the contents of display screens corresponding to various operating states, which are displayed at the display unit 30 of the operation assist apparatus in the embodiment. FIGS. 59A-59C, crucial display contents that must be displayed at the display unit 30 are marked with ◎, whereas display contents simply recommended to be displayed at the display unit 30 are marked with ○.

As shown in 59A-59C the screens brought up on display at the display unit 30 are grouped into the raising guidance screens, the work range screens and the lowering guidance screens. The raising guidance screens are further divided into A) pre-raise guidance screens, B) tower raising guidance screens and C) jib raising guidance screens. The lowering guidance screens, on the other hand, are divided into F) tower raising guidance screens, G) jib lowering guidance screens and H) tower lowering guidance screens. The following is an explanation of the display contents displayed at the display unit 30 in the individual screens.

A: Pre-Raise Guidance

During the pre-raise inspection (A1), details of the inspection such as the main body inspection are displayed in the main screen as shown in FIGS. 6 to 9 explained earlier. The information indicating whether or not the jib hoist cable tension is too low or too high is displayed together with the information indicating the engaged/released state of the coupling device in the sub-screen. In addition, instructions prompting the operator to verify that the clutch hose is connected to the tower side, that the brake mode selection key is set at the lock position and that the automatic brake of the auxiliary hoist brake mode selector switch is on may be displayed in the sub-screen. By doing this, the brake mode selector key is sustained at a locked position and the auxiliary hoist brake mode selector switch is sustained in an ON state so that the jib is not allowed to fall down even if the clutch hose is connected to the crane side.

When inspecting the operations of the individual overwind preventing devices (A2), the instructions for inspecting the hook overwind preventing device, the overload preventing device and the like are displayed in the main screen, as shown in FIGS. 10 to 16. In those screens, a captured image of an area around a limit switch for overwind detection and the like may be displayed in the sub-screen to show the operating state of the corresponding overwind preventing device or overload preventing device.

B: Tower Raising Guidance

During the lift-off/raising operation (B1), the real-time posture and the real-time operating direction of the tower crane are displayed in the main screen, as shown in FIGS. 18 to 20, together with an instruction to set the engine rotational speed to low. In addition, the rotating state of a winch drum may also be displayed. At this time, the information indicating whether or not the tower hoist cable tension is too low or in an abnormal state may also be displayed in the sub-screen together with information indicating whether or not the jib hoist cable tension is too low or too high, whether the coupling device is in an engaged state or a released state and the engine rotational speed. It is to be noted that a warning may be displayed if the engine rotational speed exceeds a predetermined value. Instead of displaying the instruction to set the engine rotational speed to low, a warning may be brought up on display if the engine rotational speed is high.

When the tower angle reaches 70° (B2), an instruction to remove the tower hoist pad is displayed in the main screen as explained in reference to FIG. 21. Since the crane main body 1 may tip over if the wind velocity increases while the front end of the tower boom 2 is set at a significant height, the wind velocity and the wind direction are displayed in the sub-screen. A warning may be displayed in the display screen if the wind velocity exceeds a predetermined value.

When the tower boom enters a 90°-overwind state (B3), an image of the area around the limit switch for 90°-overwind detection captured by the camera is displayed in the main screen to allow the operator to check the operating state of the limit switch, as shown in FIG. 26.

C: Jib Raising Guidance

When releasing the coupling device (C1), the instructions for releasing the coupling device 13 are displayed in the main screen, as shown in FIGS. 28 and 29. At this time, information indicating whether the coupling device 13 is in an engaged state or a released state is displayed in the sub-screen.

During the jib raising operation (C2), the real-time posture and the real-time operating direction of the tower crane are displayed in the main screen, as shown in FIG. 30, together with an instruction to set the engine rotational speed to low. In addition, the rotating state of a winch drum may also be displayed. Information indicating whether or not the jib hoist cable tension is too low or too high, whether or not the boom hoist cable tension is too low or in an abnormal state, the engine rotational speed, the wind velocity and the wind direction is displayed in the sub-screen.

D: Work Range

When inspecting the operations of the individual overwind preventing devices (D1), the instructions for inspecting the hook overwind preventing device, the overload preventing device and the like are displayed in the main screen, as shown in FIGS. 32 and 33. In those screens, the operating state of an overwind preventing device or the overload preventing device may be displayed in the sub-screen.

During the crane work (D2), a moment limiter screen or the rotating state of a winch drum is displayed in the main screen, as shown in FIGS. 34 to 36. An image of the rear side of the crane main body or an image of a winch drum, captured by the camera, may also be displayed. In the sub-screen, the load factor calculated by the moment limiter, the engine rotational speed, the wind velocity and the wind direction are displayed.

F: Tower Raising Guidance

During the tower raising operation (F1), the real-time posture and the real-time operating direction of the tower crane are displayed in the main screen, as shown in FIGS. 37 to 39, together with an instruction to set the engine rotational speed to low. In addition, the rotating state of a winch drum may also be displayed. Information indicating whether or not the tower hoist cable tension is too low or in an abnormal state, the wind velocity and the wind direction is displayed in the sub-screen. The engine rotational speed may also be indicated.

When the tower boom enters a 90°-overwind state (F2), an image of the area around the limit switch for 90°-overwind detection captured by the camera is displayed in the main screen, as shown in FIG. 40.

G: Jib Lowering Guidance

During the jib lowering operation (G1), the real-time posture and the real-time operating direction of the tower crane are displayed in the main screen, as shown in FIG. 42, together with an instruction to set the engine rotational speed to low. The rotating state of a winch drum may also be displayed. Information indicating whether or not the jib hoist cable tension is too low or too high, the engine rotational speed, the wind velocity and the wind direction is displayed in the sub-screen.

When adjusting the hook height (G2), while instructions with regard to the hook height is displayed in the main screen to prompt the operator to ensure that the hook is not set on the ground, as shown in FIG. 44 explained earlier.

When engaging the coupling device (G3), the instructions are displayed in the main screen to prompt the operator to verify that the coupling device 13 has been engaged, as shown in FIGS. 45 and 46. Information indicating whether the coupling device 13 is in an engaged state or a released state is displayed in the sub-screen.

H: Tower Lowering Guidance

During the tower lowering operation (H1), the real-time posture and the real-time operating direction of the tower crane are displayed in the main screen, as shown in FIGS. 49 and 50, together with an instruction to set the engine rotational speed to low. In addition, the rotating state of a winch drum may also be displayed. Information indicating whether or not the jib hoist cable tension is too low or too high, whether or not the boom hoist cable tension is too low or in an abnormal state, the engine rotational speed, the wind velocity and the wind direction is displayed in the sub-screen.

When the tower angle reaches 70° (H2), an instruction to place the tower hoist pad is displayed in the main screen as explained earlier in reference to FIG. 51.

When setting the hook on the ground (H 3), an instruction to set the hook on the ground is displayed in the main screen, as shown in FIG. 47.

The display screens shown in FIGS. 5 to 56 simply represent an example of display screens that may be brought up on display at the display unit 30 of the operation assist apparatus in the embodiment, and the actual display screens may adopt a different format as long as at least the display contents in the table presented in FIGS. 59A-59C are displayed in correspondence to the individual operating states. In addition, when the operating procedure guidance is provided as a message displayed in the main screen, the same guidance may also be output as an audio message.

The tower angle of the tower boom 2 does not need to be exactly 70° when the instruction to set or remove the tower hoist pad is displayed, as long as the tower angle is close to 70°. In addition, the instruction to set or remove the tower hoist pad may be modified in correspondence to the condition of the front attachment attached to the crane main body 1. For instance, the guidance regarding the tower hoist pad may be omitted when a tower boom 2 with a small tower boom length is raised from the ground or is lowered onto the ground, so that there is no risk of the rear side of the crane main body 1 becoming lifted up by the weight of the tower boom 2.

Figure 61:
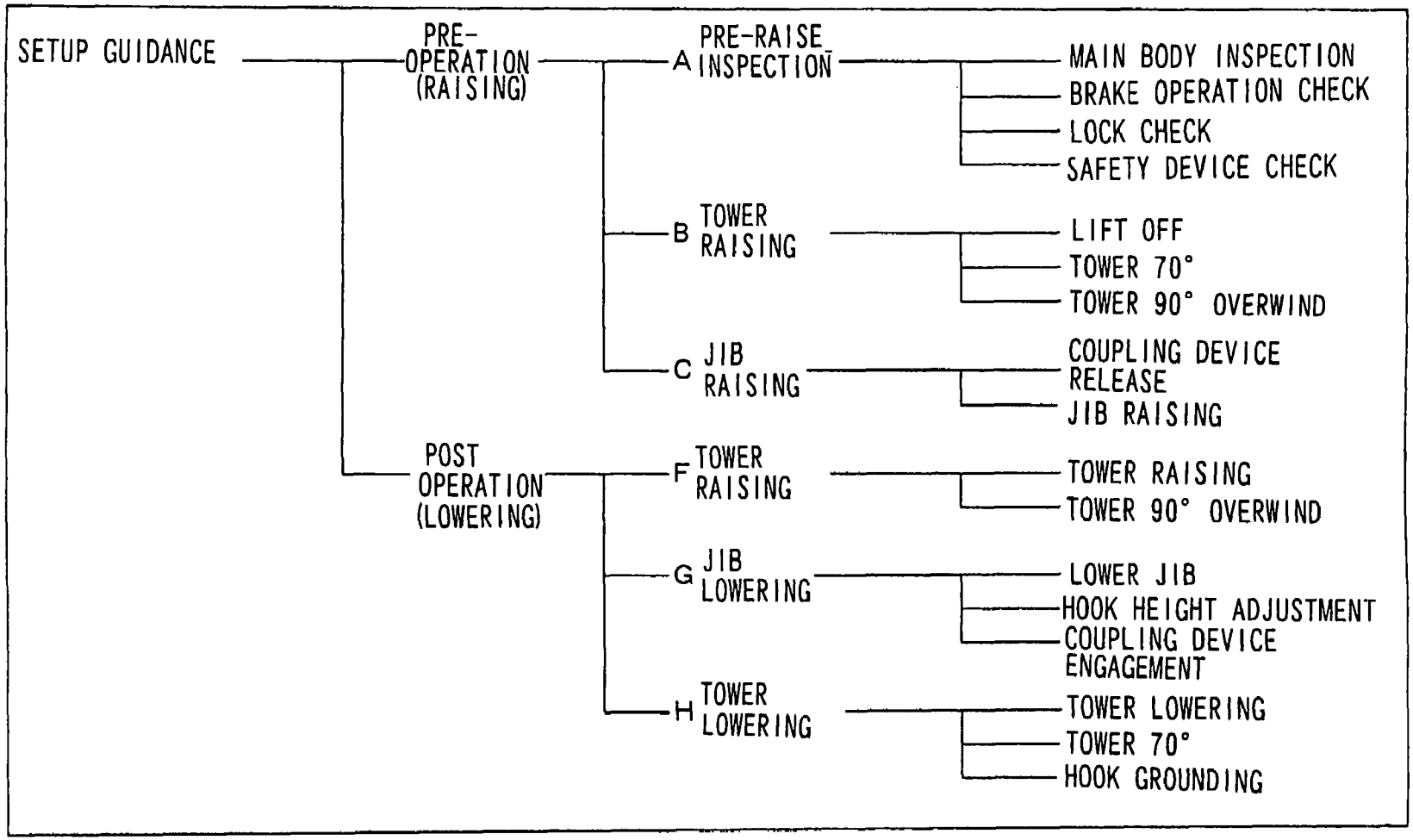
FIG. 61 shows a list of the setup operating procedures displayed in a tree format.

Furthermore, an at-a-glance list of the operating procedures or the operational progress status may be displayed at the display screen of the display unit 30 so as to allow the operator to check the operating procedure of a given setup operation or the operational progress status during the setup operation. FIG. 61 shows a list of the operating procedures of the setup operations presented in a tree format. FIGS. 62 to 65 present examples of the operating procedures and the operational progress statuses that may be displayed at the display unit 30.

Figure 62:
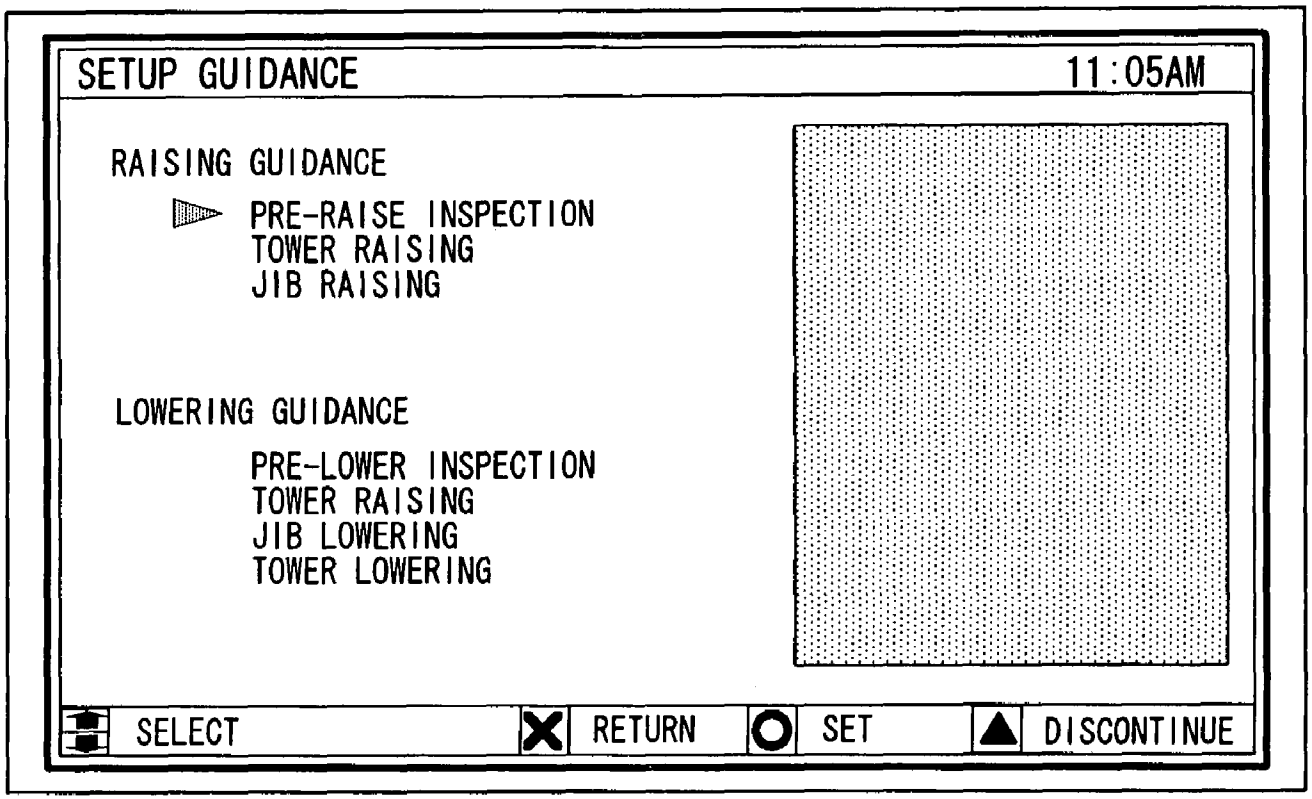
FIGS. 62 to 65 each present an example of a list of the operating procedures that may be displayed at the display unit.
Figure 63:
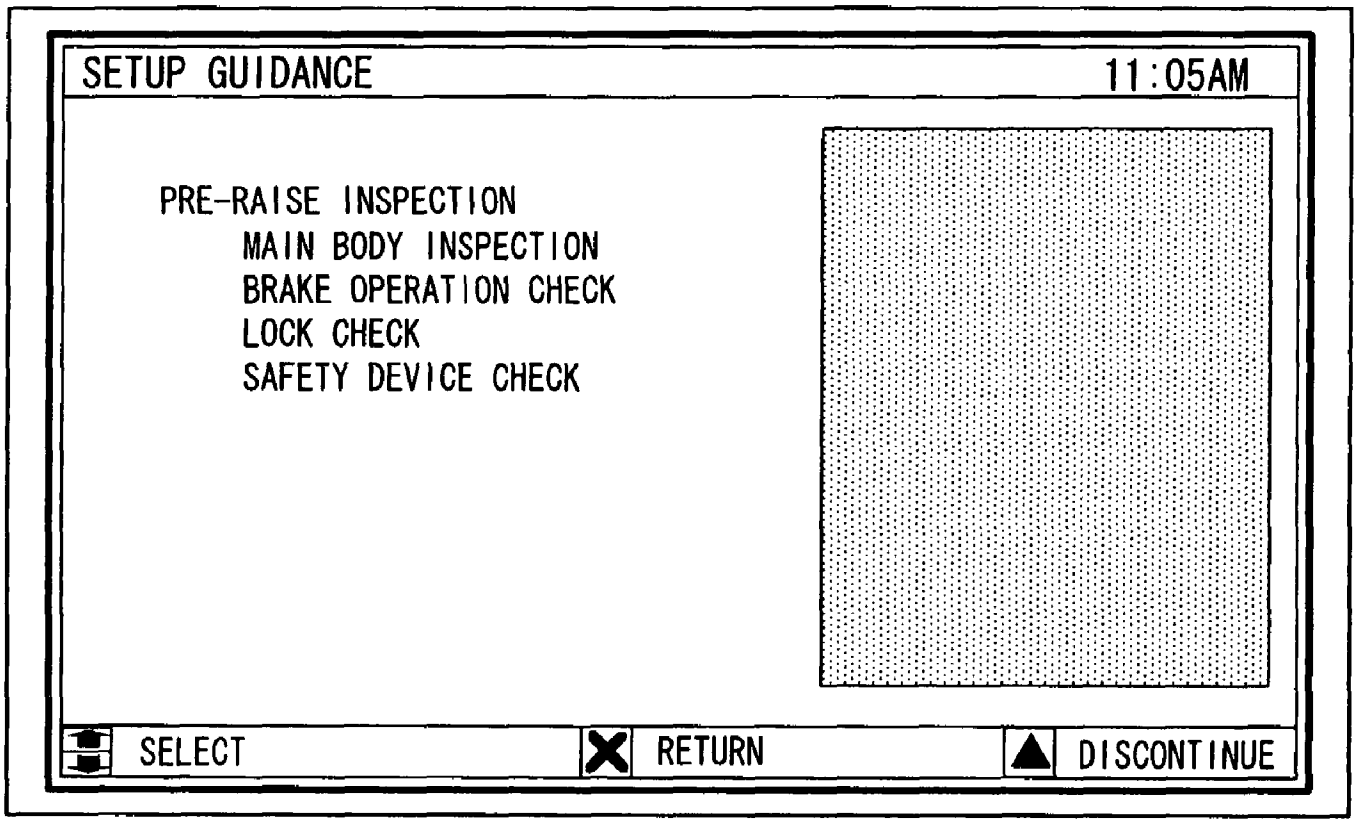

The setup operating procedures displayed in the screen shown in FIG. 62 include the raising guidance and the lowering guidance, with the indicator in the display screen indicating that the pre-raise inspection in the raising guidance is currently selected. As the operator selects the "set" key (○ key) 45 at the input device 40 with the screen in FIG. 62 on display at the display unit 30, the display is switched to the display screen shown in FIG. 63 to show the items to be inspected in the pre-raise inspection. For any of the other operations, e.g., the tower raising operation, the operator selects the "set" key (○ key) in the display screen shown in FIG. 62 to bring up a list of the operation procedural steps on display. The display of such a list assists the operator in confirming the sequence and the flow of the operating procedural steps of a given setup operation.

Figure 64:
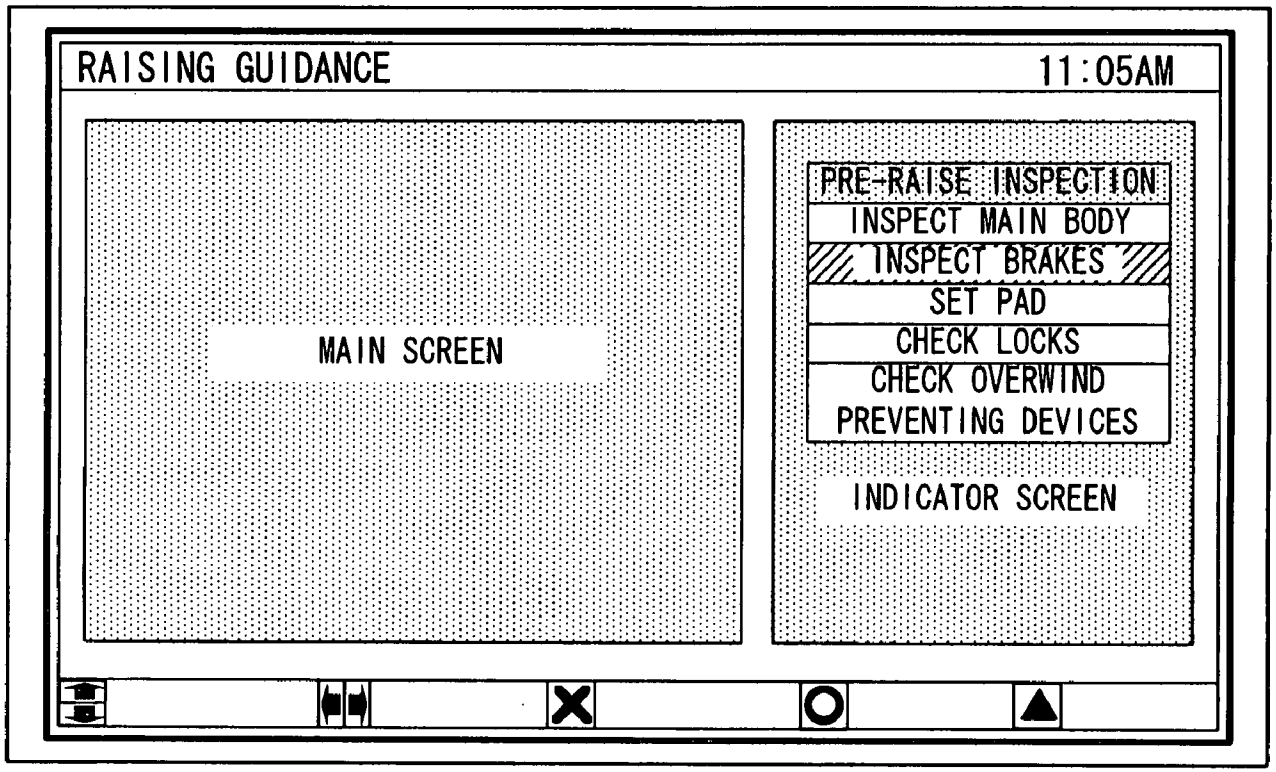
Figure 65:
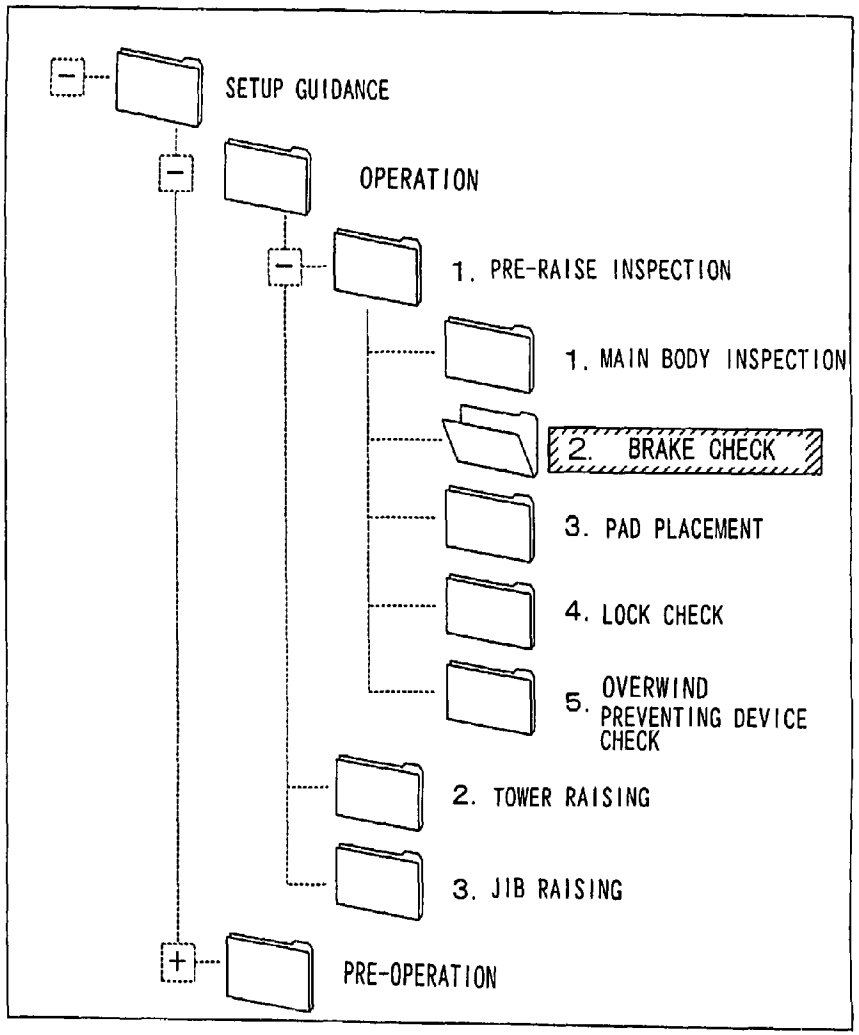

Alternatively, the list of the operation procedural steps of the selected setup operation may be displayed in the sub-screen at the display unit 30 at all times, as shown in FIG. 64. In FIG. 64, the current setup step, e.g., the brake inspection, is lit to help the operator ascertain the current status of progress of the overall setup operation. As a further alternative, the list of the operation procedural steps of the setup operation displayed in the sub-screen in FIG. 64 may be instead displayed in the tree format shown in FIG. 65. Such a display will allow the operator to ascertain with ease the current stage of progress in the overall setup operation.

Variation of the First Embodiment

In the embodiment described above, a list of safety devices and inspection items is displayed at the display unit 30, as shown in FIGS. 32 and 33 as the pre-work inspection guidance, and the specific inspection details corresponding to a given safety device are brought up on display, as shown in FIGS. 12 to 16, when the operator selects the "details" key. Now, another example of pre-work inspection guidance display is explained in reference to drawings.

Figure 66:
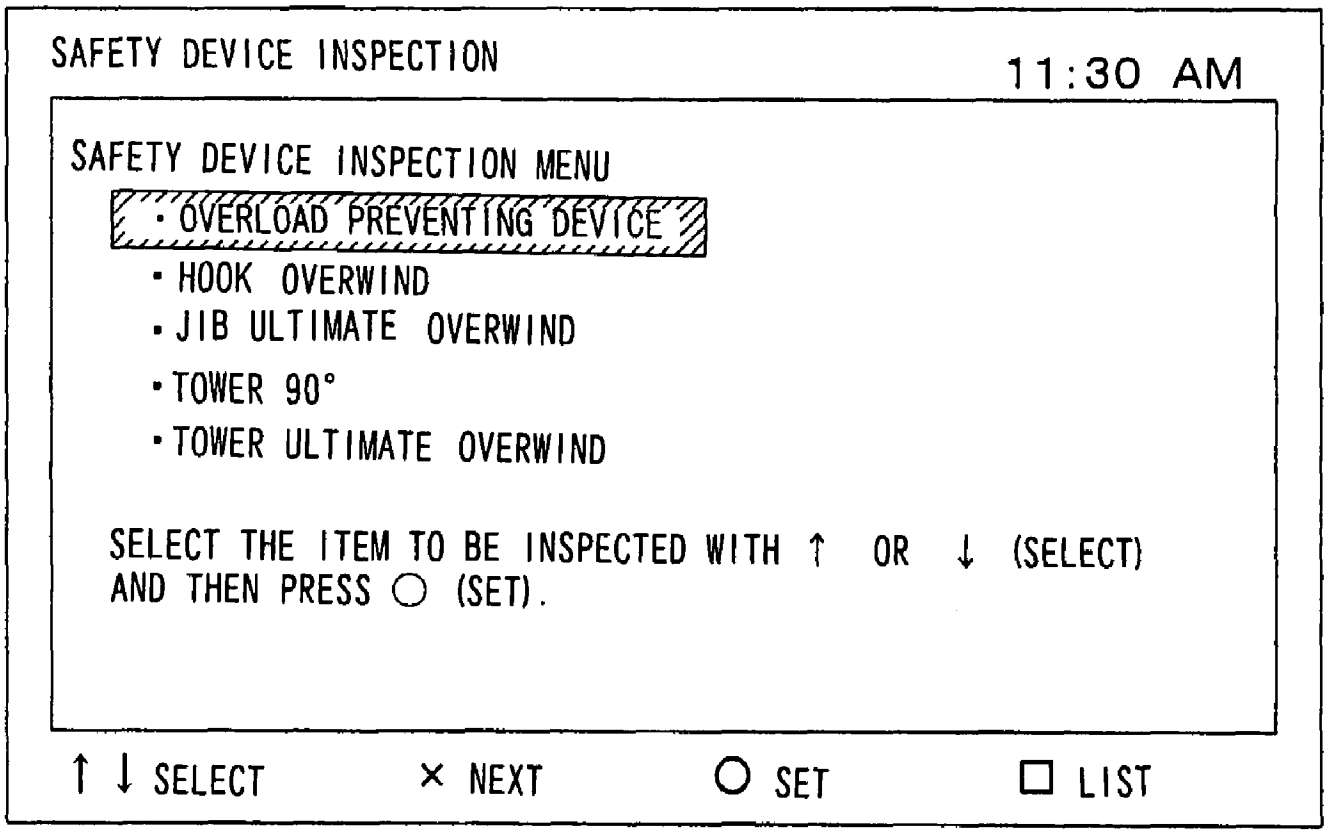
FIGS. 66 to 76 present other examples of operating procedure screens that may be displayed at the display unit.

As the operator selects the "next" key (○ key) 45 while the display screen shown in FIG. 31 is on display at the display unit 30 after the raising guidance is completed, the display is switched to the display screen of pre-work inspection guidance shown in FIG. 66. FIG. 66 shows an inspection menu listing the safety devices, i.e., the overload preventing device, the hook overwind preventing device, the jib ultimate-overwind preventing device, the tower 90°-overwind preventing device and the tower ultimate-overwind preventing device, which is displayed over the entire display screen. If the operator selects the "list" key (□ key 48) displayed in the lower portion of the display screen, the display is switched to a list of inspection items to be checked in correspondence to the individual safety devices, such as that shown in FIG. 32.

As the operator selects a safety device with the "select" key (UP or DOWN arrow key 41 or 43) and operates the "set" key (○ key 45) in the safety device inspection menu screen shown in FIG. 66, detailed inspection operating procedure instructions for the selected safety device are brought up on display at the display unit 30. If "overload prevention" is selected and the ○ key 45 is operated in FIG. 66, the display is switched to the display screen shown in FIG. 67. If, on the other hand, the "next" key (X key) 46 is operated, the display is switched to a moment limiter screen, such as that shown in FIG. 34, without displaying any detailed inspection operating procedure instructions.

Figure 67:
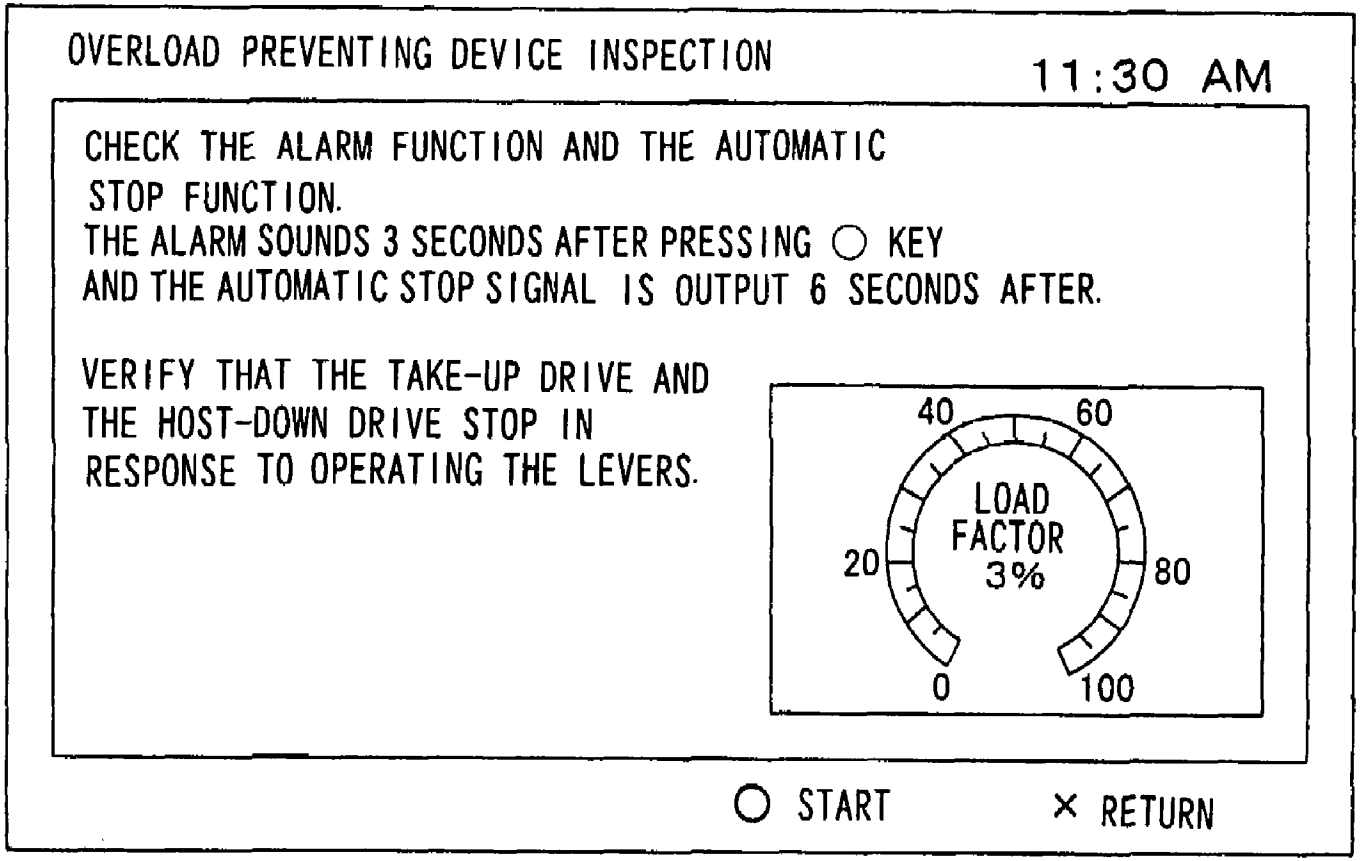

In FIG. 67, the following messages are on display as the inspection operating procedure instructions for the overload preventing device.

Check the alarm function and the auto stop function.

The alarm sounds 3 second after pressing ○ key and an auto stop signal is output 6 seconds after. Verify that the take-up drive and the hoist-down drive stop in response to operating the levers.

In addition, a graph of the load factor is displayed in the display screen. In this example, the graph indicates that the load factor is 3%. As the operator presses the ○ key 45 at the input device 40, the inspection of the overload preventing device starts and the display at the display unit 30 is switched to the display screen shown in FIG. 68. It is to be noted that the display returns to the display screen shown in FIG. 66 in response to an operation of the "return" key (X key) 46.

Figure 68:
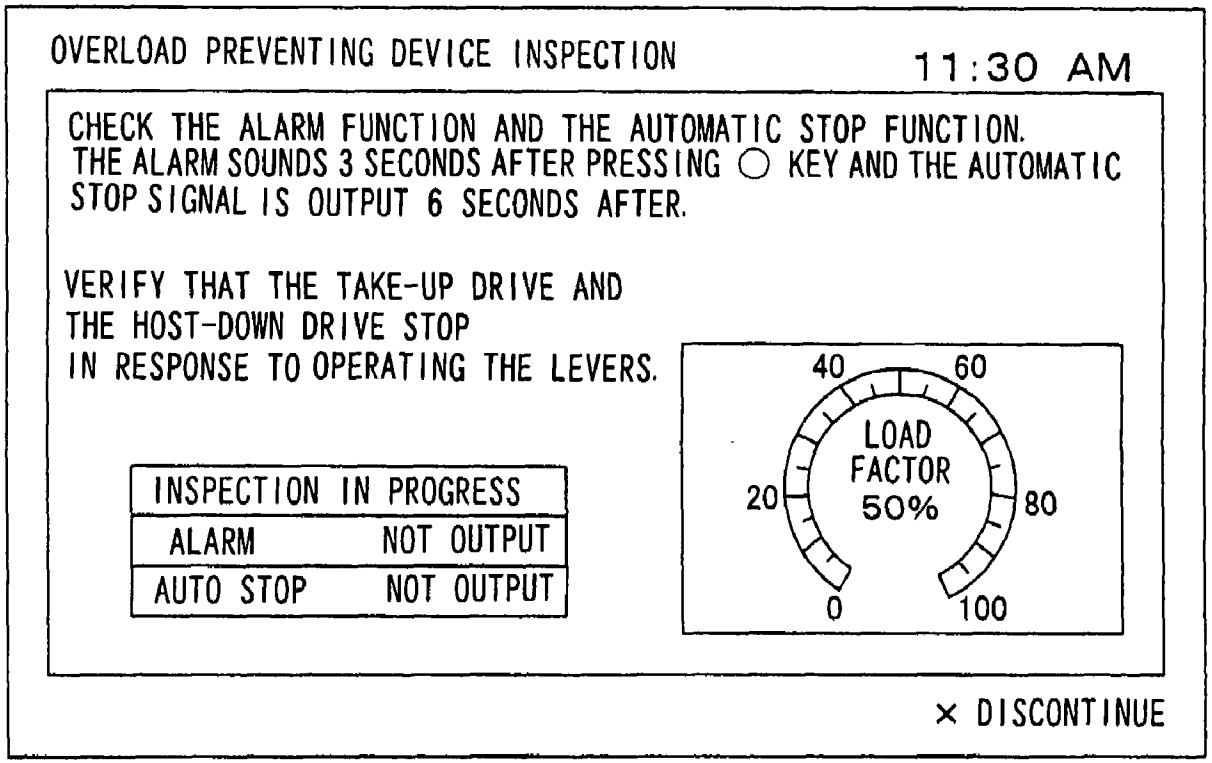

Messages identical to those in FIG. 67 are displayed in the display screen shown in FIG. 68. The graph indicates that the load factor is 50%, and an inspection-in-progress sign indicating that neither the alarm nor the auto stop signal has been output is displayed.

Figure 69:
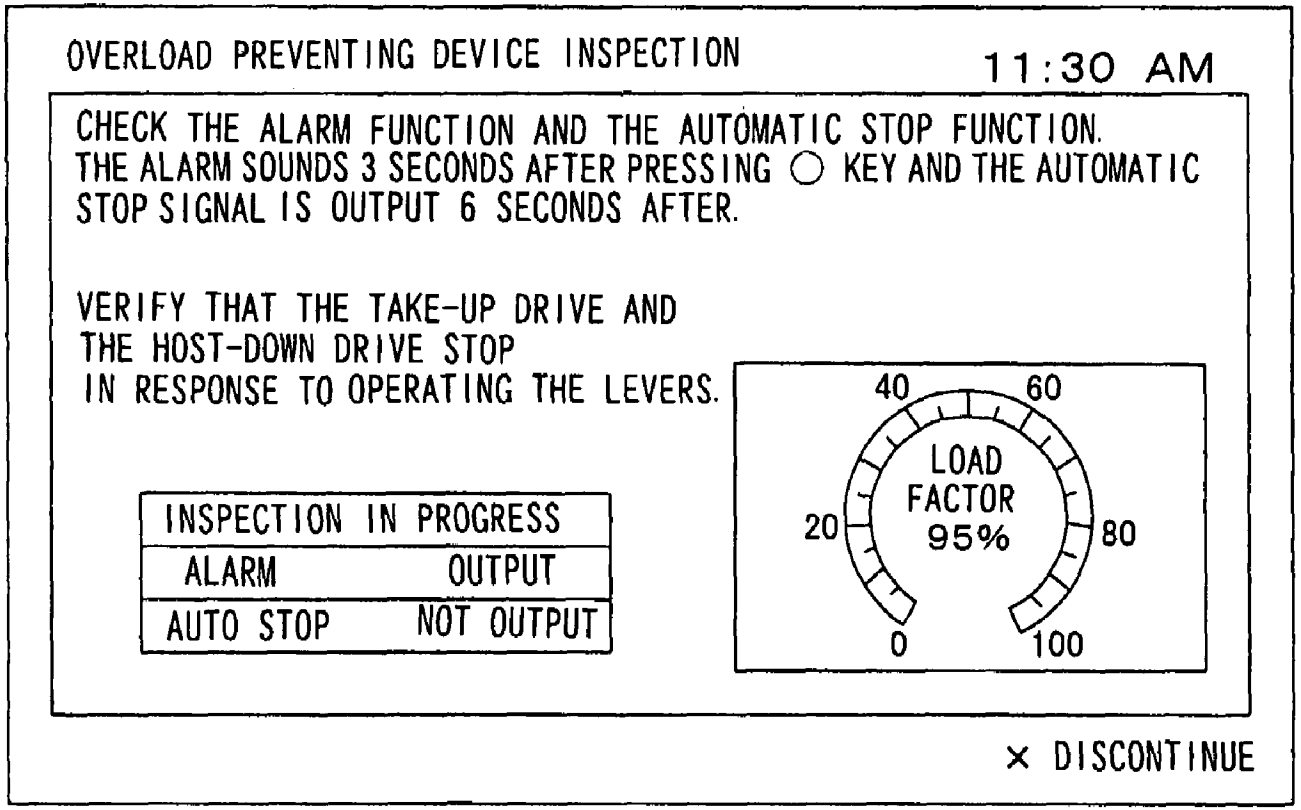

3 seconds after the inspection of the overload preventing device starts, the display is switched to the display screen shown in FIG. 69. The display screen in FIG. 69 indicates that the alarm has been output and that the load factor is 95%. The operator verifies that the alarm is being output for the overload preventing device as indicated in the display.

Figure 70:
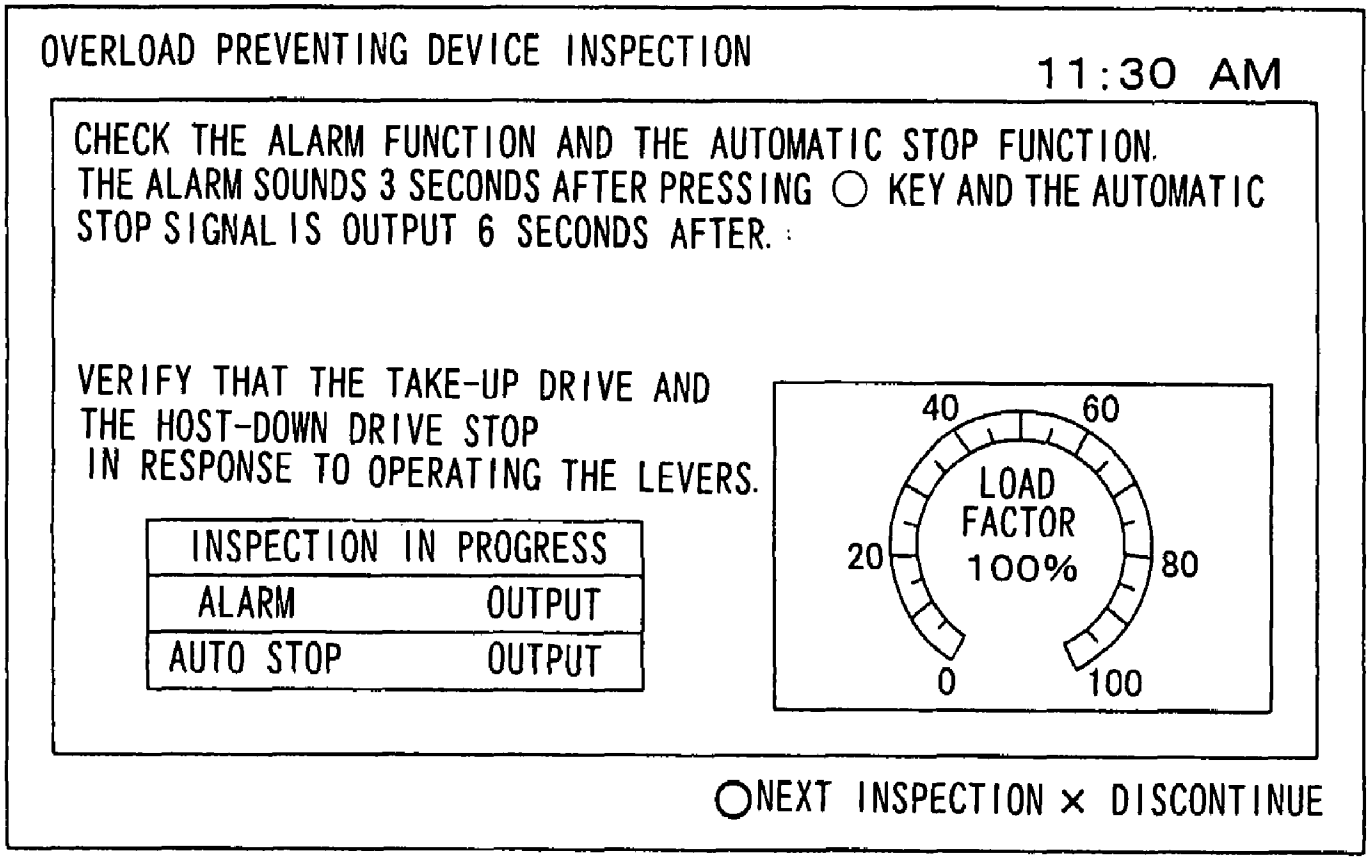

6 seconds after the inspection start, the display is switched to the display screen shown in FIG. 70. The screen display in FIG. 70 indicates that both the alarm and the auto stop signal have been output and that the load factor is 100%. The operator operates the tower hoist operating lever, the jib hoist operating lever and the hook take-up operating lever and verifies that the take-up drive of the hook hoist winch 15, the take-down drive of the tower boom hoist winch 4 and the take-down drive of the jib hoist winch 10 are all stopped.

Figure 71:
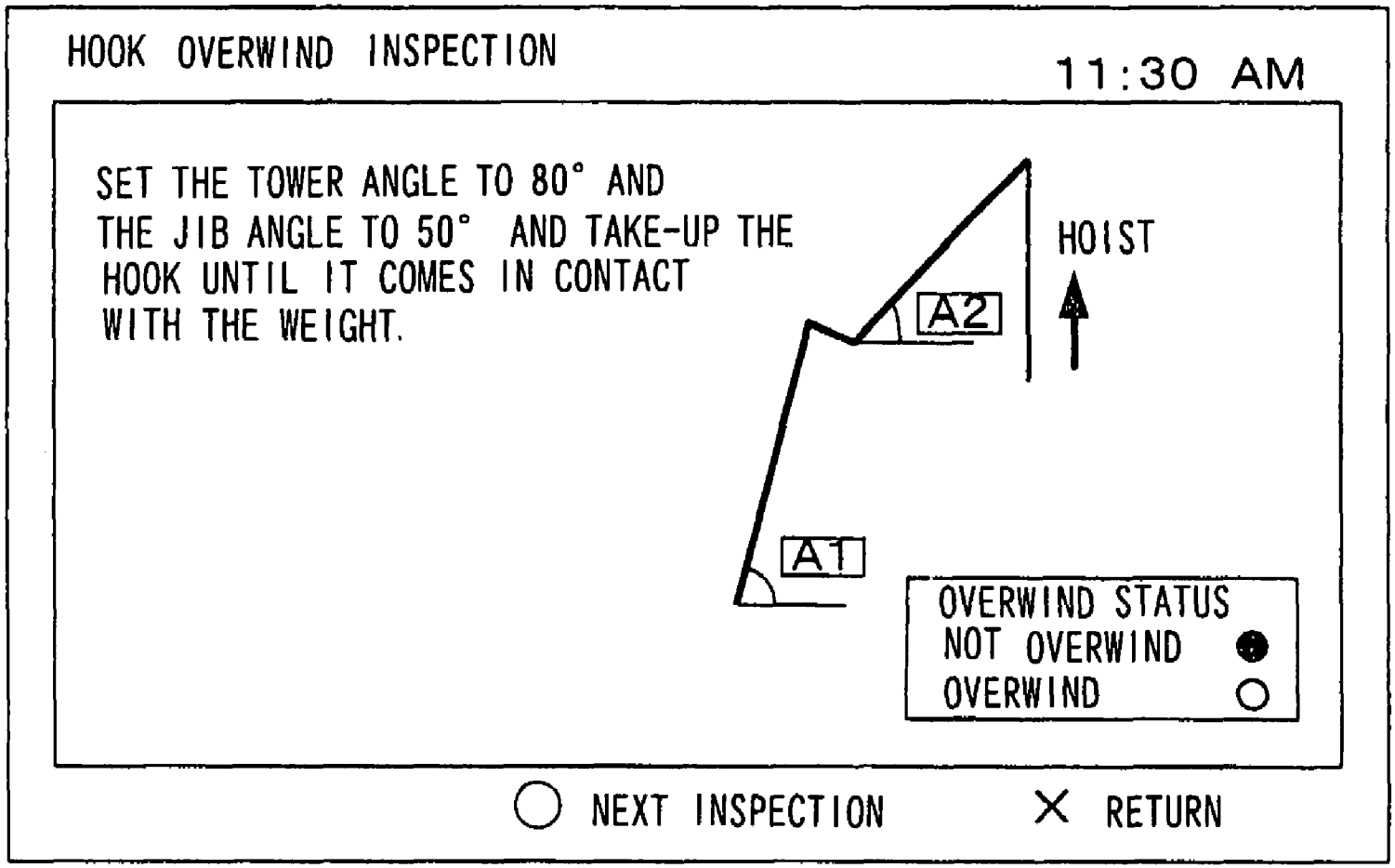

As the operator operates the ○ key 45 after verifying that the overload preventing device is operating correctly, the display shifts to a display screen providing the next inspection guidance, as shown in FIG. 71. It is to be noted that the display returns to that shown in FIG. 67 in response to an operation of the "discontinue" key (X key) 46 in the display screen shown in FIG. 68 or 69, whereas the display returns to that shown in FIG. 66 in response to an operation of the "discontinue" key (X key) 46 in the screen display shown in FIG. 70.

In FIG. 71, the following message is displayed to provide operating procedure instructions for inspecting the hook overwind preventing device in the display screen; "Set the tower angle to 80° and the jib angle to 50°, and take-up the hook until it comes in contact with the weight". In addition, a simple illustration of the tower crane including the tower angle (A1) and the jib angle (A2) that instructs to take up the hook and a sign indicating that the hook overwind has not occurred are displayed in the display screen. As the operator takes up the hook by following the instructions provided in the message and the hook enters an overwind state with the weight lifted up as a result, the display is switched to the display screen shown in FIG. 72.

Figure 72:
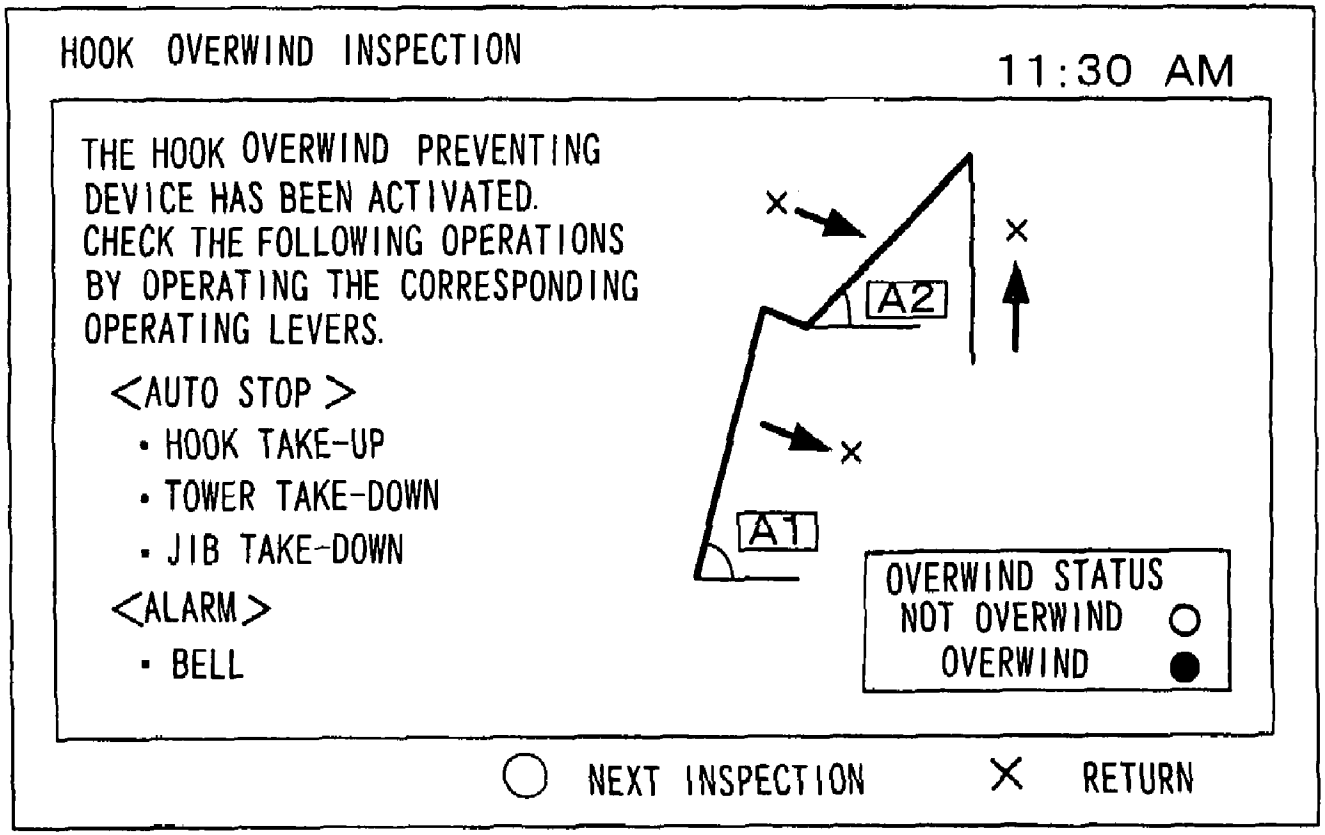

The following messages are displayed in the display screen shown in FIG. 72.

The hook overwind preventing device has been activated.

Check the following operations by operating the corresponding operating levers.

(Auto Stop)
Hook take-up
Tower take-down
Jib take-down (Alarm)
Bell

Figure 73:
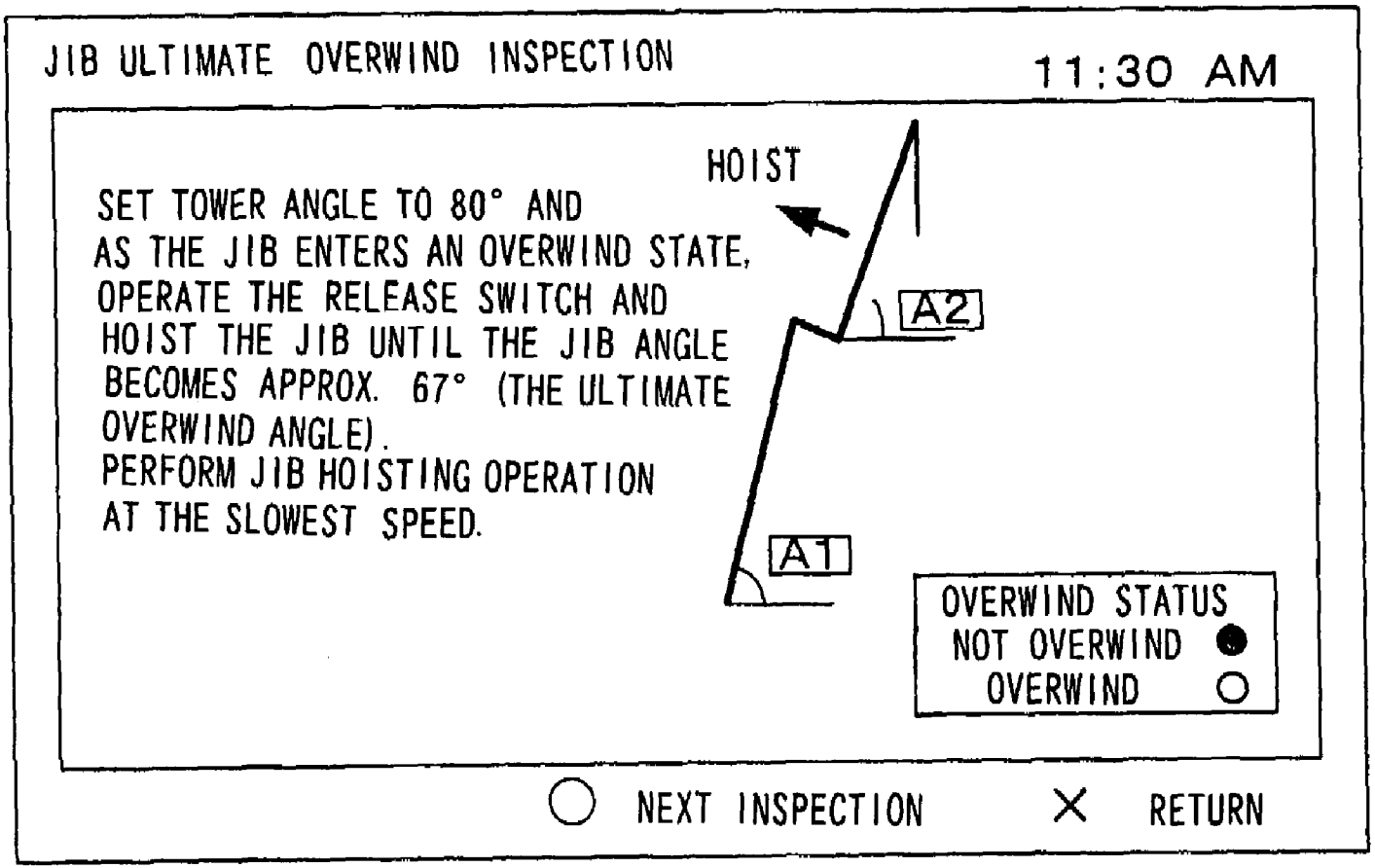

In addition, an illustration of the tower crane indicating that the hook take-up drive, the tower boom take-down drive and the jib take-down drive stop and a sign indicating that a hook overwind has occurred are displayed in the screen. The operator follows the instructions in the messages to verify that the individual drive operations have stopped and the alarm bell is output. As the operator operates the ○ key 45 after verifying that the hook overwind preventing device operates correctly, the display moves forward to the display screen providing the next inspection guidance, as shown in FIG. 73. It is to be noted that the display returns to the display screen in FIG. 66 in response to an operation of the "return" key (X key) 46 in the display screen shown in FIG. 71 or 72.

In FIG. 73, the following messages are displayed in the display screen to provide operating procedure instructions for inspecting the jib ultimate-overwind preventing device.

Set the tower angle to 80°, and as the jib enters an overwind state, operate the release switch and hoist the jib until the jib angle becomes approx. 67' (the ultimate-overwind angle).

Perform jib hoisting operation at the slowest speed.

In addition, an illustration of the tower crane, which indicates the tower angle (A1) and the jib angle (A2) and also includes an instruction to hoist the jib and a sign indicating that a jib ultimate-overwind has not occurred are displayed in the display screen. It is to be noted that a state of jib overwind occurs when the jib angle becomes equal to a predetermined value, e.g., 65°, smaller than the ultimate-overwind angle. As the operator hoists the jib to achieve the ultimate-overwind angle by following the instructions in the messages and the jib enters a state of ultimate-overwind, the display is switched to the display screen shown in FIG. 74.

Figure 74:
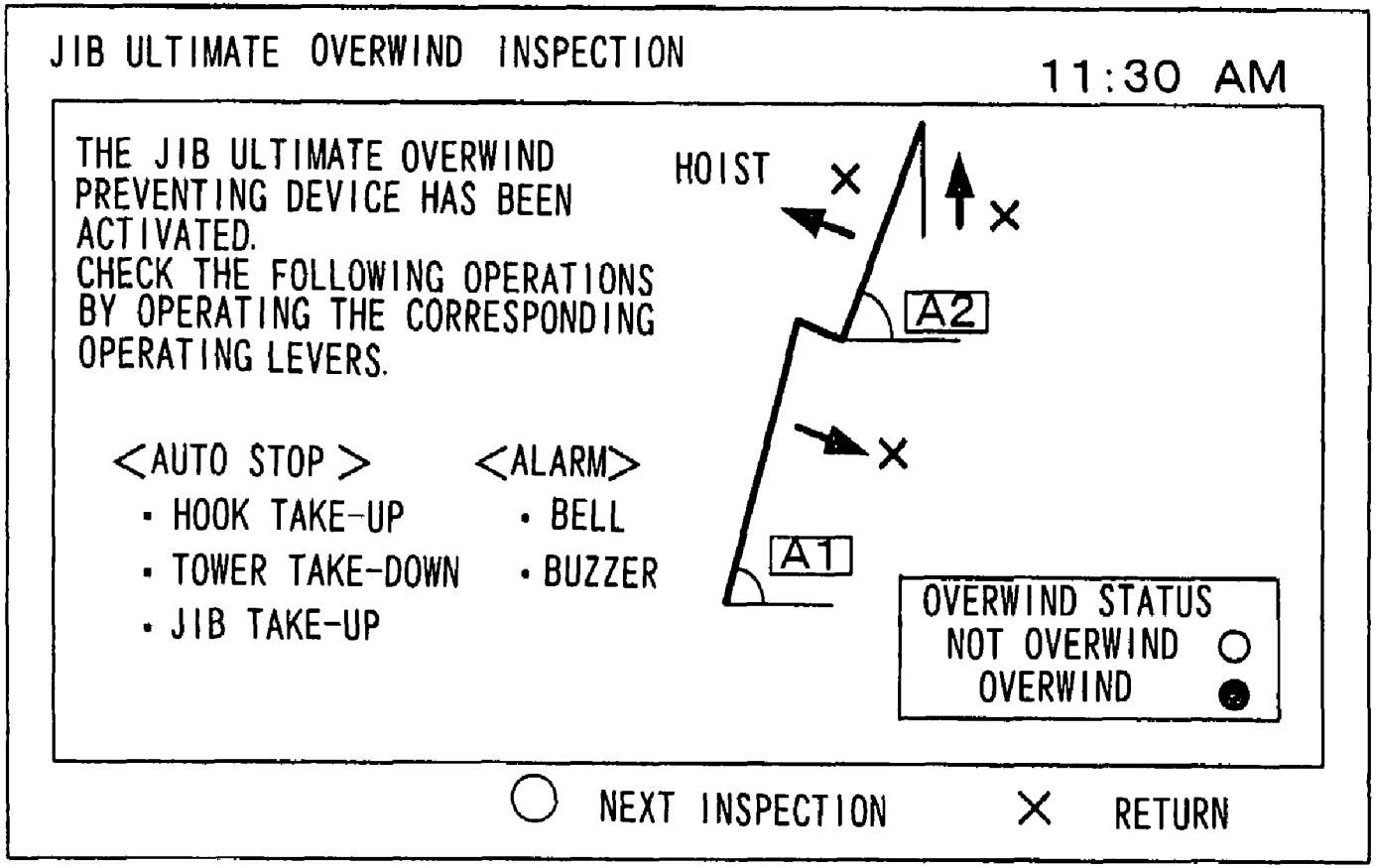

The following messages are displayed in the display screen shown in FIG. 74.

The jib ultimate-overwind preventing device has been activated.

Check the following operations by operating the corresponding operating levers.

(Auto Stop)
Hook take-up
Tower take-down
Jib take-up (Alarm)
Bell
Buzzer

In addition, an illustration of the tower crane indicating that the hook take-up drive, the tower boom take-down drive and the jib take-up drive stop and a sign indicating that a jib ultimate-overwind has occurred are displayed in the screen. The operator follows the instructions in the messages to verify that the individual drive operations have stopped and the alarm bell and the alarm buzzer sound.

Figure 75:
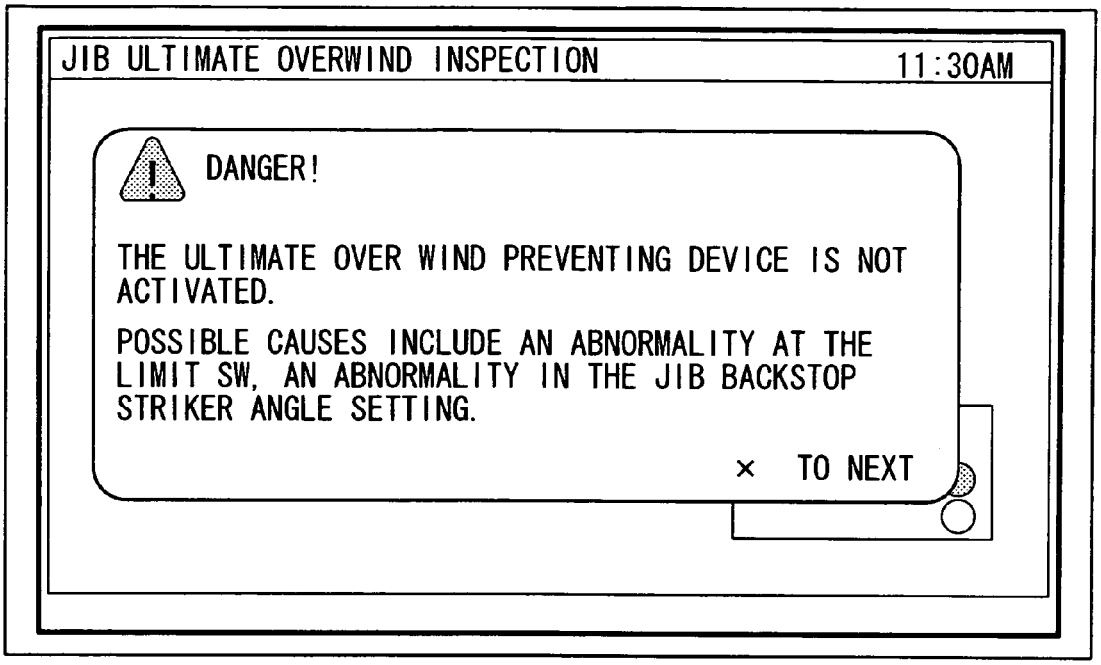

If the jib ultimate-overwind preventing device is not activated even when the jib is hoisted until the relative angle of the tower angle and the jib angle achieves a predetermined value of, for instance, 12° or smaller, i.e., until the jib angle becomes 68° or larger with tower angle being 80°, by following the instructions in the display screen in FIG. 73, the display is switched to the display screen shown in FIG. 75. In the display screen shown in FIG. 75, a warning message "The jib ultimate-overwind preventing device is not activated" is displayed as a pop-up, together with a message "Possible causes include an abnormality at the limit switch and an abnormality in the jib backstop striker angle setting". If the operator selects the X key 46 in FIG. 75, the display is switched to the display screen shown in FIG. 76.

Figure 76:
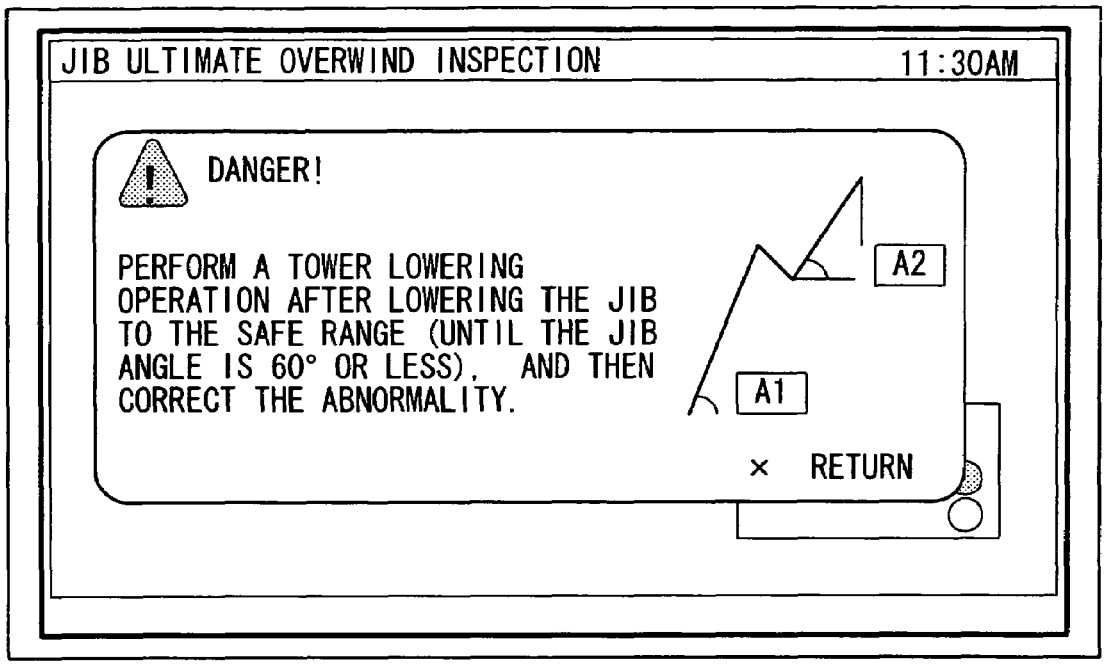

In the display screen shown in FIG. 76, a message "Perform a tower lowering operation after lowering the jib to the safe range (until the jib angle is 60° or less), and then correct the abnormality" is displayed together with an illustration of the tower crane. If the operator selects the X key 46 in this display screen, the display returns to the display screen shown in FIG. 66.

As the operator operates the ○ key 45 after verifying that the jib ultimate-overwind preventing device operations correctly in the display screen shown in FIG. 74, the operation proceeds to bring up display screens of the inspection guidance for the remaining safety devices. In the inspection operating procedure guidance of the remaining safety devices, i.e., the tower 90°-overwind preventing device and the tower ultimate-overwind preventing device, the inspection operating procedures are displayed by using illustrations and text messages as in the guidance of the inspection operating procedures for the hook overwind preventing device and the jib ultimate-overwind preventing device shown in FIGS. 71 to 74. A detailed explanation of the guidance screens for the safety devices is omitted.

The pre-work inspection operating procedure guidance explained above may be provided on display when performing the pre-raise inspection as well. It is to be noted that in such a case, the assistant operator on the ground should press the individual limit switch to assume an overwind state to enable the operator to inspect the operations of the safety devices by following the instructions in the display screens since the tower boom 2 and the jib 3 cannot be actually hoisted during the pre-raise inspection.

While an explanation is given above in reference to the embodiment on an example in which an instruction to set the engine rotational speed to a low level is displayed and a warning is displayed if the engine rotational speed becomes high when performing a setup operation, the operation assist apparatus according to the present invention is not limited to this example and allows for numerous variations. For instance, if the engine rotational speed becomes high during a setup operation, the engine rotation rate may be automatically lowered by controlling a pulse motor or the like (not shown).

In addition, the angle of inclination of the crane main body 1 relative to the horizontal may be indicated in the sub-screen at the display unit 30. Furthermore, the display mode that may be adopted in conjunction with display screens is not limited to that assumed in the embodiment described above and any of various other display modes may be adopted. Namely, the design of the display screens and the like brought up on display at the operation assist apparatus according to the present invention, which assists operator operations by displaying the setup operating procedures together with the quantities indicating the state of the tower crane during the setup operations, the tower crane posture and the environment information, can be altered as long as the operator is provided with the information he needs to perform the operations. It is desirable that the operating procedures, the machine posture and the state quantities be indicated through a combination of illustrations, text messages and audio messages so that the operator can easily follow the instructions. The input device 40 may be integrated with the display unit 30, and may be a touch panel device.

While an explanation is given above in reference to the embodiment on an example in which the setup operating procedures for raising and lowering the tower crane are displayed at the display unit 30, the operation assist apparatus according to the present invention is not limited to this example and it may be used to display setup operating procedures for a construction machine other than a tower crane, such as a standard crane. Namely, the present invention may be adopted in all types of operation assist apparatuses that assist operator operations by displaying operating procedures together with the machine posture and the machine state quantities at a multi-display screen.

As described above, the operation assist apparatus achieved in the embodiment of the present invention displays the setup operating procedures and information such as the crane state quantities by using text, illustrations, dynamic images and the like at the display unit 30 installed in the operator's cab 1*a* of the construction machine. The operator can thus check the crane state quantities, the crane posture and the environment surrounding the crane during a setup operation to prevent irregular winding of a winch that may be caused by a slack cable, damage to the swing lever 7 caused by overwinding of a cable and the like. Since any abnormal cable tension, incorrect coupling or releasing of the coupling device 13 and the like are indicated on display or as an audio output, the operator is duly warned in a timely manner to correct the situation promptly.

The tower crane may assume a specific setting to skip the display of an operation procedure at the display unit 30, or the operator may opt to skip the display of a specific operating procedure at the display unit 30. For instance, the display may start with the tower raising operation guidance by skipping the display of the pre-raise inspection operating procedure guidance or the display of the tower hoist pad guidance may be skipped. Thus, a practical and user-friendly operation assist apparatus, which allows only the operating procedure guidance actually needed by the operator to be displayed at the display unit 30, is achieved. In addition, installation space can be saved by using the display unit 30 at which the moment limiter screens can be displayed as well as the operating procedures. Furthermore, by displaying a list of the setup operating procedures in a tree format at the display screen, the operator can ascertain with ease the operations currently in progress.

By displaying information as needed in correspondence to the current tower crane posture or the current operation items, as shown in FIGS. 59A-59C, e.g., by displaying the wind velocity when the tower angle reaches 70°, the limited display area at the display unit 30 can be utilized efficiently and, at the same time, the information needed by the operator can be provided in a timely manner.

Since the screen number assigned to the display screen on display when the power goes off is recorded into the nonvolatile memory 21, the operation can be resumed by turning the power back on with the same screen that was on display when the operation was interrupted (a resume function).

The following is the advantages achieved by the operation assist apparatus in the embodiment of the present invention.

(1) The operation assist apparatus according to the present invention, which displays operating procedures at the display unit 30 installed in the operator's cab 1*a* by using text, i.e., characters, and messages and illustrations, allows the operator to perform operations by checking the operating procedures displayed at the display device and thus, the operator can perform operations easily with a high degree of accuracy.

(2) Since the operating procedures for the setup operations are displayed at the display unit 30, the setup operations which are performed by the operator in reference to the instruction manual in the related art, can be performed with greater ease and a higher degree of reliability.

(3) Since information required to drive and operate the construction machine, e.g., the driving environment information and information generated as the operation progresses, are displayed together with the corresponding operating procedure at the display unit 30, the operator can easily and accurately perform the operation by checking the information on the construction machine.

(4) The display screen at the display unit 30 is updated as necessary based upon the operating environment surrounding the construction machine and the information generated as the operation progresses and thus, the operator can perform the operation in a highly reliable manner based upon the real-time information.

(5) Since the operating procedure guidance includes instructions on specifically how to perform the individual operations, e.g., how to start raising operation, the verification items to be checked such as the orientation of the main body and the operating states of the brakes, the inspection items to be checked such as the operating states of the safety devices and operational warnings, e.g., a warning that the coupling device is in a released state, which are displayed at the display unit 30, the operator can perform the operations with ease and a high degree of reliability.

(6) The quantities indicating the state of the tower crane such as the tensions of the cables used to hoist the front attachment which includes the tower boom 2 and the jib 3, the posture of the construction machine represented by the tower angle, the jib angle and the like and the environment information including the wind velocity and the wind direction are detected and the information resulting from the detection is displayed at the display unit 30. Thus, the operator is enabled to check various types of information concerning the construction machine with ease.

(7) Since the subsequent operating procedure is brought up on display based upon the current posture of the construction machine, e.g., the instructions with regard to the tower hoist pad are displayed when the tower angle reaches 70°, the operator is enabled to perform the operations by checking the correct operating procedure with ease.

(8) Since the operating procedure corresponding to an operation performed at the input device, i.e., the selection device 40, is displayed at the display unit 30, the operator can select and display any operating procedure that he wishes.

(9) If the construction machine is within the work range, i.e., if the current working radius relative to the radius limit is within a predetermined allowable range, moment limiter information is displayed at the display unit 30. This allows the crane operation and the like to be performed smoothly and, at the same time, the limited space inside the operator's cab 1*a* can be utilized with a high degree of efficiency.

(10) By displaying a list of the operating procedures in a tree format in the sub-screen, i.e., in a portion of the display screen, at all times, the operator can easily ascertain the exact state of operational progress. Alternatively, a list of the operating procedures assuming a tree format may be brought up on display in the main screen as necessary, to enable the operator to easily ascertain the state of the operational progress.

(11) The operating procedure displayed at the display unit 30 immediately before the power is turned off is stored into the nonvolatile memory 21, and the operating procedure stored in the nonvolatile memory 21 is brought up on display at the display unit 30 when the power is turned on again. As a result, even when the power is cut off temporarily due to a disconnection or the like, the operation can be resumed at the point where the operation was interrupted.

(12) By providing the operating procedure guidance via an audio output as well as text messages, illustrations and dynamic images, the operation assist apparatus allows the operator to check the operating procedures with an even higher degree of reliability.

Second Embodiment

The following is an explanation of the operation assist apparatus achieved in the second embodiment of the present invention. The structure of the operation assist apparatus adopted in the second embodiment is similar to that of the operation assist apparatus in the first embodiment having been explained earlier in reference to FIG. 3. While the explanation of the first embodiment focuses on the display of the tower crane setup operating procedures at the display unit 30, an explanation is given in reference to the second embodiment on a shift from the display of a moment limiter screen to the display of a setup operating procedure.

When the tower crane is currently assuming a work posture, i.e., when the tower crane is ready for work, a moment limiter screen such as that shown in FIG. 34 is displayed at the display unit 30. In addition, after an engine key switch (not shown) at the crane main body 1 is turned on and a setting screen in which the tower crane operating state is set is displayed, a moment limiter screen is displayed at the display unit 30.

In the second embodiment, the posture of the tower crane is judged while a moment limiter screen is on display at the display unit 30 and a screen which provides the operating procedure corresponding to the current tower crane posture is then brought up on display at the display unit 30.

The controller 20 makes a decision as to whether or not the current tower crane posture is within the work range based upon the tower angle and the jib angle detected at the angle sensors 51 and 52 and displays a moment limiter screen at the display unit if the tower crane posture is within the work range. If, on the other hand, the tower crane posture is not within the work range, or if the tower crane posture has shifted from the work range to the non-work range, the controller 20 switches the display at the display unit 30 from the moment limiter screen to the appropriate operating procedure in correspondence to the tower crane posture. The tower crane posture in the non-work range fits into one of the following three classifications.

(1) Pre-Assembly or Front-on-the-Ground State

Figure 77:
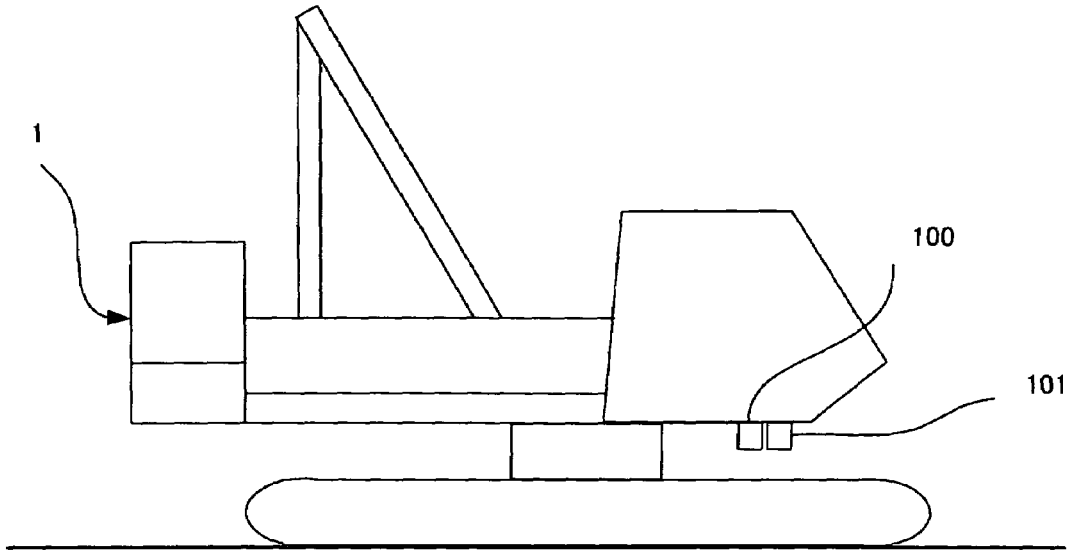
FIG. 77 is a schematic side elevation of the tower crane before undergoing the assembly process.
Figure 78:
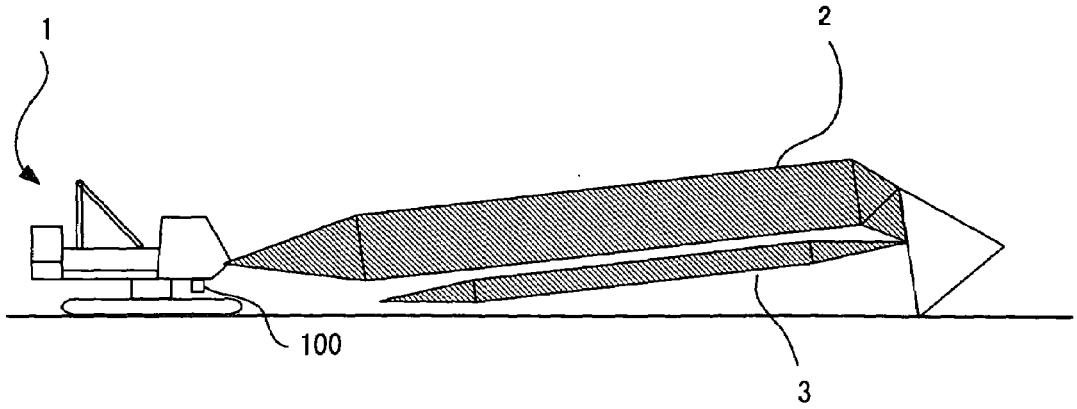
FIG. 78 is a schematic side elevation of the tower crane with a front attachment resting on the ground.

The tower crane assumes a first type of posture in the non-work range when the tower boom 2 and the jib 3 are not attached to the crane main body 1 yet (hereafter referred to as a pre-assembly posture), as shown in FIG. 77, or when the tower boom 2 and the jib 3 attached to the crane main body 1 are still on the ground (hereafter referred to as the front-on-the-ground state), as shown in FIG. 78. A decision as to whether the tower crane is in the pre-assembly state or in the front-on-the-ground state is made by detecting whether or not a shorting plug 101 is connected to a main body connector 100 shown in FIGS. 77 and 78. If the shorting plug 101 is connected to the main body connector 100 as shown in FIG. 77, it is judged that the front attachment has not been attached to the main body yet and therefore the tower crane is in the pre-assembly state. If, on the other hand, the shorting plug 101 is not connected to the main body connector 100, it is judged that the front attachment has been attached to the main body. It is to be noted that this decision-making is executed at the controller 20.

(2) Resting State with Front Attached

Figure 79:
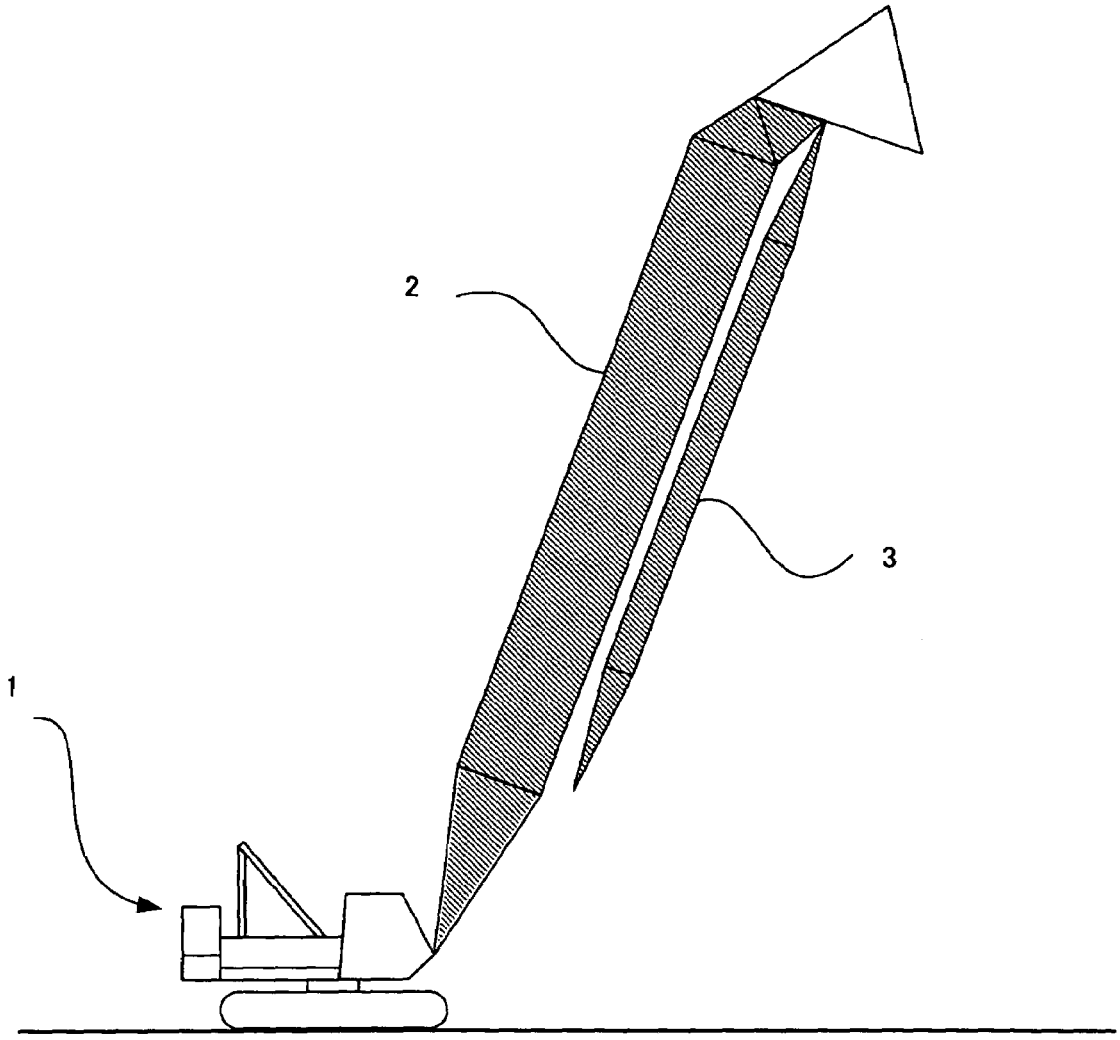
FIG. 79 is a schematic side elevation of the tower crane with the front attachment mounted thereupon in an idle state.

The tower crane assumes a second type of posture in the non-work range when the tower boom 2 and the jib 3 are attached to the crane main body 1, the tower crane is not currently in a work posture and it is not currently in the front-on-the-ground state, as shown in FIG. 78, either. For instance, the tower crane assumes this posture when the crane operation is interrupted due to high wind or the like by taking down the tower boom 2 to achieve a boom angle of approximately 60° with the jib 3 and the tower boom 2 in a coupled state, as shown in FIG. 79 (hereafter to be referred to as a rest in a or idle state with front attached).

(3) Transition from the Work Range to the Non-Work Range

The tower crane assumes a third type of posture in the non-work range when it undergoes a transition from a work posture to an posture in the non-work range.

The following is a detailed explanation of the operations of the operation assist apparatus in the situations described above in (1) to (3), given in reference to the drawings.

(1) Pre-Assembly or Front-on-the-Ground State

Figure 80:
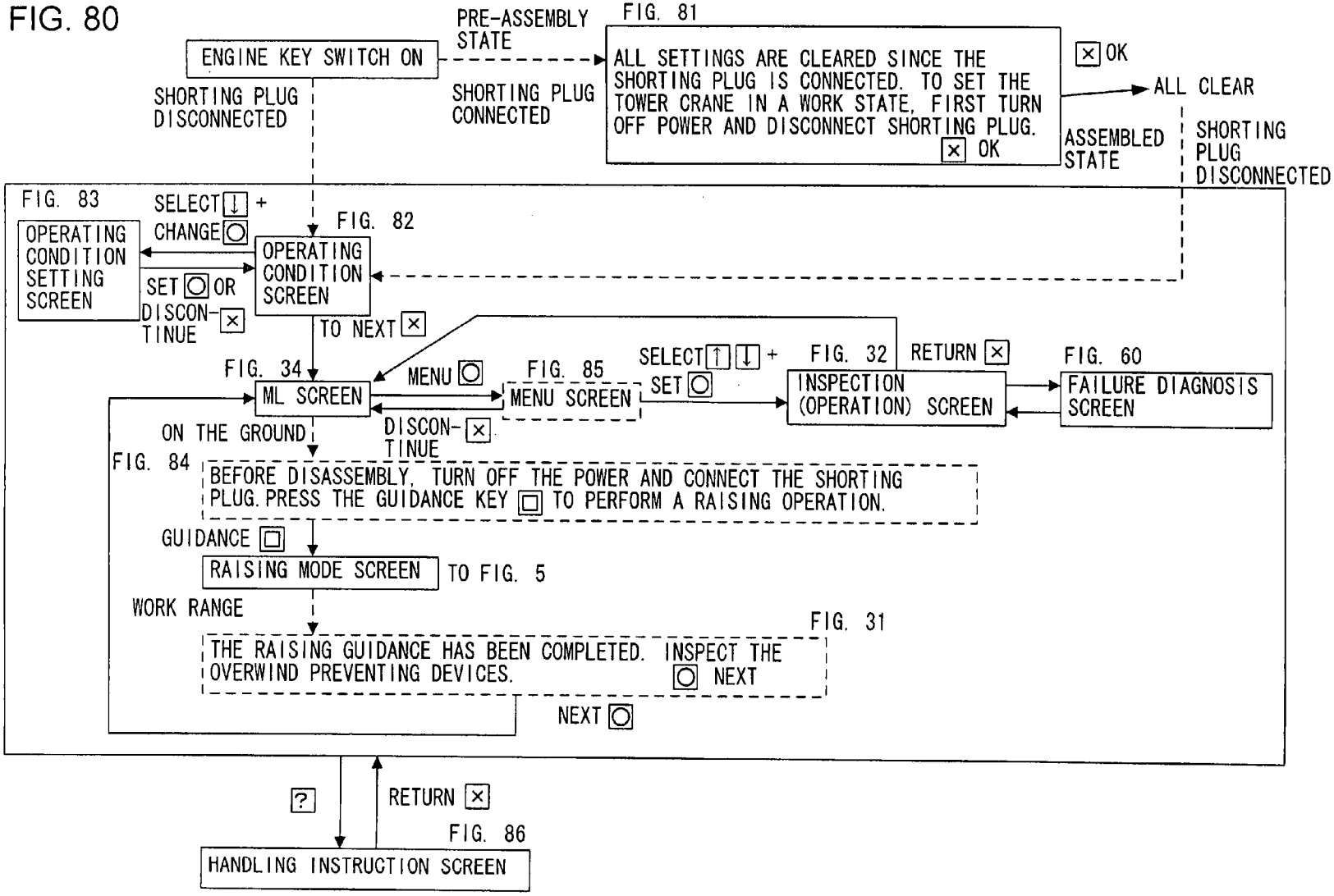
FIG. 80 shows the flow of the operating procedure screens brought up on display prior to the assembly process or when the front mounted at the tower crane is set on the ground.

The operating procedures displayed at the display unit 30 when the tower crane posture is in the pre-assembly state or the front-on-the-ground state are explained in reference to FIG. 80. FIG. 80 presents a flowchart of the flow of operating procedure screens displayed at the display unit 30 in the pre-assembly state or the front-on-the-ground state. The flow in the flowchart presented in FIG. 80 starts as the engine key switch is turned on.

Figure 81:
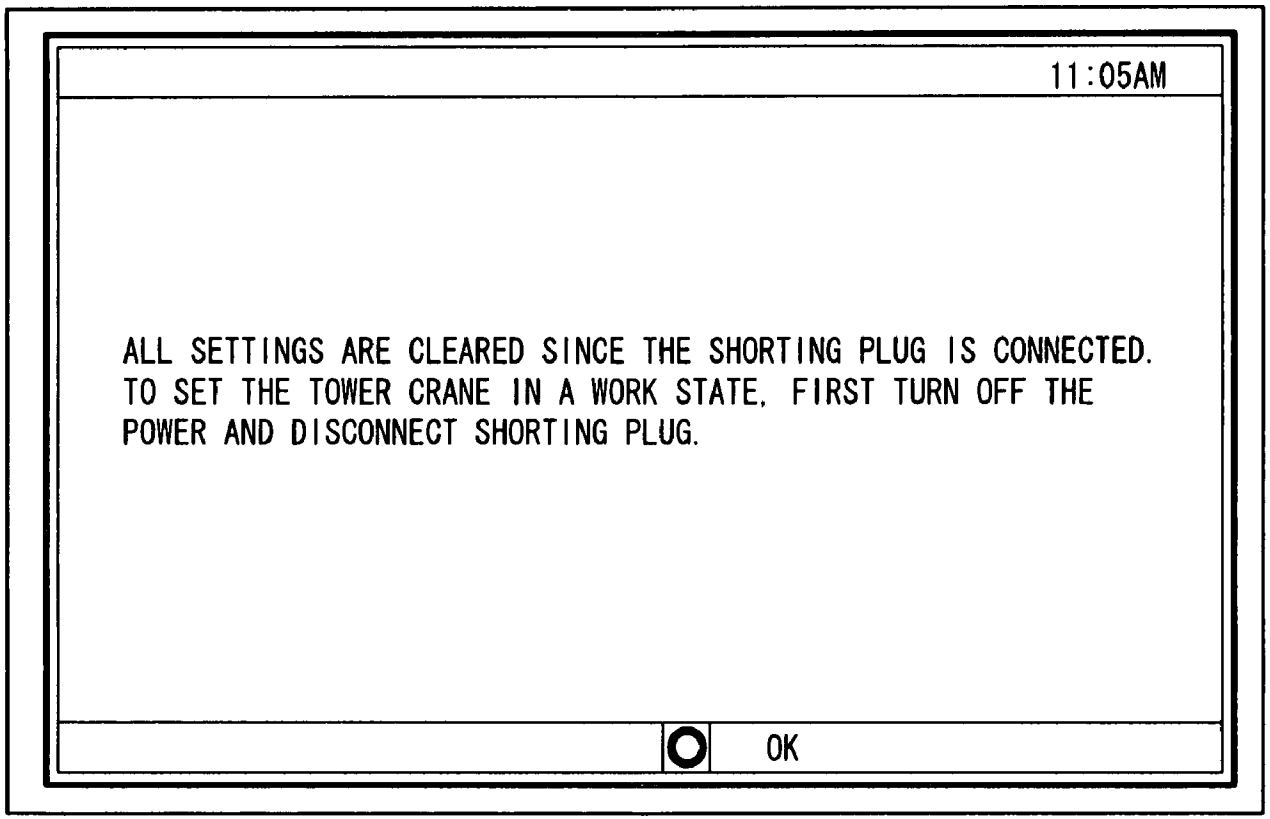

If the tower crane is in the pre-assembly state with the shorting plug 101 connected to the main body connector 100 when the engine key switch is turned on, the display screen shown in FIG. 81 is brought up on display at the display unit 30. A message which may read as follows is displayed over the entire display screen shown in FIG. 81.

All settings are cleared since the shorting plug is connected. If you wish to set the tower crane in a work state, first turn off the power and disconnect the shorting plug.

If the operator operates the OK key (○ key) 45, the settings at the overwind preventing devices and the like are all cleared. After the front attachment is attached and the shorting plug 101 is disconnected, the display screen shown in FIG. 82 is brought up on display at the display unit 30.

Figure 82:
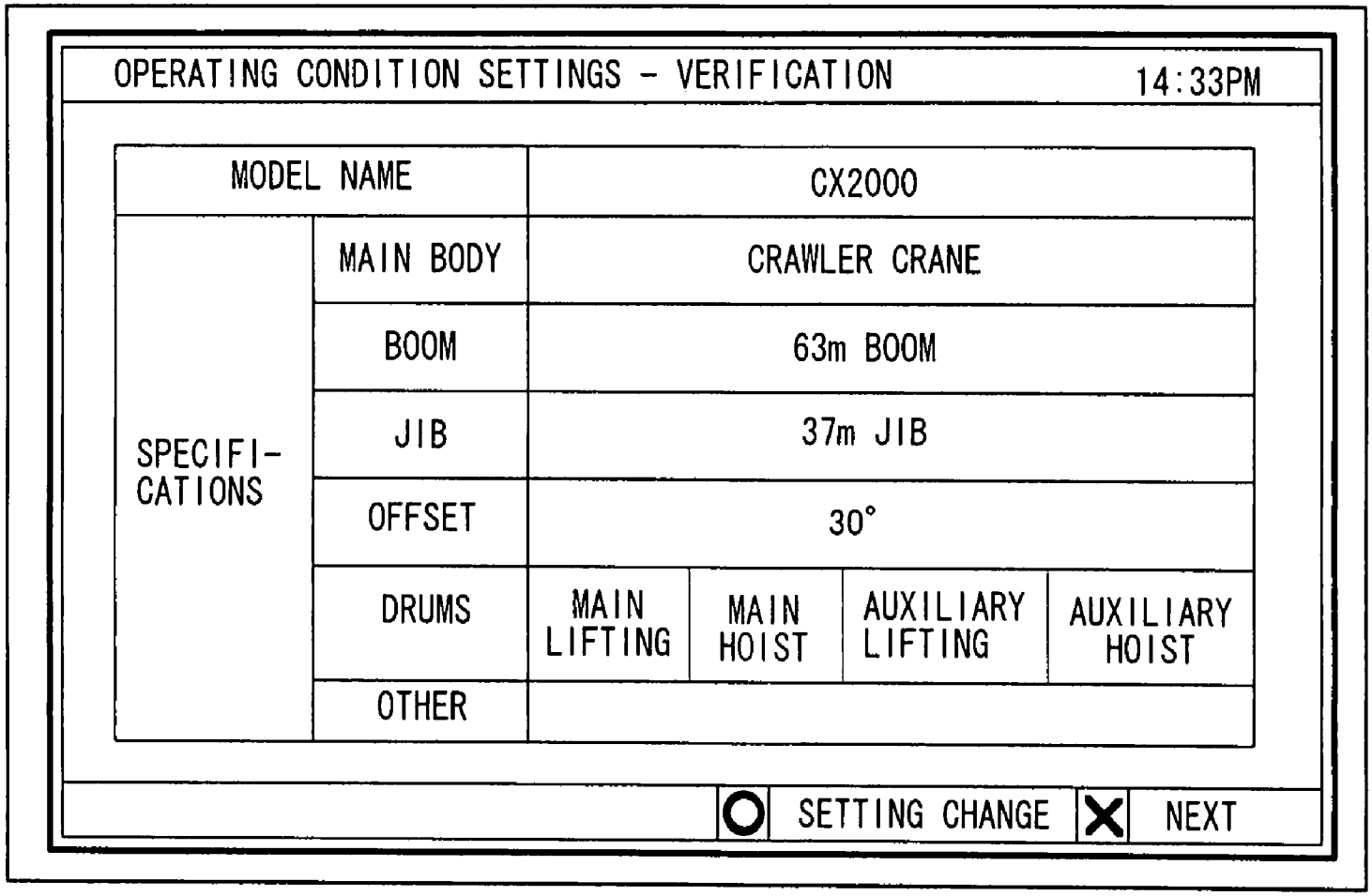

On the other hand, if the shorting plug 101 has been disconnected from the main body connector 100 when the key switch is turned on, the display screen shown in FIG. 82 is brought upon display. As shown in FIG. 82, a table indicating the model name of the construction machine and the specifications of the construction machine is displayed over the entire display screen. The specifications of the construction machine may include, for instance, the following.

Type of construction machine main body (crawler crane in this example)

Boom length

Jib length

Offset angle

Winch drum types (the tower boom hoist winch 4, the jib hoist winch 10, the hook hoist winch 15, etc. in this example)

The operator checks the operating condition settings indicated at the display unit 30, and operates the setting change key (○ key) 45 to alter an operating condition setting. In response to the operation of the setting change key 45, the display screen shown in FIG. 83 is brought up on display.

Figure 83:
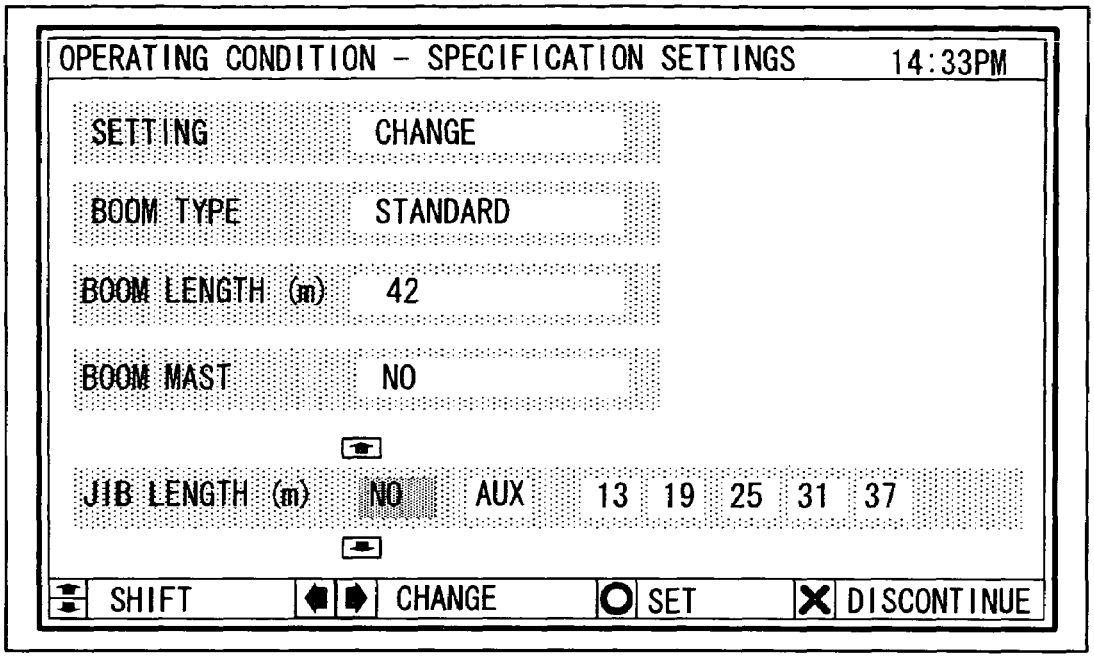

FIG. 83 shows a screen in which the condition settings can be modified is displayed over the entire display screen. The following is an example of settings that may be displayed in the specification setting screen.

Boom type

Boom length

Presence/absence of boom mast

Jib length

In order to modify a specification setting, the operator selects a specific setting by operating the UP or DOWN key 41 or 43 and changes the selected setting by operating the LEFT or RIGHT key 42 or 44. Once the specified setting has been altered, the operator selects the "set" key (○ key) 45. In response to the operation of the "set" key 45, the screen for verifying the operating condition setting shown in FIG. 82 is brought up on display again. In addition, if the operator operates the "discontinue" key (X key) 46 in the display screen shown in FIG. 83, too, the display returns to the display screen shown in FIG. 82.

As the operator selects the "next" key (X key) 46 in the display screen shown in FIG. 82, the display is switched to the moment limiter screen shown in FIG. 34. At this time, the controller 20 detects the posture of the tower crane based upon the signals provided by the boom angle sensor 51 and the jib angle sensor 52. If the tower angle is substantially 0° and the tower boom 2 and the jib 3 are both laid on the ground, as shown in FIG. 78, the controller 20 switches the display from the moment limiter screen to the display screen shown in FIG. 84.

In the display screen shown in FIG. 84, a message which may read as follows is displayed as a pop-up on the moment limiter screen.

For disassembly, turn off the power and connect the shorting plug. For a raising operation, press the guidance key.

If the operator wishes to raise the tower boom 2, he operates the guidance key (□ key) 48 by following the instructions in the message. As the guidance key 48 is operated, the display is switched to the raising guidance screen shown in FIG. 5. As the raising guidance provided, as shown in FIG. 5 and subsequent figures, has been explained in detail in reference to the first embodiment, its explanation is omitted here. After the pre-raise inspection, the tower raising operation and the jib raising operation are performed by following the instructions provided in the raising guidance and the tower crane posture is set within the work range, a screen indicating the end of the raising guidance, such as that shown in FIG. 31, is brought up on display. As the operator operates the "next"

key (O key) 45 in the screen shown in FIG. 31, the display is switched to the moment limiter screen shown in FIG. 34.

Figure 85:
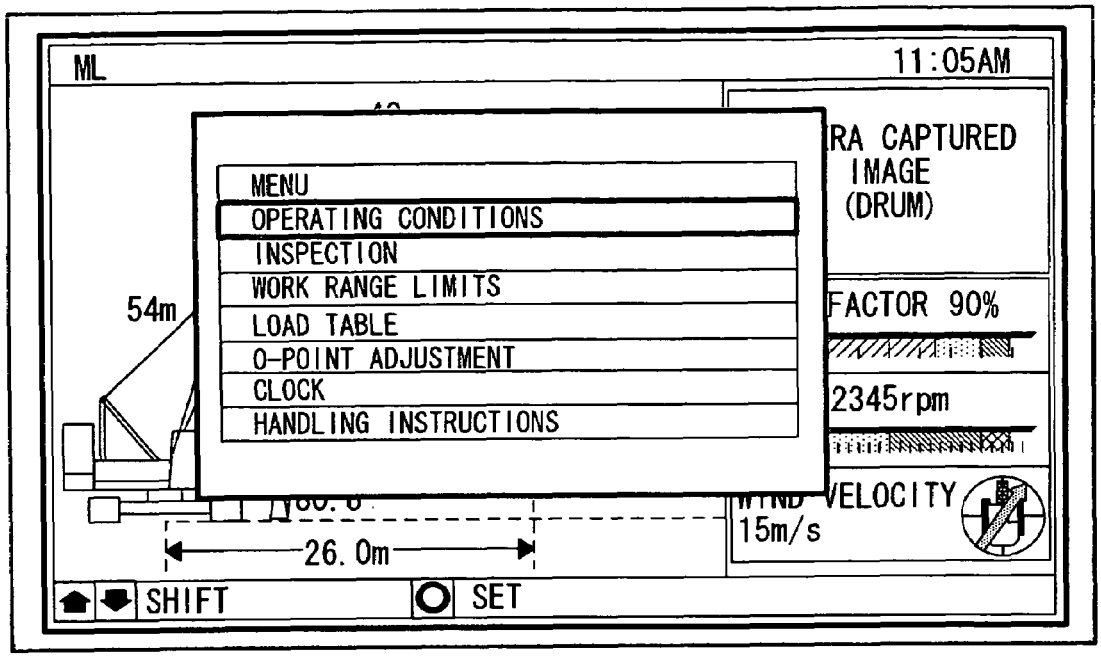

In response to an operation of the menu key (○ key) 45 in the screen shown in FIG. 34, the display is switched to the display screen shown in FIG. 85. FIG. 85 shows a pop-up menu which may include, for instance, the following menu items, displayed over the moment limiter screen.

Figure 60:
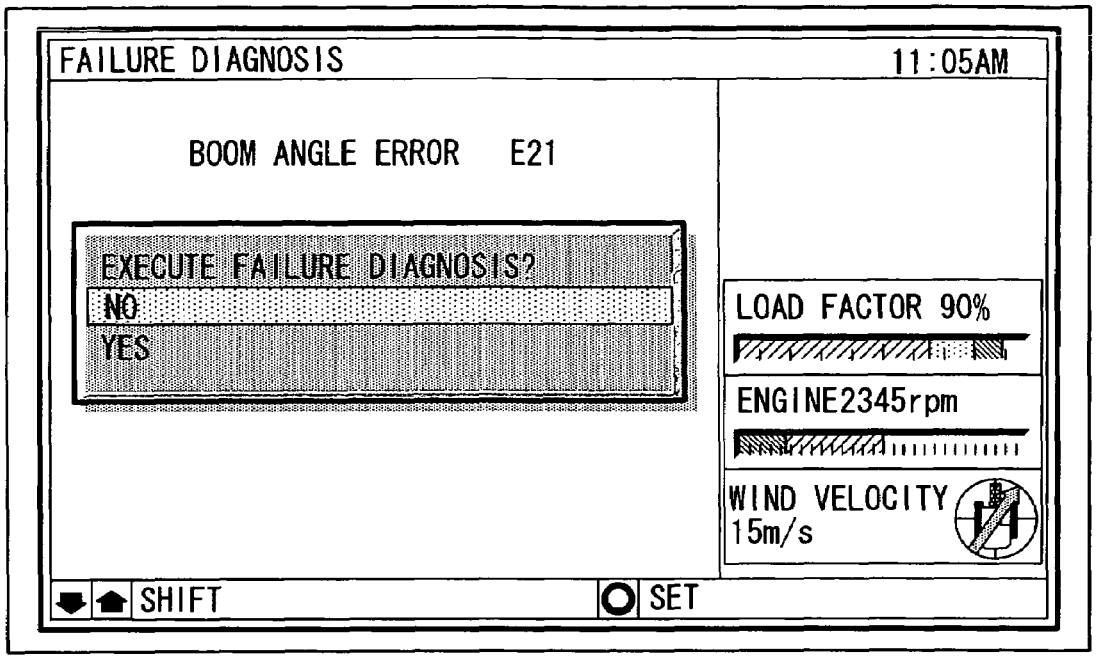
FIG. 60 presents an example of a failure diagnosis screen that may be displayed at the display unit.

Operating conditions
Inspection
Work range limits
Load table
0-point adjustment
Clock
Operation manual The operator selects a menu item by operating the UP or DOWN key 41 or 43 and then operates the "set" key (○ key) 45. For instance, if he selects "inspection" and operates the "set" key 45, the display is switched to the overwind preventing device operation check screen shown in FIG. 32. The operator then performs a pre-work inspection on the overwind preventing devices by following the instructions provided in the display screen in FIG. 32. If there is an error in an overwind preventing device, a selection screen which allows the operator to indicate whether or not a failure diagnosis is to be executed, such as that shown in FIG. 60, is displayed. Since how to verify the operation of the overwind preventing device operation has been explained in detail in reference to the first embodiment, a repeated explanation is not provided.

As the operator operates the "return" key (X key) 46 in the screen shown in FIG. 32, the display is switched to the moment limiter screen shown in FIG. 34. The operator then carries out a crane operation while ensuring that the tower crane posture does not enter the non-work range and that an overload does not occur by checking the tower crane state quantities displayed in the moment limiter screen. It is to be noted that at the bottom of each of the display screens described above, a help call key (? key, not shown) is displayed at all times to allow the operator to bring up a display of operation manual or handling instruction corresponding to the screen currently on display by operating the help call key. For instance, if the operator operates the help call key while the moment limiter screen shown in FIG. 32 is on display, an operation manual screen corresponding to the moment limiter screen, such as that shown in FIG. 86, is brought upon display.

In the display screen shown in FIG. 86, messages such as those below are displayed.

This is a moment limiter screen indicating the state of the machine. Keep the screen on display while performing a crane work.

Press "←" in the moment limiter screen to switch to the main lifting operation display. . . . (to be continued)

If the operator selects the page switch key (→ key) 42 in the screen, the display is switched to the display screen shown in FIG. 87.

In FIG. 87, messages such as those below are displayed in the display screen.

Press "→" to switch to the auxiliary lifting operation display ("←" and "→" are displayed only when operating a construction machine with an auxiliary jib or a jib).

Press "○" to bring up the menu for switching the display to a moment limiter sub-function screen . . . (to be continued)

An explanation of subsequent operation manual screens to follow that shown in FIG. 87 is omitted.

On the upper right side of the operation manual screens shown in FIGS. 86 and 87, the corresponding page numbers are displayed, and the operator can switch the display of the operation manual screen by operating the page switch key (left or right arrow key) 42 or 44. In addition, if the operator operates the "return" key (X key) 46, the display returns to the moment limiter screen shown in FIG. 34.

(2) Resting State with Front Attached

Figure 88:
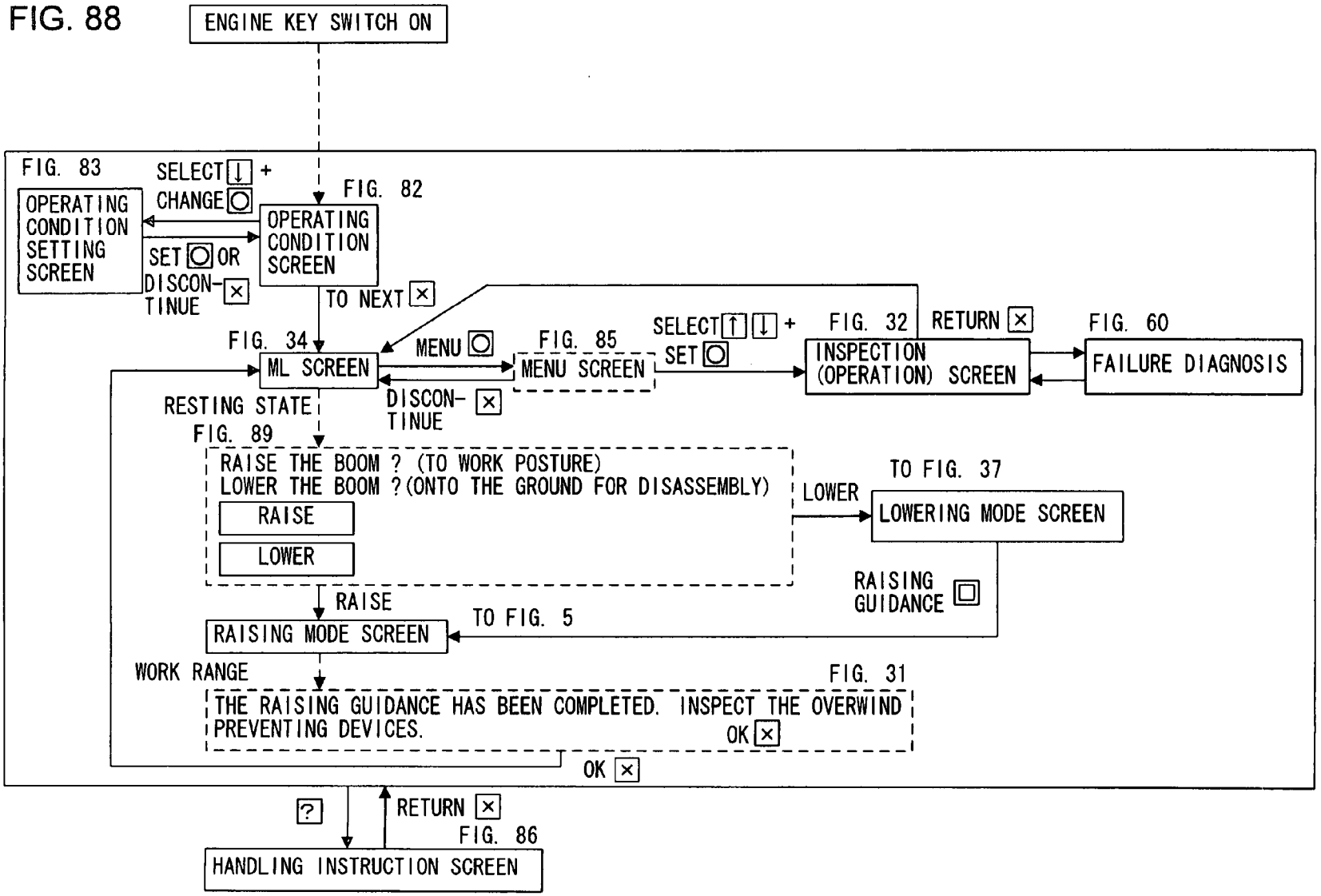
FIG. 88 shows the flow of the operating procedure screens brought up on display when the tower crane on which the front attachment is mounted is in an idle state.

Next, the operating procedures brought up on display at the display unit 30 when the tower crane posture is in the resting state with front attached are explained in reference to FIG. 88. FIG. 88 presents a flowchart of the flow of the operating procedure screens displayed at the display unit 30 when the tower crane is in the resting state with front attached. The flow shown in the flowchart in FIG. 88 starts as the engine key switch is turned on.

The display is switched to bring up the operating condition setting verification screen (FIG. 82), the specification setting change screen (FIG. 83), the moment limiter screen (FIG. 34) and the menu screen (FIG. 85) as in the pre-assembly state or in the front-on-the-ground state described above in (1). The controller 20 detects the tower crane posture based upon the signals provided by the boom angle sensor 51 and the jib angle sensor 52 while the moment limiter screen is on display.

Figure 89:
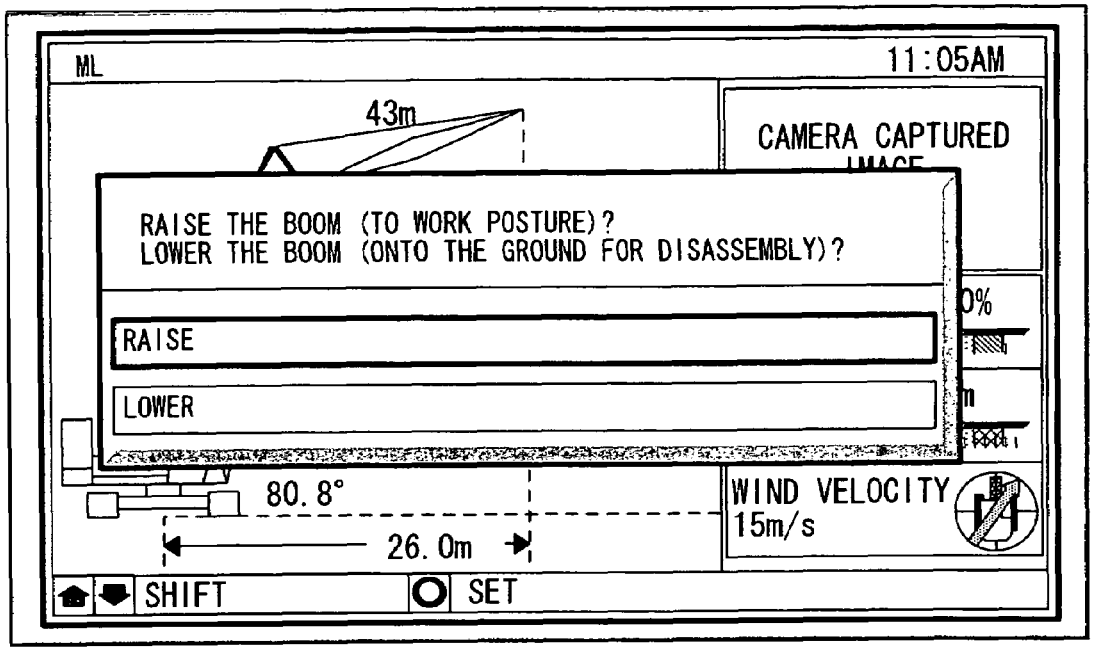
FIG. 89 presents an example of an operating procedure screen that may be displayed at the display unit.

If the tower crane is currently in the resting state shown in FIG. 79, the display is switched from the moment limiter screen to the display screen shown in FIG. 89. FIG. 89 shows the following messages displayed as a pop-up over the moment limiter screen.

Raise the boom (into a work posture)?
lower the boom (onto the ground for disassembly)?

The operator selects to either raise or lower the boom by operating the item shift key (UP or DOWN arrow key) 41 or 43 and then operates the "set" key (○ key) 45. If the operator selects to "raise" in the screen shown in FIG. 89, the display is switched to the raising guidance menu screen shown in FIG. 5. As the raising operation is completed by following the instructions provided in the raising guidance, the display is switched to a display screen indicating the end of the raising operation, such as that shown in FIG. 31.

If, on the other hand, the operator selects "lower" in FIG. 89, the display is switched to the lowering guidance screen shown in FIG. 37. Since the lowering guidance provided in the display screens in FIG. 37 and subsequent figures has been explained in detail in reference to the first embodiment, its explanation is omitted. As the operator selects the guidance key (□ key) 48 while the display screen shown in FIG. 56, which indicates the end of the lowering guidance, is on display, the raising guidance menu screen in FIG. 5 is brought up.

Figure 90:
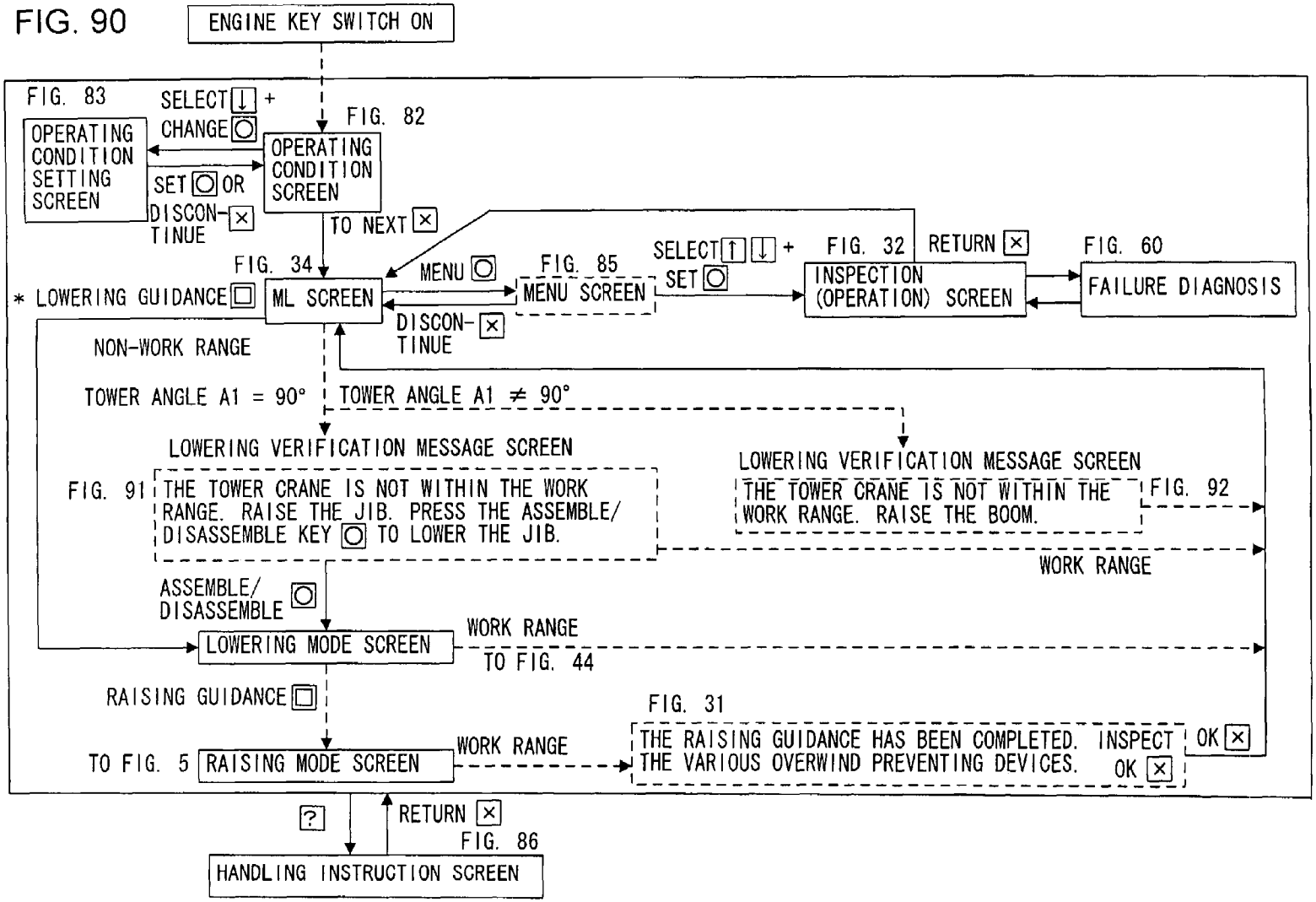
FIG. 90 shows the flow of the operating procedure screens brought up on display when the posture of the tower crane having been within the work range shifts into the non-work range.

(3) Transition from the Allowable Work Range to the Outside of the Allowable Work Range Next, the operating procedures displayed at the display unit 30 when the tower crane posture undergoes a transition from the work range to the non-work range are explained in reference to FIG. 90. FIG. 90 presents a flowchart of the flow of the operating procedure screens displayed at the display unit 30 when the tower crane posture shifts from the work range to the non-work range. The flow in the flowchart shown in FIG. 90 starts as the engine key switch is turned on.

The display is switched to bring up the operating condition setting verification screen (FIG. 82), the specifications setting change screen (FIG. 83), the moment limiter screen (FIG. 34) and the menu screen (FIG. 85) as in the pre-assembly state or in the front-on-the-ground state described in (1) and in the resting state with front attached described in (2).

While the moment limiter screen shown in FIG. 34 is on display, the controller 20 detects the posture of the tower crane based upon the signals provided by the boom angle sensor 51 and the jib angle sensor 52. As the tower crane posture shifts from the work range to the non-work range, the display is switched from the moment limiter screen to a screen displaying the operating procedure corresponding to the detected tower crane posture.

Figure 91:
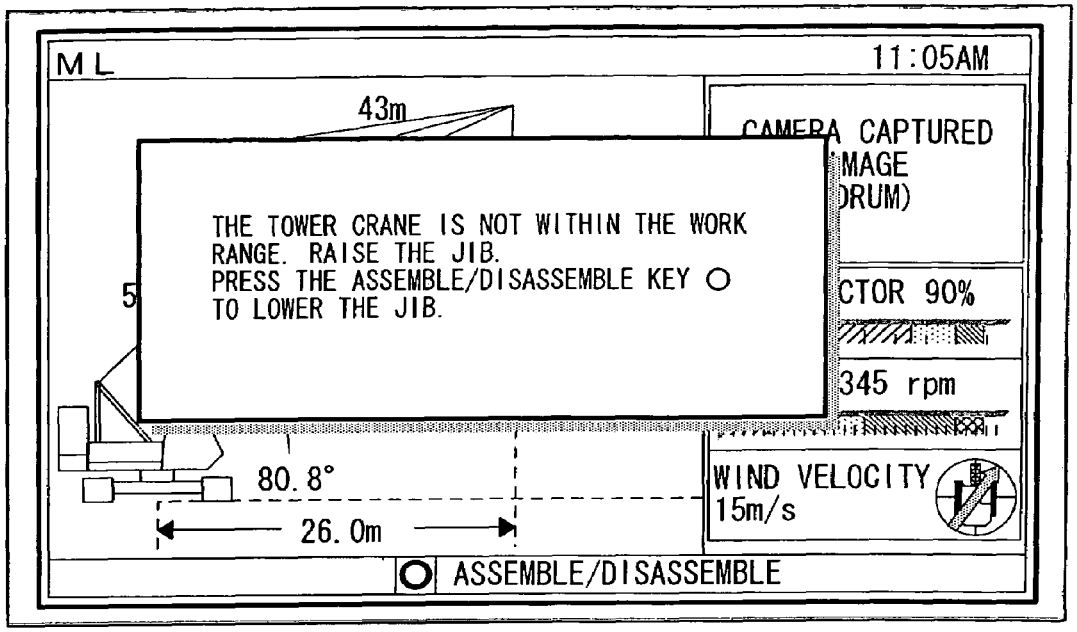
FIGS. 91 and 92 each present an example of an operating procedure screen that may be displayed at the display device.

If the tower crane posture enters the non-work range while the tower angle detected by the boom angle sensor 51 is 90°, i.e., if the jib 3 is taken down and the tower crane posture enters the non-work range as a result, the display screen shown in FIG. 91 is brought up on display. FIG. 91 shows the following messages displayed as a pop-up over the moment limiter screen.

The tower crane is not within the work range. Raise the jib.

Press the assemble/disassemble key to lower the jib.

If the operator selects the assemble/disassemble key (○ key) 45 in this screen, the display is switched to the lowering guidance screen for the jib lowering operation shown in FIG. 44. If, on the other hand, the jib 3 is taken up and the tower crane posture reenters the work range, the moment limiter screen in FIG. 34 is brought up on display again.

Figure 92:
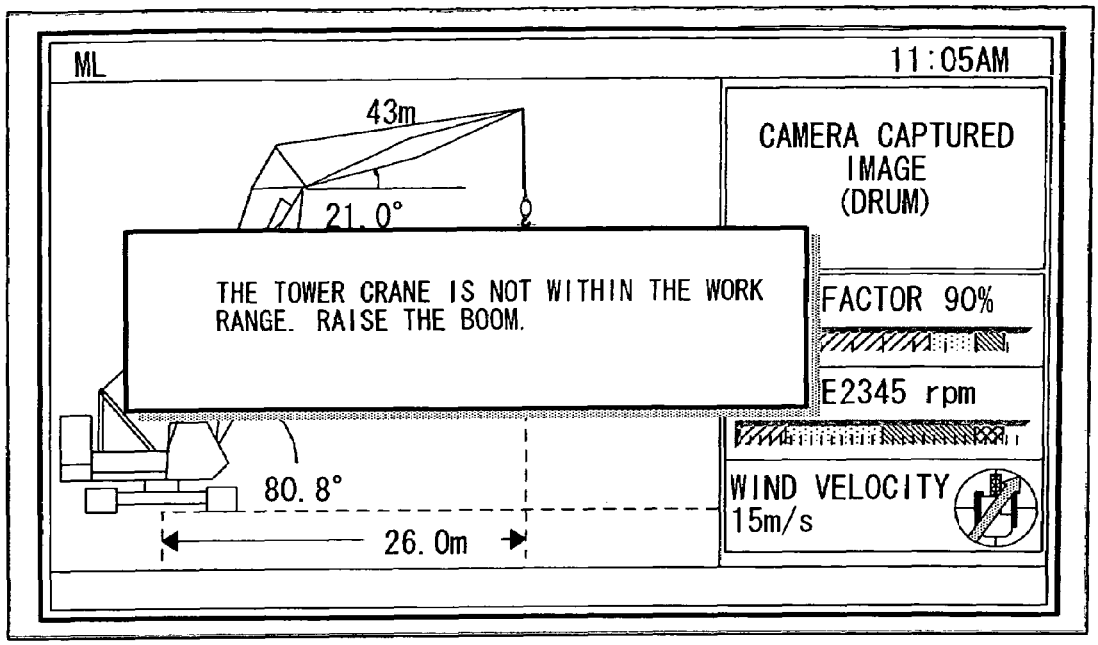

If the tower crane posture enters the non-work range while the tower angle detected by the boom angle sensor 51 is other than 90°, i.e., if the tower boom 2 is taken down and the tower crane aptitude enters the non-work range as a result, the display screen shown in FIG. 92 is brought up on display. FIG. 92 shows the following message displayed as a pop-up over the moment limiter screen.

The tower crane is not within the work range. Raise the boom.

If the tower boom 2 is taken up and the tower crane posture reenters the work range while this screen is on display, the moment limiter screen in FIG. 34 is brought back on display. It is to be noted that since the work range varies in correspondence to the specifications of individual tower cranes, the controller 20 sets in advance the work range of the specific tower crane in use in correspondence to the tower crane specifications displayed in the screen shown in FIG. 82, i.e., in correspondence to the tower boom length, the jib length and the like. It is also to be noted that in the resting state with front attached described in (2) and when the tower crane posture undergoes transition from the work range to the non-work range as described in (3), too, the operator can select the "?" key to bring up the operation manual screen corresponding to the screen currently on display.

Figure 84:
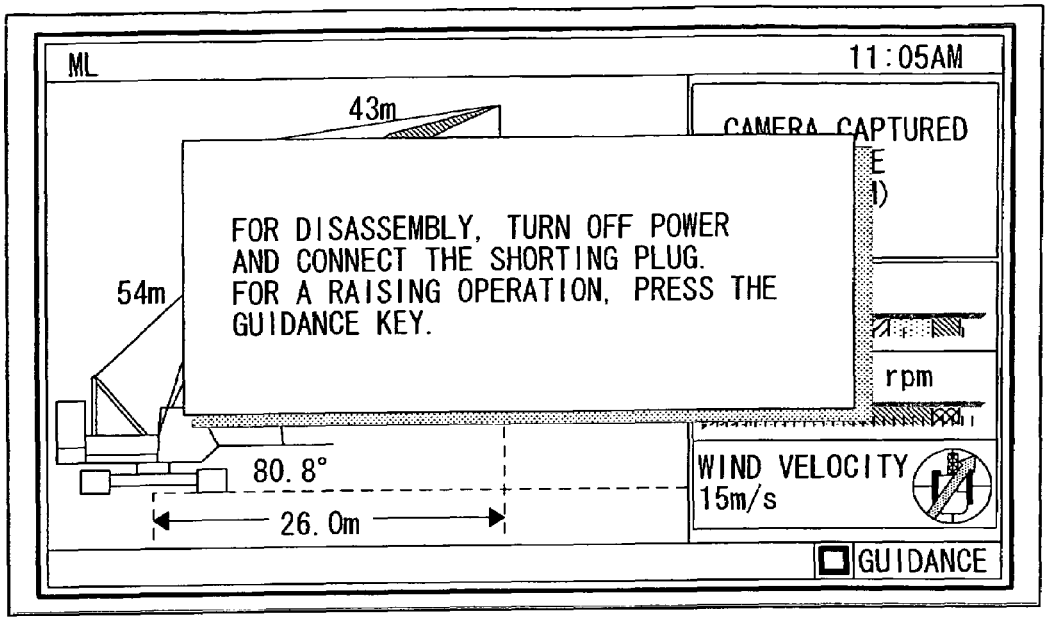

As explained above, if the tower crane posture is in the non-work range while the moment limiter screen is on display at the display unit 30, the operating procedure screen which corresponds to the specific tower crane posture is displayed. Namely;

(1) If the front attachment is laid on the ground, the operating procedure shown in FIG. 84 is brought up on display.

(2) If the tower crane is currently in the resting state with front attached, the operating procedure shown in FIG. 89 is brought up on display.

(3) When the tower crane posture has shifted from the work range to the non-work range, the operating procedure shown in FIG. 91 is brought up on display if the tower angle is 90° and the operating procedure in FIG. 92 is brought up on display if the tower angle is not 90°.

While an explanation is given above in reference to the second embodiment on the operating procedures displayed at the display unit 30 when operating a tower crane having the tower boom 2 and the jib 3 mounted thereupon as a front attachment, operating procedures similar to those described above may also be displayed when operating a crane having only a jib 3, i.e., a regular crane at which only a boom is mounted. However, a message such as that below should be displayed as a pop-up over the moment limiter screen shown in FIG. 34 when the posture of the regular crane shifts from the work range to the non-work range as described in (3), i.e., when the boom is taken down and the crane enters the non-work range.

The crane is not within the work range. Raise the boom or press the assemble/disassemble key to lower the boom.

It is to be noted that the display screen shown in the figures in reference to which the embodiment has been explained simply represent an example, and the layout and the messages may be changed as long as the necessary information is provided in the screens.

The following is the advantages of the operation assist apparatus achieved in the second embodiment of the present invention.

(1) The operation assist apparatus achieved in the second embodiment of the present invention, which displays the moment limiter information screen at the display unit 30 installed in the operator's cab 1*a*, also displays the operating procedures at the display unit 30 by using text and illustrations. Thus, the operator is enabled to perform operations easily and with a high degree of accuracy by checking the moment limiter information and the operating procedures displayed at the display unit 30. In addition, since the display unit 30 can be utilized both to display the moment limiter information and to display the operating procedures, the limited space inside the operator's cab 1*a* can be utilized efficiently.

(2) The display at the display unit 30 is switched from the moment limiter information to the operating procedure guidance or vice versa depending upon the posture of the construction machine. Since the information that matches the current state of the construction machine is displayed at the display unit 30 in this manner, the operator can perform the operation that needs to be performed under the current circumstances easily and reliably.

(3) If the construction machine posture is not within the allowable work range or if the construction machine posture has undergone a transition from the allowable work range to the outside of the allowable work range, the display at the display unit 30 is switched from the moment limiter information to the operating procedure corresponding to the specific construction machine posture. For instance, if the construction machine is a tower crane and the front attachment is currently laid on the ground, the operating procedure for the front attachment disassembly or the front attachment raising operation is brought up on display. If the construction machine is currently assuming the resting state with front attached, the operating procedure for taking up or lowering the tower boom 2 is brought up on display. When the construction machine posture has shifted from the work range to the non-work range, on the other hand, the operating procedure for taking up or lowering the jib 3 is brought up on display if the tower angle is 90° and the operating procedure for taking up the tower boom 2 is brought up on display if the tower angle is not 90°. As a result, the operator is enabled to perform the operation that needs to be performed in correspondence to the current tower crane posture with ease and reliability.

(4) The operating procedure guidance includes instructions on specifically how to perform operations to take-up or take-down the tower boom 2, and the like, the verification items to be checked such as the orientation of the main body and the operating states of the brakes, the inspection items to be checked, such as the operating states of the safety devices and operational warnings. Since the operating procedure or the moment limiter information that is in correspondence to the current construction machine posture or the operating procedure or the moment limiter information conforming to an operation performed at the input device 40 is displayed at the display unit 30, the information that is needed under the current circumstances is displayed and the information desired by the operator can be selected and displayed.

(5) If an error is detected with regard to an inspection item, the failure diagnosis screen is brought up on display at the display unit 30 to enable a failure diagnosis to be executed promptly on the corresponding safety device or the like.

(6) As the operator operates the handling instruction call key, more detailed operation manual corresponding to the display screen currently on display at the display unit 30 are brought up on display. As a result, the operator can obtain information he needs whenever necessary and the operator's work is, therefore, greatly facilitated.

(7) If the front attachment is not mounted at the construction machine, the operating procedure corresponding to the unattached state is displayed at the display unit 30 to ensure easy and highly reliable operation.

(8) Since the operating procedures for the setup operations are displayed at the display unit 30, the setup operating procedures such as the front attachment raising operation and the front attachment lowering operation, which are performed by the operator in reference to the instruction manual in the related art, can be performed with greater ease and a higher degree of reliability.

INDUSTRIAL APPLICABILITY

While an explanation has been given on an example in which the present invention is adopted in an operation assist apparatus that displays tower crane operating procedures, the present invention is adopted equally effectively in conjunction with construction machines other than tower cranes.

The invention claimed is:

1. An operation assisting apparatus comprising:

a display device installed in an operator's cab of a construction machine, at which at least operating procedures for the construction machine are displayed with text and illustrations;

an image processing device that generates images;

a control device that engages the image processing device to generate an image of an operating procedure corresponding to an operation of the construction machine and engages the display device to display the image generated by the image processing device;

an information detection device that detects information required to drive and operate the construction machine; and wherein the control device engages the image processing device to generate an image based upon the information detected by the information detecting device together with the image of the operating procedure and engages the display device to display the image of the operating procedure and the image of the information related to the construction machine which are generated by the image processing device; and wherein the information detection device detects a state quantity indicating a state of the construction machine, a posture of the construction machine and environment information indicating an environment surrounding the construction machine.

2. An operation assisting apparatus according to claim 1, wherein:

the control device engages the display device to display an operating procedure of a setup operation for raising or lowering a front attachment of the construction machine.

3. An operation assisting apparatus according to claim 1, wherein:

the control device updates the images displayed at the display device based upon the information detected by the information detection device.

4. An operation assisting apparatus according to claim 1, wherein:

the operating procedure of the construction machine displayed at the display device includes an instruction on how to operate the construction machine, verification items to be checked, inspection items to be checked and an operational warning, which match the information detected by the information detection device.

5. An operation assisting apparatus according to claim 1, wherein:

the control device engages the display device to display a subsequent operating procedure based upon the posture of the construction machine detected by the information detection device.

6. An operation assisting apparatus according to claim 1, further comprising:

a selection device that selects an operating procedure to be displayed at the display device, wherein:

the control device engages the display device to display the operating procedure selected by the selection device.

7. An operation assisting apparatus according to claim 1, wherein:

when the posture of the construction machine detected by the information detection device is within an allowable work range, the control device engages the display device to-display moment limiter information related to a load applied to the construction machine, instead of the operating procedure, at the display screen.

8. An operation assisting apparatus according to claim 1, wherein:

the control device engages the display device to display a list of the operating procedures in a tree format.

9. An operation assisting apparatus according to claim 8, wherein:

the control device sustains a display of the list of the operating procedures at all times at a portion of the display device.

10. An operation assisting apparatus according to claim 8, wherein:

the control device displays the list of the operating procedures at the display device.

11. An operation assisting apparatus according to claim 1, wherein:

the control device includes a storage unit that stores in memory the operating procedure displayed at the display device immediately before power to the construction machine is turned off and engages the display device to display the operating procedure stored in memory at the storage unit when the power to the construction machine is turned on again.

12. An operation assisting apparatus according to claim 1, further comprising:

an audio output device that outputs the operating procedures of the construction machine as audio instructions.

13. An operation assisting apparatus according to claim 1, wherein:

the display device further displays moment limiter information related to a load applied to the construction machine; and the control device engages the image processing device to generate an image providing the moment limiter information and an image of the operating procedure corresponding to the operation of the construction machine and engages the display device to display the images generated by the image processing device.

14. An operation assisting apparatus according to claim 13, further comprising:

an information detection device that detects a state quantity indicating a state of the construction machine, a posture of the construction machine and environment information indicating an environment surrounding the construction machine, wherein:

the control device engages the image processing device to generate an image based upon the information detected by the information detection device and engages the display device to display one of the moment limiter information related to a load applied to the construction machine and the operating procedure in correspondence to the posture of the construction machine.

15. An operation assisting apparatus according to claim 14, wherein:

the control device switches the image displayed at the display device from the moment limiter information related to a load applied to the construction machine to the operating procedure when the posture of the construction machine detected by the information detection device is not within an allowable work range or when the posture of the construction machine detected by the information detection device which has been in the allowable work range shifts into outside of the allowable work range.

16. An operation assisting apparatus according to claim 14, wherein:

the operating procedure of the construction machine displayed at the display device includes an instruction on how to operate the construction machine, verification items to be checked, inspection items to be checked and an operational warning, which match the information detected by the information detection device, the operation assisting apparatus further comprises a selection device that selects an image to be displayed at the display device; and the control device engages the display device to display one of the operating procedure and the moment limiter information related to a load applied to the construction machine corresponding to the posture of the construction machine, or one of the operating procedure and the moment limiter information selected by the selection device.

17. An operation assisting apparatus according to claim 16, wherein:

the control device engages the display device to display a failure diagnosis screen when an error has been detected with regard to an inspection item.

18. An operation assisting apparatus according to claim 16, wherein:

the operating procedure of the construction machine displayed by the control device further includes a handling instruction; and if the handling instruction is selected by the selection device, the control device engages the display device to display the handling instruction corresponding to the screen currently on display.

19. An operation assisting apparatus according to claim 14, wherein:

the information detection device detects whether or not a front attachment is mounted at the construction machine; and the control device engages the display device to display the operating procedure if the information detection device detects that a front attachment is not mounted.

20. An operation assisting apparatus according to claim 13, wherein:

the control device engages the display device to display an operating procedure of a setup operation for raising or lowering a front attachment of the construction machine.

21. A construction machine having an operation assisting apparatus according to claim 1.

* * * * *